US009837012B2

(12) United States Patent
Ikeda et al.

(10) Patent No.: US 9,837,012 B2
(45) Date of Patent: Dec. 5, 2017

(54) DISPLAY DEVICE AND ELECTRONIC APPARATUS

(71) Applicant: Japan Display Inc., Minato-ku (JP)

(72) Inventors: Kojiro Ikeda, Minato-ku (JP); Masaaki Kabe, Minato-ku (JP); Akira Sakaigawa, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 56 days.

(21) Appl. No.: 15/084,531

(22) Filed: Mar. 30, 2016

(65) Prior Publication Data

US 2016/0307487 A1 Oct. 20, 2016

(30) Foreign Application Priority Data

Apr. 15, 2015 (JP) ..... 2015-083657

(51) Int. Cl.
*G09G 5/02* (2006.01)
*G09G 3/20* (2006.01)

(52) U.S. Cl.
CPC ... *G09G 3/2003* (2013.01); *G09G 2300/0452* (2013.01); *G09G 2340/0457* (2013.01)

(58) Field of Classification Search
CPC ..... G09G 3/2003; G09G 2340/0457; G09G 2300/0452
See application file for complete search history.

(56) References Cited

U.S. PATENT DOCUMENTS

2002/0186229 A1* 12/2002 Brown Elliott ..... G09G 3/20 345/649
2009/0315921 A1 12/2009 Sakaigawa et al.
2010/0149204 A1 6/2010 Han
2011/0181635 A1 7/2011 Kabe et al.
2013/0241810 A1 9/2013 Higashi et al.

FOREIGN PATENT DOCUMENTS

JP 9-247475 9/1997
JP 2010-33009 2/2010
JP 2011-154323 8/2011
JP 2013-195605 9/2013

* cited by examiner

*Primary Examiner* — Adam R Giesy
(74) *Attorney, Agent, or Firm* — Oblon, McClelland, Maier & Neustadt, L.L.P.

(57) ABSTRACT

A display device 10 includes are arranged in a matrix form and to which image information is input, and a signal processing unit 20. The signal processing unit 20 includes a rendering position deciding unit that decides whether or not a sub-pixel rendering process of changing input signal values of sub-pixels of a second pixel among a first pixel, the second pixel, and the third pixel is performed, a pattern information acquiring unit that acquires an arrangement of the sub-pixels in a processing direction of either of a portrait mode and a landscape mode as pattern information indicating a first arrangement pattern or a second arrangement pattern, and a rendering unit that performs a first sub-pixel rendering process or a second sub-pixel rendering process on the input signals of the sub-pixels of the second pixel based on the decision of the rendering position deciding unit and the pattern information.

20 Claims, 29 Drawing Sheets

FIG.20A

| | | |
|---|---|---|
| G R<br>B W<br>PROCESSING DIRECTION<br>FIRST PORTRAIT MODE | SECOND ARRANGEMENT PATTERN | BGR RENDERING |
| R W<br>G B<br>PROCESSING DIRECTION<br>FIRST LANDSCAPE MODE | FIRST ARRANGEMENT PATTERN | RGB RENDERING |
| W B<br>R G<br>PROCESSING DIRECTION<br>SECOND PORTRAIT MODE | FIRST ARRANGEMENT PATTERN | RGB RENDERING |
| B G<br>W R<br>PROCESSING DIRECTION<br>SECOND LANDSCAPE MODE | SECOND ARRANGEMENT PATTERN | BGR RENDERING |

FIG.20B

| | | |
|---|---|---|
| G B<br>R W<br>PROCESSING DIRECTION<br>FIRST PORTRAIT MODE | FIRST ARRANGEMENT PATTERN | RGB RENDERING |
| B W<br>G R<br>PROCESSING DIRECTION<br>FIRST LANDSCAPE MODE | SECOND ARRANGEMENT PATTERN | BGR RENDERING |
| W R<br>B G<br>PROCESSING DIRECTION<br>SECOND PORTRAIT MODE | SECOND ARRANGEMENT PATTERN | BGR RENDERING |
| R G<br>W B<br>PROCESSING DIRECTION<br>SECOND LANDSCAPE MODE | FIRST ARRANGEMENT PATTERN | RGB RENDERING |

FIG.24A

| | | | |
|---|---|---|---|
| G R<br>B W<br>PROCESSING DIRECTION<br>FIRST PORTRAIT MODE | SECOND ARRANGEMENT PATTERN | FIRST BW ARRANGE-MENT | RGB RENDERING AND CORRECTION PROCESS ON PIXEL OF $X_{A1(p,q)}<X_{A2(p,q)}<X_{A3(p,q)}$ |
| R W<br>G B<br>PROCESSING DIRECTION<br>FIRST LANDSCAPE MODE | FIRST ARRANGEMENT PATTERN | SECOND BW ARRANGE-MENT | BRG RENDERING AND CORRECTION PROCESS ON PIXEL OF $X_{A1(p,q)}>X_{A2(p,q)}>X_{A3(p,q)}$ |
| W B<br>R G<br>PROCESSING DIRECTION<br>SECOND PORTRAIT MODE | FIRST ARRANGEMENT PATTERN | FIRST BW ARRANGE-MENT | BGR RENDERING AND CORRECTION PROCESS ON PIXEL OF $X_{A1(p,q)}<X_{A2(p,q)}<X_{A3(p,q)}$ |
| B G<br>W R<br>PROCESSING DIRECTION<br>SECOND LANDSCAPE MODE | SECOND ARRANGEMENT PATTERN | SECOND BW ARRANGE-MENT | RGB RENDERING AND CORRECTION PROCESS ON PIXEL OF $X_{A1(p,q)}>X_{A2(p,q)}>X_{A3(p,q)}$ |

FIG.24B

| | | | |
|---|---|---|---|
| G B<br>R W<br>PROCESSING DIRECTION<br>FIRST PORTRAIT MODE | FIRST ARRANGEMENT PATTERN | SECOND BW ARRANGE-MENT | BGR RENDERING AND CORRECTION PROCESS ON PIXEL OF $X_{A1(p,q)}>X_{A2(p,q)}>X_{A3(p,q)}$ |
| B W<br>G R<br>PROCESSING DIRECTION<br>FIRST LANDSCAPE MODE | SECOND ARRANGEMENT PATTERN | FIRST BW ARRANGE-MENT | RGB RENDERING AND CORRECTION PROCESS ON PIXEL OF $X_{A1(p,q)}<X_{A2(p,q)}<X_{A3(p,q)}$ |
| W R<br>B G<br>PROCESSING DIRECTION<br>SECOND PORTRAIT MODE | SECOND ARRANGEMENT PATTERN | SECOND BW ARRANGE-MENT | RGB RENDERING AND CORRECTION PROCESS ON PIXEL OF $X_{A1(p,q)}>X_{A2(p,q)}>X_{A3(p,q)}$ |
| R G<br>W B<br>PROCESSING DIRECTION<br>SECOND LANDSCAPE MODE | FIRST ARRANGEMENT PATTERN | FIRST BW ARRANGE-MENT | BGR RENDERING AND CORRECTION PROCESS ON PIXEL OF $X_{A1(p,q)}<X_{A2(p,q)}<X_{A3(p,q)}$ |

DISPLAY DEVICE AND ELECTRONIC APPARATUS

CROSS-REFERENCE TO RELATED APPLICATIONS

This application claims priority from Japanese Application No. 2015-083657, filed on Apr. 15, 2015, the contents of which are incorporated by reference herein in its entirety.

BACKGROUND

1. Technical Field

The present disclosure relates to a display device and an electronic apparatus.

2. Description of the Related Art

In recent years, the demand for display devices for mobile apparatuses such as mobile phones and electronic paper has been increased. In the display devices, one pixel includes a plurality of sub-pixels that output light of different colors, and various colors are displayed through one pixel by combining the colors of the sub-pixels. In the display devices, display characteristics such as a resolution and luminance have been improved year after year as well. However, since an aperture ratio decreases as a resolution increases, it is necessary to increase luminance of a backlight in order to implement high luminance, which leads to an increase in power consumption of the backlight. In order to solve this problem, a technique that adds a white sub-pixel serving as a fourth sub-pixel to red, green, and blue sub-pixels serving as first to third sub-pixels known in the art has been proposed. According to this technique, a current value of the backlight is reduced as the white sub-pixel enhances the luminance, and thus the power consumption is reduced.

Here, the display device controls light-emitting of a plurality of sub-pixels such that a predetermined color is displayed through one pixel. Thus, the display device commonly performs display driving using a plurality of sub-pixels arranged in one pixel as a set. In other words, the display device commonly performs display driving in units of pixels. Meanwhile, a technique called sub-pixel rendering of performing display driving by controlling outputs of the sub-pixels independently is known. In the sub-pixel rendering, since display driving is independently performed for each sub-pixel, the resolution can be increased in a pseudo manner. The sub-pixel rendering is used, for example, when a font of characters or the like is displayed.

Here, when the sub-pixel rendering is performed, for example, the deterioration of the image in which a portion becomes dark is likely to be viewed according to an arrangement direction of the sub-pixels in the pixel.

In order to solve the above problems, it is an object of the present invention to provide a display device and an electronic apparatus, which are capable of suppressing the deterioration of the image when the sub-pixel rendering is performed.

SUMMARY

According to an aspect, a display device includes an image display panel that includes a plurality of pixels that are arranged on a display region of a square shape having a first side and a second side intersecting with the first side in a matrix form and receives image information of a portrait mode in which a direction along the first side is a predetermined one direction of a display image or a landscape mode in which a direction along the second side is the one direction of the display image, each of the plurality of pixels including a first sub-pixel, a second sub-pixel, a third sub-pixel, and a fourth sub-pixel arranged in a 2×2 matrix form, and a signal processing unit that generates output signals from input values of input signals for the first sub-pixel, the second sub-pixel, and the third sub-pixel, and outputs the generated output signals to the image display panel. The signal processing unit includes a rendering position deciding unit that decides whether or not a sub-pixel rendering process is performed, among the plurality of arranged pixels including a first pixel, a second pixel neighboring the first pixel at a side in a predetermined processing direction, and a third pixel neighboring the second pixel at the side in the processing direction, the sub-pixel rendering process changing input signal values of sub-pixels of the second pixel, a pattern information acquiring unit that acquires an arrangement of the sub-pixels in the processing direction of a display mode indicating either of the portrait mode and the landscape mode as pattern information indicating any one of a first arrangement pattern and a second arrangement pattern that differ in the arrangement of the sub-pixels, and a rendering unit that generates rendering input signals of the sub-pixels of the second pixel by performing either of a first sub-pixel rendering process and a second sub-pixel rendering process of the sub-pixel rendering process on input signals of the sub-pixels of the second pixel based on the decision of the rendering position deciding unit and the pattern information, the second sub-pixel rendering process differing from the first sub-pixel rendering process in a change in signal values of the input signals of the sub-pixels. The processing direction is a direction along the first side of the image display panel when the display mode is the portrait mode and a direction along the second side of the image display panel when the display mode is the landscape mode.

According to an another aspect, a display device includes an image display panel that includes a plurality of pixels that are arranged on a display region of a square shape having a first side and a second side intersecting with the first side in a matrix form and receives image information of a portrait mode in which a direction along the first side is a predetermined one direction of a display image or a landscape mode in which a direction along the second side is the one direction of the display image, each of the plurality of pixels including a first sub-pixel, a second sub-pixel, a third sub-pixel, and a fourth sub-pixel arranged in a 2×2 matrix form; and a signal processing unit that generates output signals from input values of input signals for the first sub-pixel, the second sub-pixel, and the third sub-pixel, and outputs the generated output signals to the image display panel, wherein the signal processing unit includes a rendering unit that generates a rendering input signal by performing a predetermined sub-pixel rendering process, the plurality of arranged pixels including a first pixel, a second pixel neighboring the first pixel at a side in a predetermined processing direction, and a third pixel neighboring the second pixel at the side in the processing direction, the predetermined sub-pixel rendering process changing signal values of input signals of sub-pixels of the second pixel, a pattern information acquiring unit that acquires an arrangement of the sub-pixels in the processing direction of a display mode indicating either of the portrait mode and the landscape mode as pattern information indicating any one of a first arrangement pattern and a second arrangement pattern that differ in the arrangement of the sub-pixels, a correction process deciding unit that decides whether or not an output signal of the fourth sub-pixel of the second pixel is generated based on the pattern information through a correction process, a fourth sub-pixel generation signal unit that obtains a generation signal of the fourth sub-pixel of the second pixel based on the rendering input signals of the first sub-pixel, the second sub-pixel, and the third sub-pixel of the second pixel, and an expansion coefficient related to the image display panel, based on the decision of the correction process deciding unit, a fourth sub-pixel output signal generating unit that performs the correction process by performing an averaging process based on the generation signal of the fourth sub-pixel of the second pixel and input signals of other sub-pixels, and generates the output signal of the fourth sub-pixel of the second pixel, an output signal generating unit that obtains the output signal of the first sub-pixel of the second pixel based on the rendering input signal of the first sub-pixel of the second pixel, the output signal of the fourth sub-pixel of the second pixel, and the expansion coefficient, obtains the output signal of the second sub-pixel of the second pixel based on the rendering input signal of the second sub-pixel of the second pixel, the output signal of the fourth sub-pixel of the second pixel, and the expansion coefficient, and obtains the output signal of the third sub-pixel of the second pixel based on the rendering input signal of the third sub-pixel of the second pixel, the output signal of the fourth sub-pixel of the second pixel, and the expansion coefficient, and the processing direction is a direction along the first side of the image display panel when the display mode is the portrait mode and a direction along the second side of the image display panel when the display mode is the landscape mode.

According to an another aspect, A display device includes an image display panel that includes a plurality of pixels that are arranged on a display region of a square shape having a first side and a second side intersecting with the first side in a matrix form and receives image information of a portrait mode in which a direction along the first side is a predetermined one direction of a display image or a landscape mode in which a direction along the second side is the one direction of the display image, each of the plurality of pixels including a first sub-pixel, a second sub-pixel, a third sub-pixel, and a fourth sub-pixel arranged in a 2×2 matrix form; and a signal processing unit that generates output signals from input values of input signals for the first sub-pixel, the second sub-pixel, and the third sub-pixel, and outputs the generated output signals to the image display panel, wherein the signal processing unit includes a rendering unit that generates a rendering input signal by performing a predetermined sub-pixel rendering process, the plurality of arranged pixels including a first pixel, a second pixel neighboring the first pixel at a side in a predetermined processing direction, and a third pixel neighboring the second pixel at the side in the processing direction, the predetermined sub-pixel rendering process changing signal values of input signals of sub-pixels of the second pixel, a sub-pixel generation signal unit that generates generation signals of the first sub-pixel, the second sub-pixel, the third sub-pixel, and the fourth sub-pixel based on the input signal values and the rendering input signal values of the sub-pixels in each of the pixels, a correction process deciding unit that decides whether or not the output signal of the fourth sub-pixel of the second pixel is generated through a correction process based on a generation signal value of a neighboring sub-pixel and generation signal values of both-side sub-pixels, the neighboring subpixel is served as a sub-pixel of the second pixel neighboring the fourth sub-pixel of the second pixel in an orthogonal direction serving as a direction orthogonal to the processing direction, and the both-side sub-pixels are served as a plurality of sub-pixels neighboring the neighboring sub-pixel or the fourth sub-pixel of the second pixel in the processing direction or an opposite direction serving as a direction opposite to the processing direction, a fourth sub-pixel output signal generating unit that performs the correction process based on the decision of the correction process deciding unit, by performing an averaging process based on the generation signal of the fourth sub-pixel of the second pixel and input signals of other sub-pixels, and generates the output signal of the fourth sub-pixel of the second pixel, an output signal generating unit that obtains the output signal of the first sub-pixel of the second pixel based on the rendering input signal of the first sub-pixel of the second pixel, the output signal of the fourth sub-pixel of the second pixel, and the expansion coefficient, obtains the output signal of the second sub-pixel of the second pixel based on the rendering input signal of the second sub-pixel of the second pixel, the output signal of the fourth sub-pixel of the second pixel, and the expansion coefficient, and obtains the output signal of the third sub-pixel of the second pixel based on the rendering input signal of the third sub-pixel of the second pixel, the output signal of the fourth sub-pixel of the second pixel, and the expansion coefficient, and the processing direction is a direction along the first side of the image display panel when the image information corresponds to the portrait mode and a direction along the second side of the image display panel when the image information corresponds to the landscape mode.

BRIEF DESCRIPTION OF THE DRAWINGS

FIG. 20A is a table indicating a relation among a display mode, an arrangement pattern, and a rendering process of the image display panel according to the first embodiment;

FIG. 20B is a table indicating a relation among a display mode, an arrangement pattern, and a rendering process of another example of an image display panel according to the first embodiment;

FIG. 24A is a table indicating a relation between a display mode and a condition of a pixel that undergoes a correction process in the image display panel according to the second embodiment;

FIG. 24B is a table indicating a relation between a display mode and a condition of a pixel that undergoes a correction process in another example of the image display panel according to the second embodiment;

DETAILED DESCRIPTION

Figure 1:
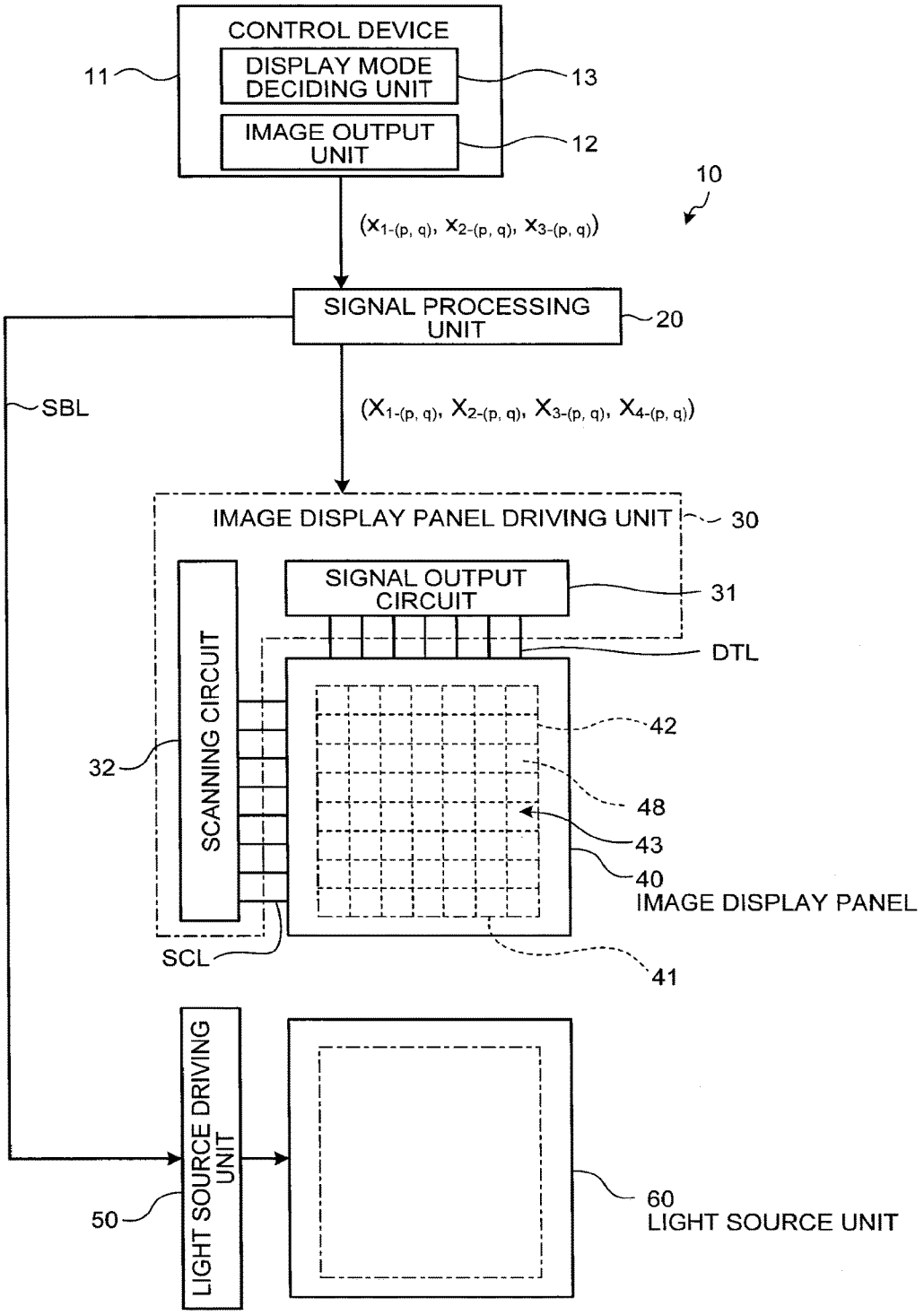
FIG. 1 is a block diagram illustrating an exemplary configuration of a display device according to a first embodiment.

Hereinafter, exemplary embodiments of the present invention will be described with reference to the accompanying drawings. The disclosure is given by way of example, and modifications that maintain the gist of the present invention and are easily conceivable by those skilled in the art are included in the present invention. To further clarify the description, the width, thickness, shape, and the like of each component may be schematically illustrated in the drawings as compared to actual aspects, and they are given by way of example and interpretation of the present invention is not limited to them. The same elements as those described in the description with reference to some drawings are denoted by the same reference numerals through the description and the drawings, and detailed descriptions thereof will be omitted in some cases.

First Embodiment

Overall Configuration of Display Device

First, a first embodiment (a first aspect) will be described. FIG. 1 is a block diagram of an exemplary configuration of a display device according to a first embodiment. A display device 10 according to the first embodiment includes a signal processing unit 20, an image display panel driving unit 30, an image display panel 40, a light source driving unit 50, and a light source unit 60 as illustrated in FIG. 1. The signal processing unit 20 receives an input signal (RGB data) from an image output unit 12 of a control device 11, and transfers a signal generated by performing a predetermined data conversion process on the input signal to the respective units of the display device 10. The image display panel driving unit 30 controls driving of the image display panel 40 based on the signal received from the signal processing unit 20. The light source driving unit 50 controls driving of the light source unit 60 based on the signal received from the signal processing unit 20. The light source unit 60 illuminates the back surface of the image display panel 40 with light based on the signal received from the light source driving unit 50. The image display panel 40 displays an image based on the signal received from the image display panel driving unit 30 and the light emitted from the light source unit 60. The control device 11 includes a display mode deciding unit 13 that detects a direction in the vertical direction of the display device 10 through an acceleration sensor, and decides a display mode of the image display panel 40.

Configuration of Image Display Panel

Figure 2:
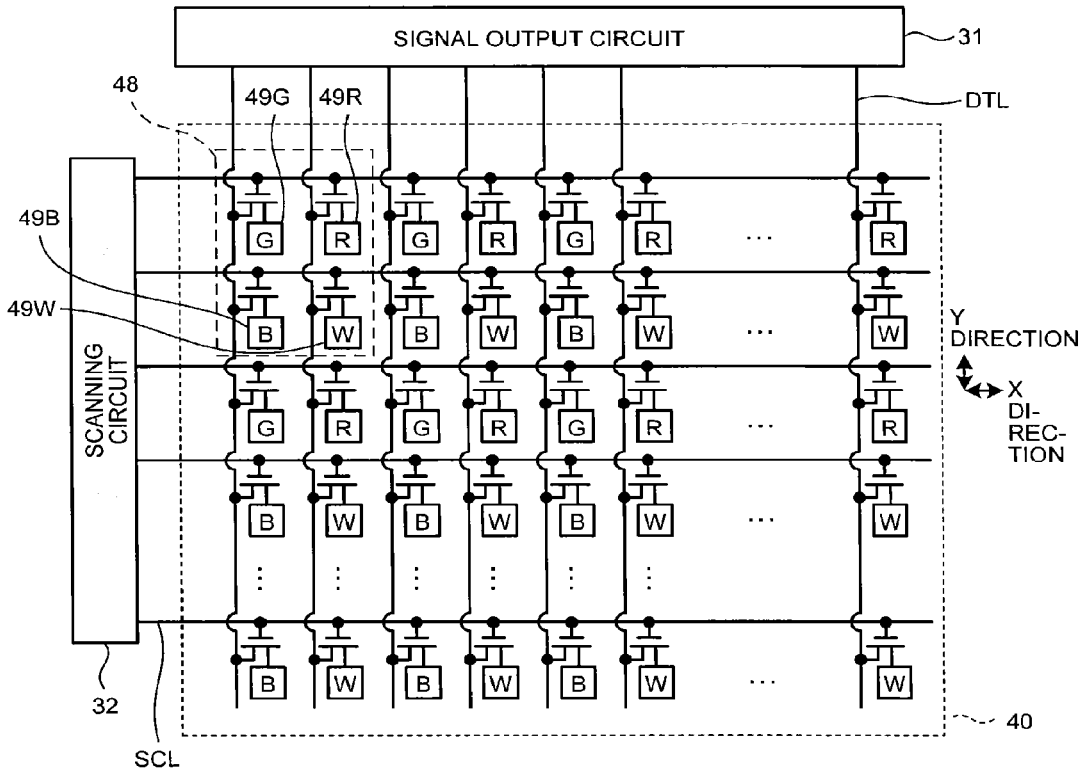
FIG. 2 is a conceptual diagram of an image display panel according to the first embodiment.
Figure 3:
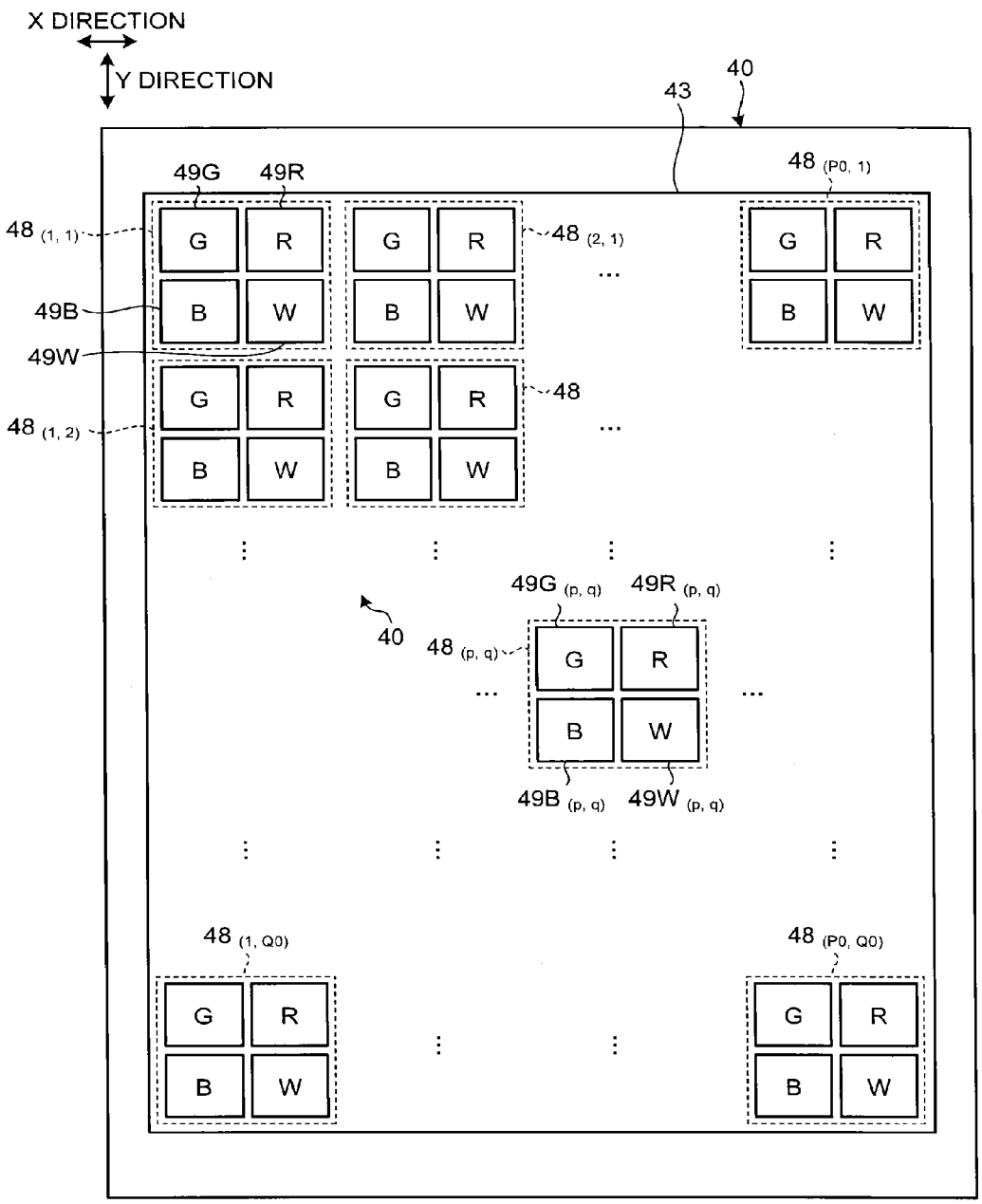
FIG. 3 is a schematic diagram illustrating a sub-pixel arrangement according to the first embodiment.

First, a configuration of the image display panel 40 will be described. FIG. 2 is a conceptual diagram the image display panel according to the first embodiment. FIG. 3 is a schematic diagram illustrating a sub-pixel arrangement according to the first embodiment. The image display panel 40 includes a display region 43 in which $P_0 \times Q_0$ pixels 48 ($P_0$ pixels in an X direction and $Q_0$ pixels in a Y direction) are arranged in a two-dimensional (2D) matrix form as illustrated in FIGS. 1, 2, and 3. Here, the X direction is the row direction of an image displayed on the image display panel 40. The Y direction is a direction orthogonal to the X direction, that is, the column direction of an image displayed on the image display panel 40. An embodiment is not limited thereto, and the X direction may be the column direction of the image, and the Y direction may be the row direction of the image. The display region 43 of the image display panel 40 has a rectangular shape including a short side 41 serving as a first side and a long side 42 serving as a second side intersecting with the short side 41 as illustrated in FIG. 1. The display region 43 may have a quadrangular shape, for example, a square shape in which the short side 41 and the long side 42 have the same length.

Each of the pixels 48 includes a first sub-pixel 49R, a second sub-pixel 49G, a third sub-pixel 49B, and a fourth sub-pixel 49W as illustrated in FIGS. 2 and 3. The first sub-pixel 49R displays a first color (red in the first embodiment). The second sub-pixel 49G displays a second color (green in the first embodiment). The third sub-pixel 49B displays a third color (blue in the first embodiment). The fourth sub-pixel 49W displays a fourth color (white in the first embodiment). The first, the second, the third, and the fourth colors are not limited to red, green, blue, and white, respectively, and simply need only to be different from one another, such as complementary colors. The fourth sub-pixel 49W that displays the fourth color preferably has higher luminance than that of the first sub-pixel 49R that displays the first color, the second sub-pixel 49G that displays the second color, and the third sub-pixel 49B that displays the third color when they are irradiated with light with the same light source lighting amount. In the following description, when it is unnecessary to distinguish the first sub-pixel 49R, the second sub-pixel 49G, the third sub-pixel 49B, and the fourth sub-pixel 49W, they are referred to as a "sub-pixel 49." To distinguish and specify a position at which a sub-pixel is arranged, for example, a fourth sub-pixel in a pixel $\mathbf{48}_{(p,q)}$ is referred to as a "fourth sub-pixel $\mathbf{49}W_{(p,q)}$."

As illustrated in FIG. 3, the pixel 48 includes the four sub-pixels 49 which are arranged in a 2×2 matrix form. The four sub-pixels 49 are the first sub-pixel 49R, the second sub-pixel 49G, the third sub-pixel 49B, and the fourth sub-pixel 49W.

Figure 4A:
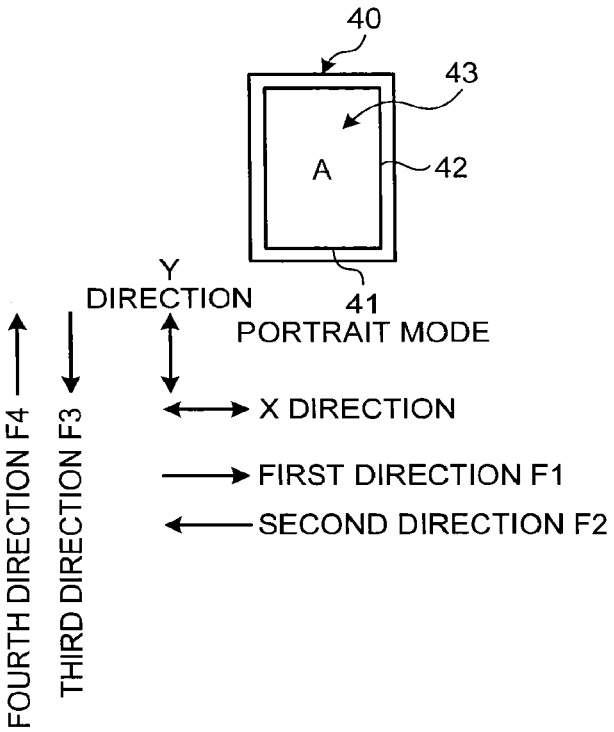
FIG. 4A is a schematic diagram for describing a portrait mode and a landscape mode.
Figure 4B:
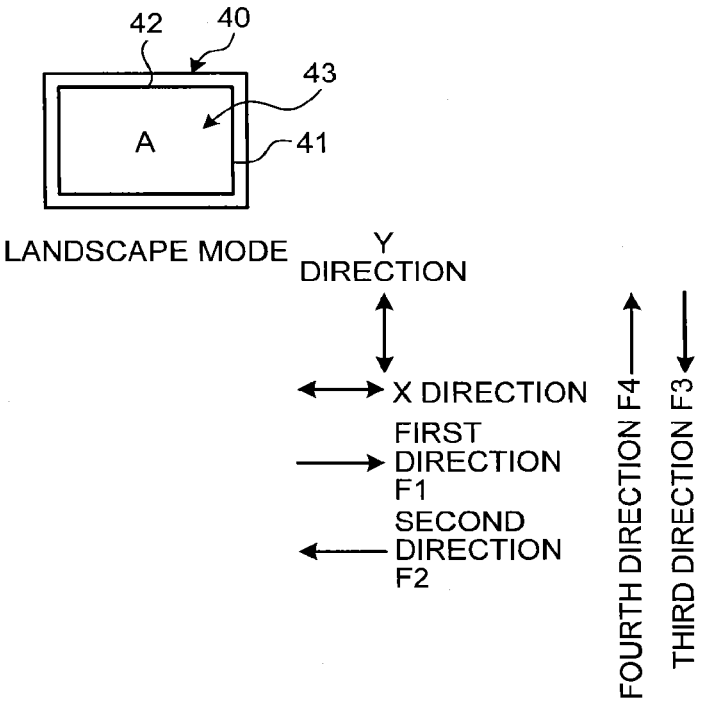
FIG. 4B is a schematic diagram for describing a portrait mode and a landscape mode.

The image display panel 40 receives image information corresponding to a portrait mode or a landscape mode according to decision of the display mode deciding unit 13 of the control device 11. Here, the image information is information for displaying an image. In further detail, the control device 11 outputs an input signal corresponding to the display mode of either of the portrait mode and the landscape mode to the signal processing unit 20 according to the decision of the display mode deciding unit 13. Then, the signal processing unit 20 generates an output signal based on the input signal. The image display panel driving unit 30 generates image information (video signal) for displaying an image based on the output signal, and outputs the image information to the image display panel 40. FIGS. 4A and 4B are schematic diagrams for describing the portrait mode and the landscape mode. FIGS. 4A and 4B illustrate examples in which an alphabet A is displayed on the image display panel 40.

Here, as illustrated in FIG. 4A, in the portrait mode, the short side 41 of the image display panel 40 lies in the X direction serving as the row direction of the image. In the portrait mode, the long side 42 of the image display panel 40 lies in the Y direction serving as the column direction of the image. On the other hand, as illustrated in FIG. 4B, in the landscape mode, the short side 41 lies in the Y direction serving as the column direction of the image. In the landscape mode, the long side 42 lies in the X direction serving as the row direction of the image. In other words, the image display panel 40 sets a direction along the short side 41 as a predetermined one direction (here, the X direction) of a display image in the portrait mode, and sets a direction along the long side 42 as the predetermined one direction (here, the X direction) of a display image in the landscape mode.

The portrait mode and the landscape mode are not limited to the examples illustrated in FIGS. 4A and 4B. Here, in the direction along the X direction, one direction is referred to as a "first direction F1,", the other direction is referred to as a "second direction F2." Further, in the direction along the Y direction, one direction is referred to as a "third direction F3," and the other direction is referred to as a "fourth direction F4." The portrait mode includes a first portrait mode (see FIG. 4A) in which the short side 41 is positioned at a side of the image in the third direction F3 and a second portrait mode in which the short side 41 is positioned at a side of the image in the fourth direction F4. The landscape mode includes a first landscape mode (see FIG. 4B) in which the short side 41 is positioned at a side of the image in the first direction F1 and a second landscape mode in which the short side 41 is positioned at a side of the image in the second direction F2. The image display panel 40 is preferably capable of displaying at least one portrait mode and at least one landscape mode. The first direction F1, the second direction F2, the third direction F3, and the fourth direction F4 are not limited to the above directions as long as the first direction F1, the second direction F2, the third direction F3, and the fourth direction F4 are one directions along the X direction or the Y direction and different.

Here, arrangement orders of the pixels 48 and the sub-pixels 49 are fixed to the short side 41 and the long side 42 of the image display panel 40. Thus, as will be described later, the arrangement orders of the pixels 48 and the sub-pixels 49 in the X direction and the Y direction change according to the display mode.

Figure 5:
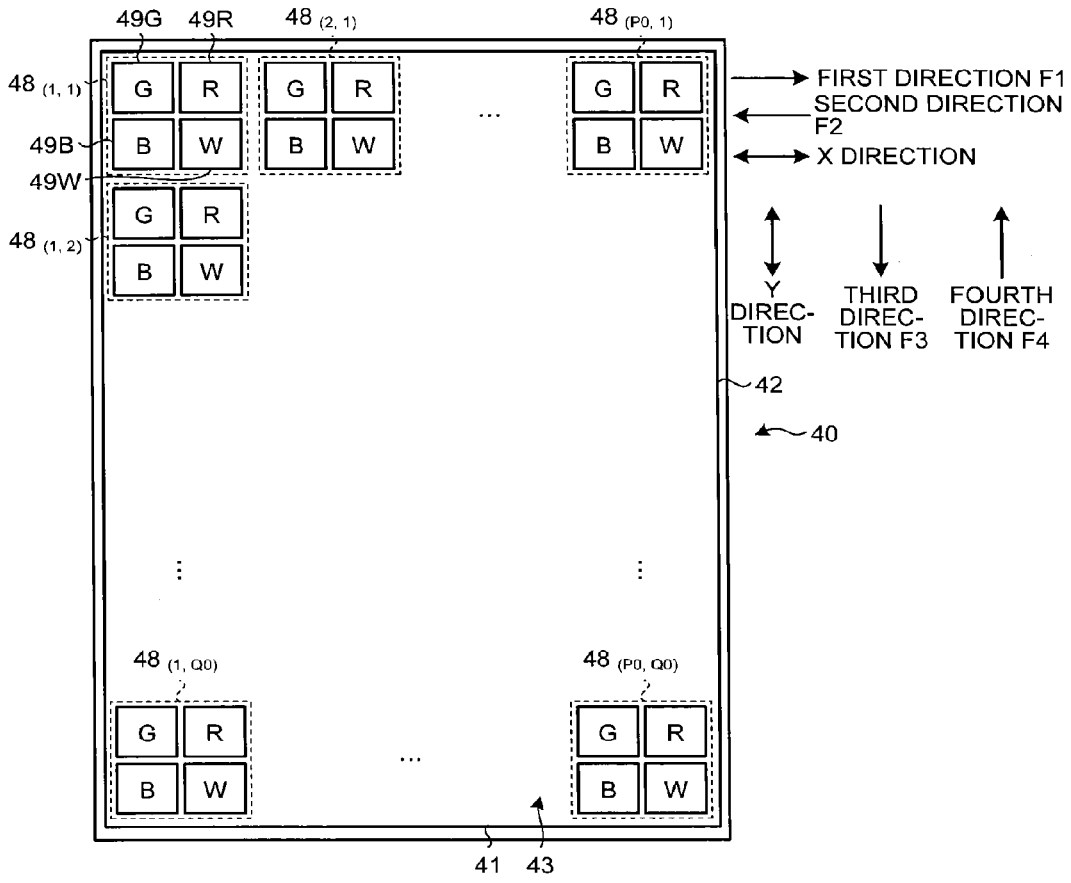
FIG. 5 is a schematic diagram illustrating an example of a sub-pixel arrangement in a portrait mode.
Figure 6:
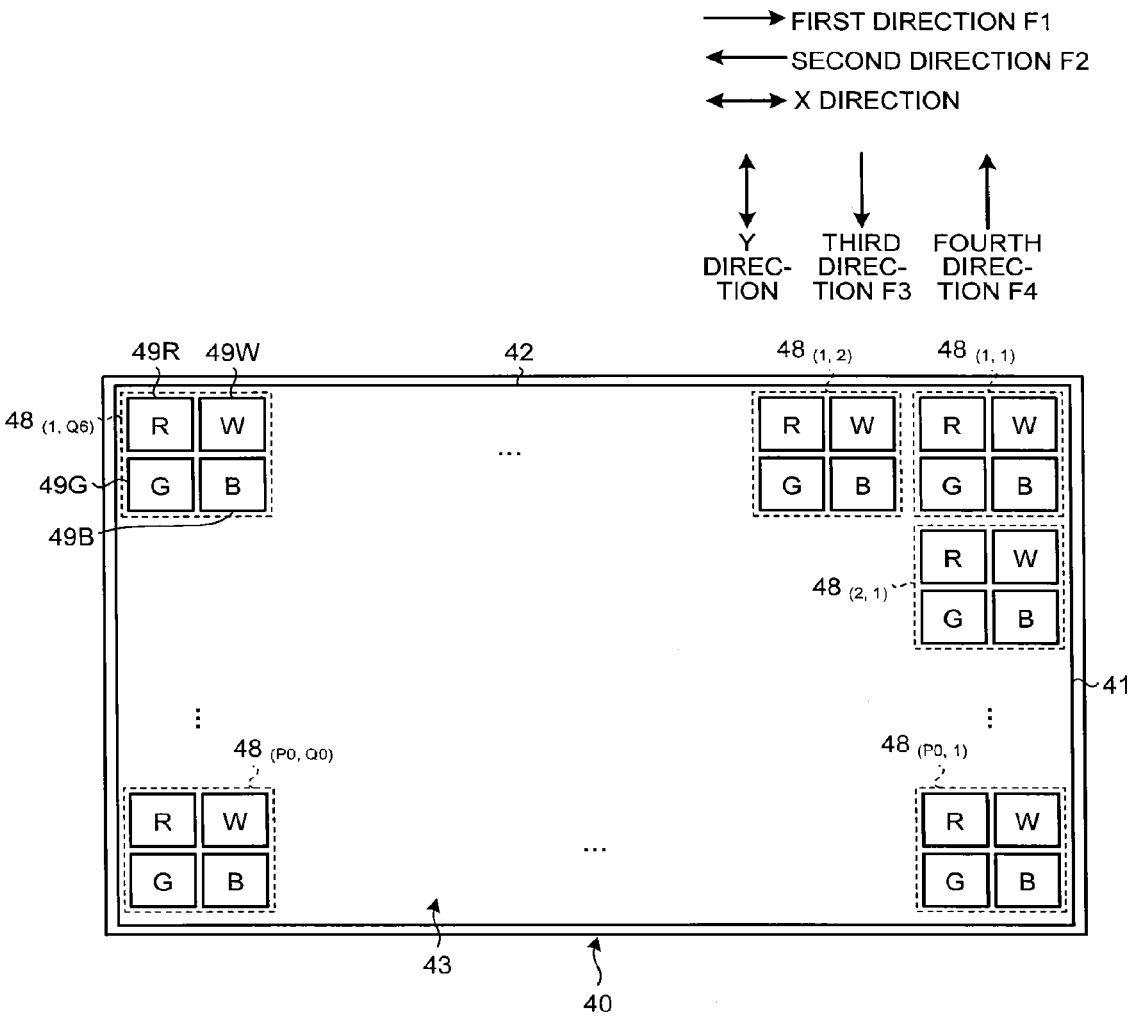
FIG. 6 is a schematic diagram illustrating an example of a sub-pixel arrangement in a landscape mode.

FIG. 5 is a schematic diagram illustrating an example of a sub-pixel arrangement in the portrait mode. FIG. 6 is a schematic diagram illustrating an example of a sub-pixel arrangement in the landscape mode. FIG. 5 illustrates the first portrait mode in which the short side 41 is positioned at the side of the image in the third direction F3. In the portrait mode illustrated in FIG. 5, a pixel $\mathbf{48}_{(1,1)}$ and a pixel $\mathbf{48}_{(2,1)}$ are arranged in the first direction F1 in this order. Further, in the portrait mode illustrated in FIG. 5, the pixel $\mathbf{48}_{(1,1)}$ and a pixel $\mathbf{48}_{(1,2)}$ are arranged in the third direction F3 in this order.

In the landscape mode illustrated in FIG. 6, the pixel $\mathbf{48}_{(1,1)}$ and the pixel $\mathbf{48}_{(2,1)}$ are arranged in the third direction F3 in this order. Further, in the landscape mode illustrated in FIG. 6, the pixel $\mathbf{48}_{(1,1)}$ and the pixel $\mathbf{48}_{(1,2)}$ are arranged in the second direction F2 in this order. As described above, the arrangement order of the pixels 48 in the X direction and the Y direction changes according to the display mode.

As described above, when the X direction is the row direction of the image, and the Y direction is the column direction of the image, in the portrait mode illustrated in FIG. 5, the second sub-pixel 49G is arranged in the first row of the first column of the pixel 48. The third sub-pixel 49B is arranged in the second row of the first column of the pixel 48. The first sub-pixel 49R is arranged in the first row of the second column of the pixel 48. The fourth sub-pixel 49W is arranged in the second row of the second column of the pixel 48. In other words, in the portrait mode illustrated in FIG. 5, the second sub-pixel 49G and the first sub-pixel 49R are arranged in the first direction F1 in this order. Further, in the portrait mode illustrated in FIG. 5, the third sub-pixel 49B and the fourth sub-pixel 49W are arranged in the first direction F1 in this order. Further, in the portrait mode illustrated in FIG. 5, the second sub-pixel 49G and the third sub-pixel 49B are arranged in the third direction F3 in this order, and the first sub-pixel 49R and the fourth sub-pixel 49W are arranged in the third direction F3 in this order.

In the sub-pixel arrangement of the landscape mode in FIG. 6, the first sub-pixel 49R is arranged in the first row of the first column of the pixel 48, the second sub-pixel 49G is arranged in the second row of the first column of the pixel 48, the fourth sub-pixel 49W is arranged in the first row of the second column of the pixel 48, and the third sub-pixel 49B is arranged in the second row of the second column of the pixel 48. In other words, in the landscape mode illustrated in FIG. 6, the first sub-pixel 49R and the fourth sub-pixel 49W are arranged in the first direction F1 in this order, and the second sub-pixel 49G and the third sub-pixel 49B are arranged in the first direction F1 in this order. Further, in the landscape mode illustrated in FIG. 6, the first sub-pixel 49R and the second sub-pixel 49G are arranged in the third direction F3 in this order, and the fourth sub-pixel 49W and the third sub-pixel 49B are arranged in the third direction F3 in this order. As described above, the sub-pixel arrangement in the X direction and the Y direction changes according to the display mode. The arrangement is not limited to the examples illustrated in FIGS. 5 and 6 as long as the sub-pixels 49 are arranged in the pixel 48 in the 2×2 matrix form. Hereinafter, unless otherwise set forth, the arrangements of the pixels 48 and the sub-pixels 49 are assumed to be the arrangements in the first portrait mode illustrated in FIG. 5.

Configuration of Image Display Panel Driving Unit

The image display panel driving unit 30 includes a signal output circuit 31 and a scanning circuit 32 as illustrated in FIGS. 1 and 2. The image display panel driving unit 30 holds video signals (the image information) in the signal output circuit 31 and sequentially outputs the video signals to the image display panel 40. More specifically, the signal output circuit 31 outputs an image output signal having a certain electric potential corresponding to the output signal from the signal processing unit 20 to the image display panel 40. The signal output circuit 31 is electrically connected to the image display panel 40 through signal lines DTL. The scanning circuit 32 controls an ON/OFF operation of a switching element (e.g., a thin-film transistor (TFT)) that controls an operation (light transmittance) of the sub-pixel 49 in the image display panel 40. The scanning circuit 32 is electrically connected to the image display panel 40 through wirings SCL.

Configurations of Light Source Driving Unit and Light Source Unit

The light source driving unit 50 controls the amount of light output from the light source unit 60, for example. Specifically, the light source driving unit 50 adjusts, for example, a voltage supplied to the light source unit 60 through pulse width modulation (PWM) based on a light source driving signal SBL output from the signal processing unit 20, and a light amount (intensity of light) of light with which the image display panel 40 is irradiated.

The light source unit 60 is arranged on the back surface of the image display panel 40, and emits light toward the image display panel 40 and illuminates the image display panel 40 with light. The light source unit 60 irradiates the image display panel 40 with light, and makes the image display panel 40 brighter.

Configuration of Signal Processing Unit

The signal processing unit 20 processes an input signal received from the control device 11, and generates an output signal. The signal processing unit 20 converts an input value of the input signal displayed by combining red (the first color), green (the second color), and blue (the third color) into an extended value (output signal) in an extended color space (a HSV (Hue-Saturation-Value, Value is also called Brightness) color space in the first embodiment) extended by red (the first color), green (the second color), blue (the third color), and white (the fourth color), and generates the output value. The signal processing unit 20 outputs the generated output signal to the image display panel driving unit 30. The extended color space will be described later. While the extended color space according to the first embodiment is the HSV color space, it is not limited thereto, and any other coordinate system such as an XYZ color space and a YUV space may be the expanded color space. The signal processing unit 20 also generates the light source driving signal SBL to be output to the light source driving unit 50.

Figure 7:
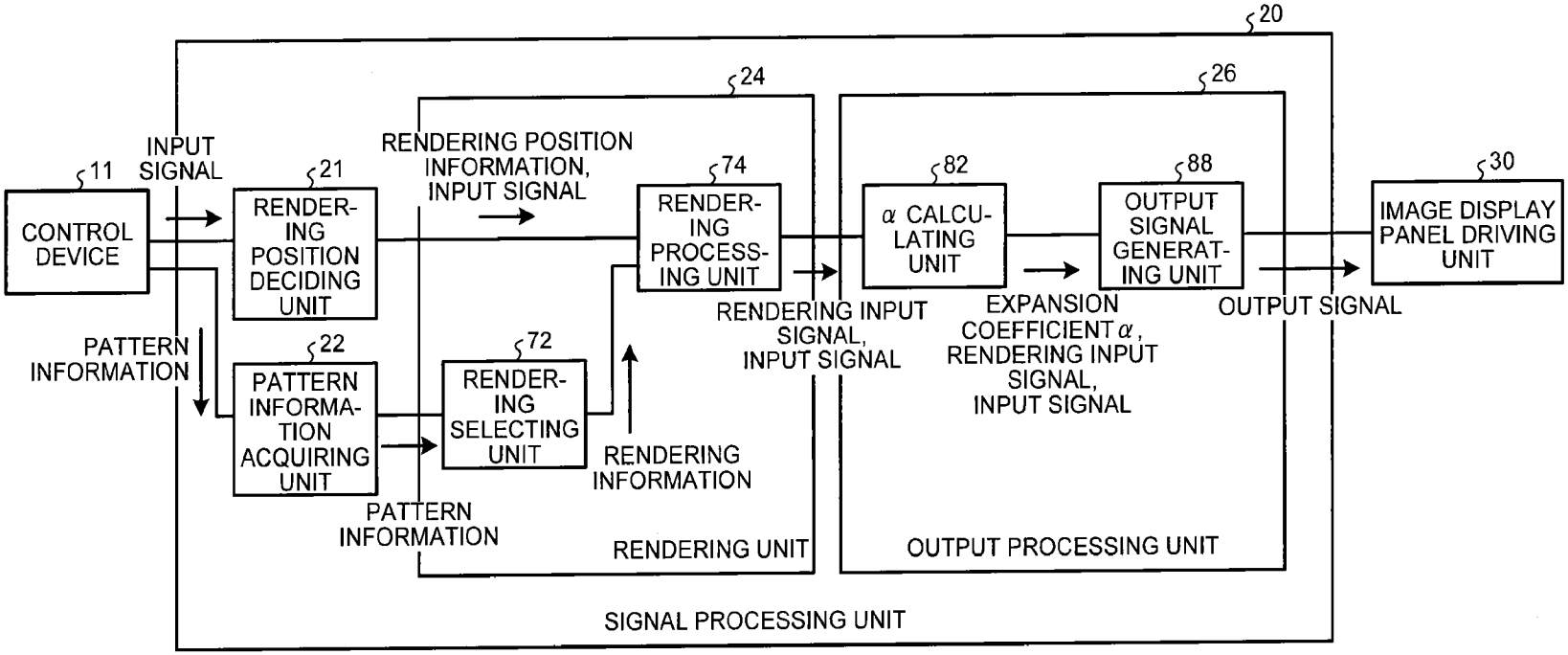
FIG. 7 is a block diagram illustrating an overview of a configuration of a signal processing unit according to the first embodiment.

FIG. 7 is a block diagram illustrating an overview of a configuration of the signal processing unit according to the first embodiment. The signal processing unit 20 includes a rendering position deciding unit 21, a pattern information acquiring unit 22, a rendering unit 24, and an output processing unit 26 as illustrated in FIG. 7. The respective units of the signal processing unit 20 may be independent units (circuits or the like) or may be a common unit.

The rendering position deciding unit 21 acquires an input signal for causing each pixel to display a predetermined color from the control device 11. The rendering position deciding unit 21 decides the pixel 48 to which a sub-pixel rendering process is performed based on the input signal of each pixel. The rendering position deciding unit 21 outputs rendering position information serving as information of the pixel 48 that is decided to undergo the sub-pixel rendering process and the input signal of each pixel to the rendering unit 24. The sub-pixel rendering process is a process of performing display driving in units of sub-pixels and changing an input signal of each sub-pixel 49 belonging to the same pixel 48. A method of deciding the pixel 48 to which the sub-pixel rendering process is performed will be described later. Hereinafter, the sub-pixel rendering process is referred to appropriately as a rendering process.

The pattern information acquiring unit 22 acquires pattern information from the display mode deciding unit 13 of the control device 11. The pattern information is information indicating whether the arrangement order of the sub-pixels 49 in the display mode of the image display panel 40 is a first arrangement pattern or a second arrangement pattern. The first arrangement pattern corresponds to two of the first portrait mode, the second portrait mode, the first landscape mode, and the second landscape mode, and the second arrangement pattern corresponds to the other two. The first arrangement pattern and the second arrangement pattern will be described later in detail.

The rendering unit 24 includes a rendering selecting unit 72 and a rendering processing unit 74. The rendering selecting unit 72 acquires the pattern information from the pattern information acquiring unit 22. The rendering selecting unit 72 selects one of an RGB rendering process (a first sub-pixel rendering process) and a BGR rendering process (a second sub-pixel rendering process) which is to be performed based on the pattern information. The rendering selecting unit 72 outputs rendering information serving as information of the selected rendering process to the rendering processing unit 74. The RGB rendering process and the BGR rendering process will be described later.

The rendering processing unit 74 acquires the rendering position information and the input signal from the rendering position deciding unit 21. The rendering processing unit 74 acquires the rendering information from the rendering selecting unit 72. The rendering processing unit 74 performs the selected rendering process on the input signal of a predetermined pixel 48 based on the input signal of each pixel 48, the rendering position information, and the rendering information. The rendering processing unit 74 performs the rendering process on the input signal of the pixel 48 that is decided to undergo the rendering process, so as to generate a rendering input signal of the pixel 48.

The output processing unit 26 includes an α calculating unit 82 and an output signal generating unit 88. The α calculating unit 82 acquires the rendering input signal of the pixel 48 that has undergone the rendering process and the input signal of another pixel 48 from the rendering processing unit 74. The α calculating unit 82 calculates an expansion coefficient α related to the image display panel 40 based on the rendering input signal and the input signal. The expansion coefficient α is used for expanding the rendering input signal value and the input signal value. A process of calculating the expansion coefficient α will be described later.

The output signal generating unit 88 acquires the expansion coefficient α, the rendering input signal of the pixel 48 that has undergone the rendering process, and the input signal of another pixel 48 from the α calculating unit 82. The output signal generating unit 88 generates the output signals of the sub-pixels 49 in the pixels 48 based on the expansion coefficient α, the rendering input signal of a predetermined pixel 48, and the input signal of another pixel 48. The output signal generating unit 88 outputs the generated output signals to the image display panel driving unit 30. An output signal generation process will be described later.

Overview of Rendering Process

Figure 8:
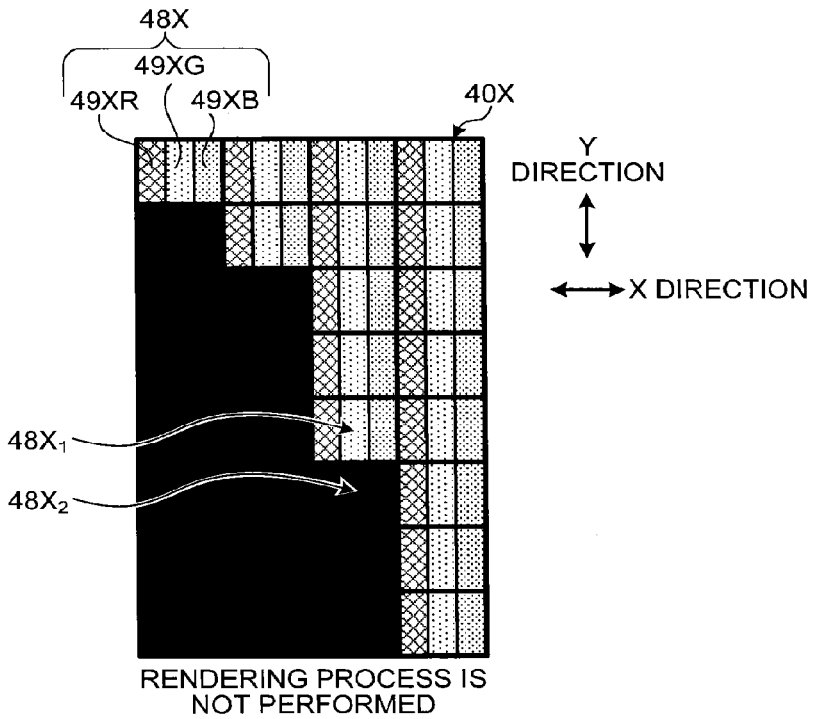
FIG. 8 is a schematic diagram illustrating an example of a display when a certain rendering process is not performed.
Figure 9:
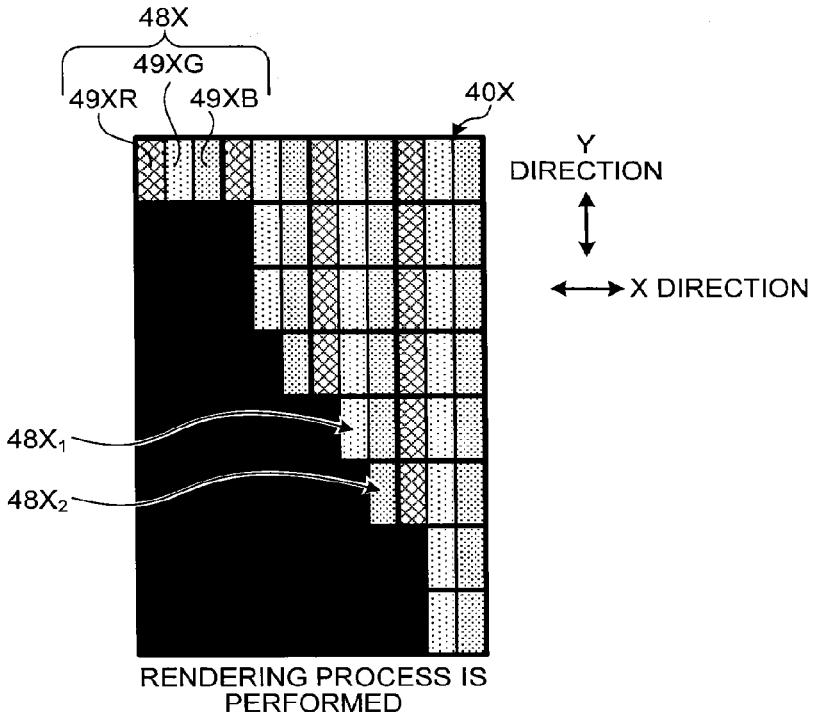
FIG. 9 is a schematic diagram illustrating an example of a display when a certain rendering process is performed.

Next, an overview of the rendering process will be described. The display device commonly performs display driving with a plurality of sub-pixels arranged in one pixel as a set. In other words, the display device commonly performs display driving in units of pixels. Meanwhile, the rendering process is a process of performing display driving in units of sub-pixels by controlling outputs of the sub-pixels independently. An example of a display when a predetermined rendering process serving as an example of the rendering process is performed will be described below. FIG. 8 is a schematic diagram illustrating an example of a display when a certain rendering process is not performed. FIG. 9 is a schematic diagram illustrating an example of a display when a certain rendering process is performed. As illustrated in FIGS. 8 and 9, in this description, an image display panel 40X differs from the image display panel 40 according to the first embodiment in a sub-pixel arrangement. In the image display panel 40X, each of pixels 48X includes a first sub-pixel 49XR, a second sub-pixel 49XG, and a third sub-pixel 49XB which are arranged in the X direction in a stripe form.

FIG. 8 illustrates an example in which regions of two different colors obtained by dividing a rectangle by a diagonal line are displayed. Black is assumed to be displayed on a region on the left of FIG. 8, and white is assumed to be displayed on a region on the right of FIG. 8. In FIG. 8, since the rendering process is not performed, a display of sub-pixels 49X belonging to one pixel 48X is decided based on a color displayed by the corresponding pixel. For example, a pixel 48$X_1$ illustrated in FIG. 8 is positioned on the diagonal line between the two regions. When the rendering process is not performed, the pixel 48$X_1$ displays white. All the sub-pixels 49X of the pixel 48$X_1$ emit light at the maximum level so that the pixel 48$X_1$ displays white. For example, pixel 48$X_2$ illustrated in FIG. 8 is positioned on the diagonal line between the two regions, and displays black. All the sub-pixels 49X of the pixel 48$X_2$ do not emit light so that the pixel 48$X_2$ displays black.

FIG. 9 illustrates an example in which the same display as in FIG. 8 is performed through the image display panel 40X. In FIG. 9, since a certain rendering process is performed, display driving is performed for each sub-pixel 49X. When the certain rendering process is performed, the first sub-pixel 49XR of the pixel 48$X_1$ does not emit light, unlike the example of FIG. 8. Further, when the certain rendering process is performed, the third sub-pixel 49XR of the pixel 48$X_2$ emits light, unlike the example of FIG. 8. Through the predetermined rendering process, the diagonal line between the two regions illustrated in FIG. 9 is displayed to be smoother than the diagonal line illustrated in FIG. 8. As described above, when the rendering process such as the certain rendering process is performed, the resolution can be improved in the pseudo manner, and thus, for example, a display of a line can be smoother.

Process Operation of Signal Processing Unit

Process of Deciding Pixel that Undergoes Rendering Process

Next, a process operation of the signal processing unit 20 will be described. First, a process of deciding the pixel 48 that undergoes the rendering process will be described. The rendering position deciding unit 21 receives the input signal of each pixel from the control device 11. Specifically, for a (p, q)-th pixel 48$_{(p,q)}$ (here, $1 \le p \le P0$ and $1 \le q \le Q0$), a signal including an input signal of a first sub-pixel 49$R_{(p,q)}$ having a signal value of $x_{1-(p,q)}$, an input signal of a second sub-pixel 49$G_{(p,q)}$ having a signal value of $x_{2-(p,q)}$), and an input signal of a third sub-pixel 49$B_{(p,q)}$ having a signal value of $x_{3-(p,q)}$ is input to the rendering position deciding unit 21. The input signal of the first sub-pixel 49$R_{(p,q)}$ is the input signal for causing the first sub-pixel 49$R_{(p,q)}$ displaying the first color to display the color, and is not actually input to the first sub-pixel 49$R_{(p,q)}$. In other words, the input signal of the first sub-pixel 49$R_{(p,q)}$ is a signal for causing the first sub-pixel 49$R_{(p,q)}$ to display the first color. The same applies to the input signal of the second sub-pixel 49$G_{(p,q)}$ and the input signal of the third sub-pixel 49$B_{(p,q)}$.

The rendering process according to the first embodiment is a process of gradually changing the input signal values of the sub-pixels for some of a plurality of pixels 48 that are adjacent to one another in a processing direction in which the rendering process is performed. In the first embodiment, the processing direction is the first direction F1. However, the processing direction may be any one of the second direction F2, the third direction F3, and the fourth direction F4. The rendering process according to the first embodiment is a process of changing the input signal values of the sub-pixels of the pixel 48 that undergoes the rendering process.

The rendering position deciding unit 21 decides the pixel 48 that undergoes the rendering process based on the input signals of the pixels. The rendering processing unit 74 performs the rendering process when a difference between the input signal values of the sub-pixels of a pixel neighboring a certain pixel 48 in the first direction F1 serving as the processing direction and the input signal values of the sub-pixels of a pixel neighboring the pixel 48 in the second direction F2 serving as a direction opposite to the processing direction is a predetermined value or more. Here, a (a, b)-th pixel $\mathbf{48}_{(a,b)}$ (a first pixel), a pixel $\mathbf{48}_{(a+1,b)}$ (a second pixel) neighboring the pixel $\mathbf{48}_{(a,b)}$ in the processing direction (here, the first direction F1), and a pixel $\mathbf{48}_{(a+2,b)}$ (a third pixel) neighboring the pixel $\mathbf{48}_{(a+1,b)}$ in the processing direction (here, the first direction F1) are considered. The rendering processing unit 74 decides to perform the rendering process on the pixel $\mathbf{48}_{(a+1,b)}$ when a difference between the input signal values of the sub-pixels $\mathbf{49}_{(a,b)}$ of the pixel $\mathbf{48}_{(a,b)}$ and the input signal values of the sub-pixels $\mathbf{49}_{(a+2,b)}$ of the pixel $\mathbf{48}_{(a+2,b)}$ is a predetermined threshold value or more. The rendering processing unit 74 decides not to perform the rendering process on the pixel $\mathbf{48}_{(a+1,b)}$ when a difference between the input signal values of the sub-pixels $\mathbf{49}_{(a,b)}$ of the pixel $\mathbf{48}_{(a,b)}$ and the input signal values of the sub-pixels $\mathbf{49}_{(a+2,b)}$ of the pixel $\mathbf{48}_{(a+2,b)}$ is smaller than the predetermined threshold value. Here, the predetermined threshold value can be arbitrarily set.

More specifically, the rendering position deciding unit 21 decides to perform the rendering process on the pixel $\mathbf{48}_{(a+1,b)}$ when the input signal value $x_{1-(a,b)}$ of the first sub-pixel of the pixel $\mathbf{48}_{(a,b)}$, the input signal value $x_{2-(a,b)}$ of the second sub-pixel thereof, the input signal value $x_{3-(a,b)}$ of the third sub-pixel thereof are the same value, the input signal value $x_{1-(a+2,b)}$ of the first sub-pixel of the pixel $\mathbf{48}_{(a+2,b)}$, the input signal value $x_{2-(a+2,b)}$ of the second sub-pixel thereof, and the input signal value $x_{3-(a+2,b)}$ of the third sub-pixel thereof are the same values, and a difference between the input signal values of the sub-pixels $\mathbf{49}_{(a,b)}$ of the pixel $\mathbf{48}_{(a,b)}$ and the input signal values of the sub-pixels $\mathbf{49}_{(a+2,b)}$ of the pixel $\mathbf{48}_{(a+2,b)}$ is a predetermined threshold value or more. The input signal values of the sub-pixels of the pixel $\mathbf{48}_{(a,b)}$ may not be the same in a condition for deciding whether or not the rendering process is performed. For example, the rendering processing unit 74 may decide to perform the rendering process when a difference between an average value of the input signal values of the sub-pixels of the pixel $\mathbf{48}_{(a,b)}$ and an average value of the input signal values of the sub-pixels of the pixel $\mathbf{48}_{(a+2,b)}$ is a predetermined value or more.

Figure 10:
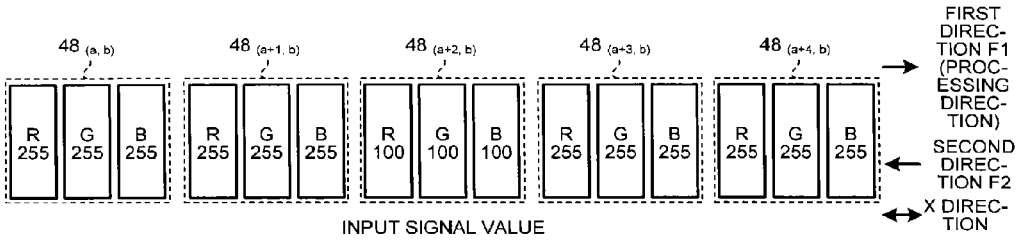
FIG. 10 is a schematic diagram for describing an input signal when a rendering process is performed.

FIG. 10 is a schematic diagram for describing an input signal when the rendering process is performed. FIG. 10 illustrates input signal values of sub-pixels of a pixel $\mathbf{48}_{(a,b)}$, a pixel $\mathbf{48}_{(a+1,b)}$, a pixel $\mathbf{48}_{(a+2,b)}$, a pixel $\mathbf{48}_{(a+3,b)}$, and a pixel $\mathbf{48}_{(a+4,b)}$ arranged in the X direction. For example, R and 255 written in the pixel $\mathbf{48}_{(a,b)}$ of FIG. 10 indicate that the input signal value $x_{1-(a,b)}$ of the first sub-pixel $\mathbf{49}R_{(a,b)}$ is 255. Similarly, G and 255 written in the pixel $\mathbf{48}_{(a,b)}$ of FIG. 10 indicate that the input signal value $x_{2-(a,b)}$ of the second sub-pixel $\mathbf{49}G_{(a,b)}$ is 255. Similarly, B and 255 written in the pixel $\mathbf{48}_{(a,b)}$ of FIG. 10 indicate that the input signal value $x_{3-(a,b)}$ of the third sub-pixel $\mathbf{49}B_{(a,b)}$ is 255. In the first embodiment, the input signal value has an integer value of 0 to 255. A direction from the pixel $\mathbf{48}_{(a,b)}$ to the pixel $\mathbf{48}_{(a+1,b)}$ is the first direction F1. A direction from the pixel $\mathbf{48}_{(a+1,b)}$ to the pixel $\mathbf{48}_{(a,b)}$ is the second direction F2.

As illustrated in FIG. 10, the input signal values of the sub-pixels $\mathbf{49}_{(a,b)}$ in the pixel $\mathbf{48}_{(a,b)}$ are 255. The input signal values of the sub-pixels $\mathbf{49}_{(a+1,b)}$ in the pixel $\mathbf{48}_{(a+1,b)}$ are 255. The input signal values of the sub-pixels $\mathbf{49}_{(a+2,b)}$ in the pixel $\mathbf{48}_{(a+2,b)}$ are 100. The input signal values of the sub-pixels $\mathbf{49}_{(a+3,b)}$ in the pixel $\mathbf{48}_{(a+3,b)}$ are 255. The input signal values of the sub-pixels $\mathbf{49}_{(a+4,b)}$ in the pixel $\mathbf{48}_{(a+4,b)}$ are 255. The input signal values of the sub-pixels $\mathbf{49}_{(a+4,b)}$ in the pixel $\mathbf{48}_{(a+4,b)}$ are 255. In this case, the pixel $\mathbf{48}_{(a+2,b)}$ displays gray, and the other pixels display white.

Here, for example, a predetermined threshold value is assumed to be 100. A difference between the input signal values of the sub-pixels of the pixel $\mathbf{48}_{(a,b)}$ and the input signal values of the sub-pixels of the pixel $\mathbf{48}_{(a+2,b)}$) is 155, and larger than the predetermined threshold value. Thus, the rendering position deciding unit 21 decides to perform the rendering process on the pixel $\mathbf{48}_{(a+1,b)}$. Similarly, a difference between the input signal values of the sub-pixels of the pixel $\mathbf{48}_{(a+2,b)}$ and the input signal values of the sub-pixels of the pixel $\mathbf{48}_{(a+4,b)}$ is 155 and larger than the predetermined threshold value. Thus, the rendering position deciding unit 21 decides to perform the rendering process on the pixel $\mathbf{48}_{(a+3,b)}$.

As described above, in the portrait mode, the short side 41 of the image display panel 40 lies in the X direction (the first direction F1). In the landscape mode, the long side 42 of the image display panel 40 lies in the X direction (the first direction F1). Thus, the processing direction is a direction along the short side 41 of the image display panel 40 in the portrait mode and a direction along the long side 42 of the image display panel 40 in the landscape mode. The processing direction is used for selection of the pixel 48 that undergoes the rendering process. Thus, there are cases in which the pixel 48 selected for the rendering process by the rendering position deciding unit 21 changes according to the display mode.

Process of Acquiring Pattern Information

Next, a process of acquiring the pattern information through the pattern information acquiring unit 22 will be described. The display mode deciding unit 13 of the control device 11 detects the direction of the display device 10 in the vertical direction, for example, using an acceleration sensor. The display mode deciding unit 13 decides the display mode indicating any one of the first portrait mode, the second portrait mode, the first landscape mode, and the second landscape mode to which the image display panel 40 is set based on the direction of the display device 10. The control device 11 outputs the input signal corresponding to the display mode to the signal processing unit 20. The display mode deciding unit 13 determines whether the decided display mode is the first arrangement pattern or the second arrangement pattern, and generates pattern information indicating the first arrangement pattern or the second arrangement pattern. The pattern information acquiring unit 22 acquires the pattern information. The display mode deciding unit 13 may decide the display mode based on, for example, an input of an operator or activation of an application in addition to the direction of the display device 10.

The display mode deciding unit 13 may output only the information of the display mode (the first portrait mode, the second portrait mode, the first landscape mode, or the second landscape mode) to the pattern information acquiring unit 22, and the pattern information acquiring unit 22 may determine whether the display mode is the first arrangement pattern or the second arrangement pattern. The display mode deciding unit 13 may include the display device 10.

Next, the first arrangement pattern and the second arrangement pattern will be described. The image display panel 40 changes a positional relation between the first direction F1 serving as the row direction of the display image and the short side 41 and the long side 42 by switching the display mode. As described above, the arrangement order of the sub-pixels 49 in the first direction F1 changes according to the display mode. Since the processing direction in which the rendering process is performed corresponds to the first direction F1, the arrangement order of the sub-pixels 49 in the processing direction can be described as changing according to the display mode. The first arrangement pattern and the second arrangement pattern differ from each other in the arrangement order of the sub-pixels 49 in the processing direction. Specifically, an arrangement of the sub-pixels 49 in the first arrangement pattern is an arrangement in which the second sub-pixel 49G belonging to the same pixel 48 is adjacent to the side of the first sub-pixel 49R in the processing direction (here, the first direction F1) or an arrangement in which the third sub-pixel 49B belonging to the same pixel 48 is adjacent to the side of the second sub-pixel 49G in the processing direction (here, the first direction F1). The arrangement of the sub-pixels 49 in the second arrangement pattern is an arrangement in which the first sub-pixel 49R belonging to the same pixel 48 is adjacent to the side of the second sub-pixel 49G in the processing direction (here, the first direction F1) or an arrangement in which the second sub-pixels 49G belonging to the same pixel 48 is adjacent to the side of the third sub-pixel 49B in the processing direction (here, the first direction F1).

Figure 11:
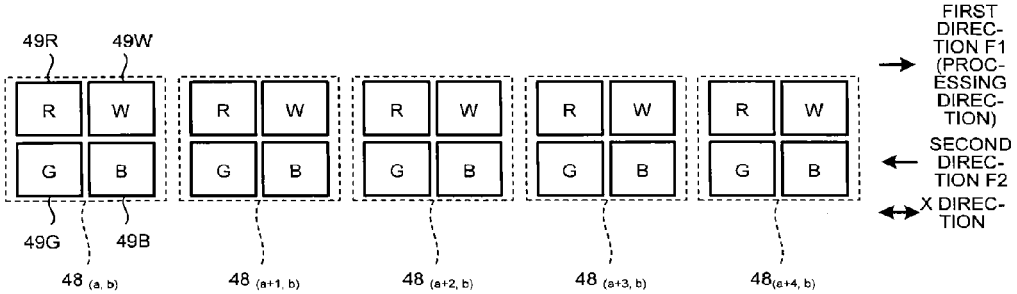
FIG. 11 is a schematic diagram illustrating an example of a sub-pixel arrangement in a first arrangement pattern.
Figure 12:
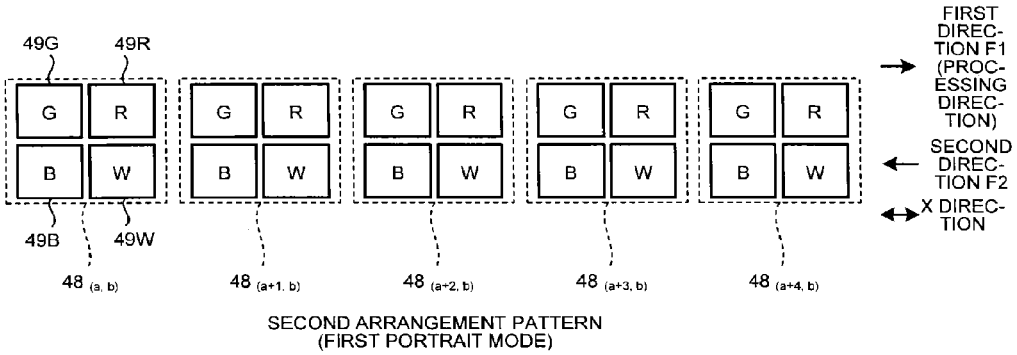
FIG. 12 is a schematic diagram illustrating an example of a sub-pixel arrangement a second arrangement pattern.

FIG. 11 is a schematic diagram illustrating an example of a sub-pixel arrangement in the first arrangement pattern. FIG. 12 is a schematic diagram illustrating an example of a sub-pixel arrangement in the second arrangement pattern. In the example of the sub-pixel arrangement of the first arrangement pattern illustrated in FIG. 11, the third sub-pixel 49B belonging to the same pixel 48 is adjacent to the side of the second sub-pixel 49G in the processing direction (the first direction F1). In the sub-pixel arrangement of the second arrangement pattern illustrated in FIG. 12, the first sub-pixel 49R belonging to the same pixel 48 is adjacent to the side of the second sub-pixel 49G in the processing direction (the first direction F1). The example of FIG. 11 corresponds to the first landscape mode of FIG. 6, and the example of FIG. 12 corresponds to the first portrait mode of FIG. 5.

In the first embodiment, when the display mode of the image display panel 40 is the first landscape mode or the second portrait mode, the display mode deciding unit 13 determines that the sub-pixel arrangement has the first arrangement pattern. Further, when the display mode of the image display panel 40 is the first portrait mode or the second landscape mode, the display mode deciding unit 13 determines that the sub-pixel arrangement has the second arrangement pattern. In the image display panel 40, when the display mode (the first portrait mode, the second portrait mode, the first landscape mode, or the second landscape mode) is fixed, the arrangement of the sub-pixels 49 is decided at the time of design. The display mode deciding unit 13 stores a relation between the display mode and the first and second arrangement patterns. The relation between the display mode and the first and second arrangement patterns differs according to a design of the sub-pixel arrangement and is not limited to the relation in the first embodiment.

Selection and Execution of Rendering Process

Next, selection and execution of the rendering process by the rendering unit will be described. The rendering selecting unit 72 selects any one of the RGB rendering process (the first sub-pixel rendering process) and the BGR rendering process (the second sub-pixel rendering process) based on the pattern information. As will be described later in detail, the rendering processing unit 74 performs the selected rendering process on the input signal of the pixel 48 decided to undergo the rendering process, and generates the rendering input signal of the pixel 48.

First, the RGB rendering process and the BGR rendering process will be described. Hereinafter, in the (p, q)-th pixel $\mathbf{48}_{(p,q)}$ (here, $1 \le p \le P0$ and $1 \le q \le Q0$), the signal value of the rendering input signal of the first sub-pixel is assumed to be $x_{A1-(p,q)}$, the signal value of the rendering input signal of the second sub-pixel is assumed to be $x_{A2-(p,q)}$, and the signal value of the rendering input signal of the third sub-pixel is assumed to be $x_{A3-(p,q)}$.

Figure 13:
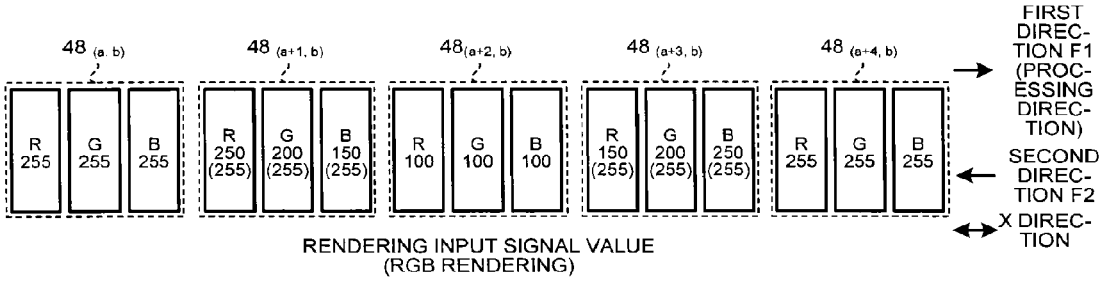
FIG. 13 is a schematic diagram for describing a rendering input signal generated by an RGB rendering process.

FIG. 13 is a schematic diagram for describing the rendering input signal generated by the RGB rendering process. FIG. 13 illustrates the rendering input signal value when the RGB rendering process is performed on the input signals of the pixels illustrated in FIG. 10. The RGB rendering is a process of changing the input signals gradually in the order of the input signal of the first sub-pixel 49R, the input signal of the second sub-pixel 49G, and the input signal of the third sub-pixel 49B. As illustrated in FIG. 13, the RGB rendering process is performed on the pixel $\mathbf{48}_{(a+1,b)}$ and the pixel $\mathbf{48}_{(a+3,b)}$ to generate the rendering input signal. The input signal values of the sub-pixels of the pixel $\mathbf{48}_{(a+1,b)}$ are 255. By performing the RGB rendering process on the pixel $\mathbf{48}_{(a+1,b)}$, a first sub-pixel rendering input signal value $x_{A1-(a+1,b)}$ is 250, a second sub-pixel rendering input signal value $x_{A2-(a+1,b)}$ is 200, and a third sub-pixel rendering input signal value $x_{A3-(a+1,b)}$ is 150. Similarly, by performing the RGB rendering process on the pixel $\mathbf{48}_{(a+3,b)}$, a first sub-pixel rendering input signal value $x_{1-(a+3,b)}$ is 150, a second sub-pixel rendering input signal value $x_{2-(a+3,b)}$ is 200, and a third sub-pixel rendering input signal value $x_{3-(a+3,b)}$ is 250. The rendering process is not performed on the other pixels.

When the RGB rendering process is performed, the rendering input signal values of the pixel $\mathbf{48}_{(a+1,b)}$ gradually decrease from the pixel $\mathbf{48}_{(a,b)}$ in which the input signal value is 255 toward the pixel $\mathbf{48}_{(a+2,b)}$ in which the input signal value is 100 in the order of the first sub-pixel rendering input signal value $x_{A1-(a+1,b)}$, the second sub-pixel rendering input signal value $x_{A2-(a+1,b)}$, and the third sub-pixel rendering input signal value $x_{A3-(a+1,b)}$. Further, when the RGB rendering process is performed, the rendering input signal values of the pixel $\mathbf{48}_{(a+3,b)}$ gradually increase from the pixel $\mathbf{48}_{(a+2,b)}$ in which the input signal value is 100 toward the pixel $\mathbf{48}_{(a+4,b)}$ in which the input signal value is 255 in the order of the first sub-pixel rendering input signal value $x_{A1-(a+3,b)}$, the second sub-pixel rendering input signal value $x_{A2-(a+3,b)}$, and the third sub-pixel rendering input signal value $x_{A3-(a++3,b)}$.

As described above, the RGB rendering process causes the first sub-pixel rendering input signal value $x_{A1-(a+1,b)}$ in the pixel $\mathbf{48}_{(a+1,b)}$ to be a value between the input signal value of the sub-pixel of the pixel $\mathbf{48}_{(a,b)}$ and the input signal value of the sub-pixel of the pixel $\mathbf{48}_{(a+2,b)}$. Further, the RGB rendering process causes the second sub-pixel rendering input signal value $x_{A2-(a+1,b)}$ in the pixel $\mathbf{48}_{(a+1,b)}$ to be a value between the first sub-pixel rendering input signal value $x_{A1-(a+1,b)}$ and the input signal value of the sub-pixel of the pixel $\mathbf{48}_{(a+2,b)}$. Furthermore, the RGB rendering process causes the third sub-pixel rendering input signal value $x_{A3-(a+1,b)}$ in the pixel $\mathbf{48}_{(a+1,b)}$ to be a value between the second sub-pixel rendering input signal value $x_{A2-(a+1,b)}$ and the input signal value of the sub-pixel of the pixel $\mathbf{48}_{(a+2,b)}$. More specifically, when the input signal value of the sub-pixel of the pixel $\mathbf{48}_{(a,b)}$ is larger than the input signal value of the sub-pixel of the pixel $\mathbf{48}_{(a+2,b)}$, the RGB rendering process is a process of causing the first sub-pixel rendering input signal value $x_{A1-(a+1,b)}$ to be largest and causing the third sub-pixel rendering input signal value $x_{A3-(a+1,b)}$ to be smallest among the first sub-pixel rendering input signal value $x_{A1-(a+1,b)}$, the second sub-pixel rendering input signal value $x_{A2-(a+1,b)}$, and the third sub-pixel rendering input signal value $x_{A3-(a+1,b)}$.

Figure 14:
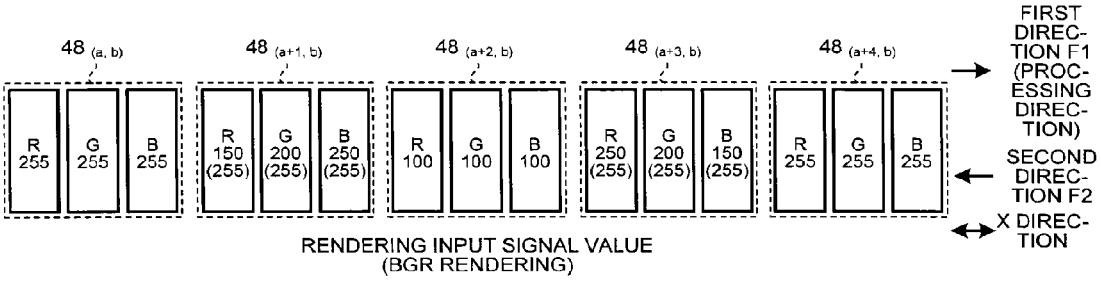
FIG. 14 is a schematic diagram for describing a rendering input signal generated by a BGR rendering process.

FIG. 14 is a schematic diagram for describing the rendering input signals generated by the BGR rendering process. FIG. 14 illustrates the rendering input signal values when the BGR rendering process is performed on the input signals of the pixels illustrated in FIG. 10. The BGR rendering process differs from the RGB rendering process in a change in the input signal values of the sub-pixels 49. The BGR rendering process gradually changes the input signals in the opposite order to that of the RGB rendering, that is, the order of the input signal of the third sub-pixel 49B, the input signal of the second sub-pixel 49G, the input signal of the first sub-pixel 49R. By performing the BGR rendering process on the pixel $\mathbf{48}_{(a+1,b)}$, the first sub-pixel rendering input signal value $x_{A1-(a+1,b)}$ is 150, the second sub-pixel rendering input signal value $x_{A2-(a+1,b)}$ is 200, and the third sub-pixel rendering input signal value $x_{A3-(a+1,b)}$ is 250. Similarly, by performing the BGR rendering process on the pixel $\mathbf{48}_{(a+3,b)}$, the first sub-pixel rendering input signal value $x_{1-(a+3,b)}$ is 250, the second sub-pixel rendering input signal value $x_{2-(a+3,b)}$ is 200, and the third sub-pixel rendering input signal value $x_{3-(a+3,b)}$ is 150.

As described above, the BGR rendering process causes the first sub-pixel rendering input signal value $x_{A1-(a+1,b)}$ in the pixel $\mathbf{48}_{(a+1,b)}$ to be a value between the input signal value of the sub-pixel of the pixel $\mathbf{48}_{(a,b)}$ and the input signal value of the sub-pixel of the pixel $\mathbf{48}_{(a+2,b)}$. Further, the BGR rendering process causes the second sub-pixel rendering input signal value $x_{A2-(a+1,b)}$ in the pixel $\mathbf{48}_{(a+1,b)}$ to be a value between the first sub-pixel rendering input signal value $x_{A1-(a+1,b)}$ and the input signal value of the sub-pixel of the pixel $\mathbf{48}_{(a,b)}$. Furthermore, the BGR rendering process causes the third sub-pixel rendering input signal value $x_{A3-(a+1,b)}$ in the pixel $\mathbf{48}_{(a+1,b)}$ to be a value between the second sub-pixel rendering input signal value $x_{A2-(a+1,b)}$ and the input signal value of the sub-pixel of the pixel $\mathbf{48}_{(a,b)}$. More specifically, when the input signal value of the sub-pixel of the pixel $\mathbf{48}_{(a,b)}$ is larger than the input signal value of the sub-pixel of the pixel $\mathbf{48}_{(a+2,b)}$ the BGR rendering process is a process of causing the first sub-pixel rendering input signal value $x_{A1-(a+1,b)}$ to be largest and causing the third sub-pixel rendering input signal value $x_{A3-(a+1,b)}$ to be smallest among the first sub-pixel rendering input signal value $x_{A1-(a+1,b)}$, the second sub-pixel rendering input signal value $x_{A2-(a+1,b)}$, and the third sub-pixel rendering input signal value $x_{A3-(a+1,b)}$.

The rendering selecting unit 72 selects the RGB rendering process when the sub-pixel arrangement has the first arrangement pattern. The rendering selecting unit 72 selects the BGR rendering process when the sub-pixel arrangement has the second arrangement pattern. The rendering processing unit 74 performs the selected rendering process on the input signal of the pixel 48 decided to undergo the rendering process based on the input signal of each pixel 48, the rendering position information, and the rendering information. The rendering processing unit 74 performs the selected rendering process on the input signal of the pixel 48 decided to undergo the rendering process, and generates the rendering input signal of the pixel 48 decided to undergo the rendering process.

Output Signal Generation Process

Next, an output signal generation process of the output processing unit 26 will be described. The output processing unit 26 processes the input signals and the rendering input signals, generates an output signal (a signal value $X_{1-(p,q)}$) of the first sub-pixel for deciding a display gradation of the first sub-pixel $\mathbf{49}R_{(p,q)}$, an output signal (the signal value $X_{2-(p,q)}$) of the second sub-pixel for deciding a display gradation of the second sub-pixel $\mathbf{49}G_{(p,q)}$, an output signal (the signal value $X_{3-(p,q)}$) of the third sub-pixel $\mathbf{49}B_{(p,q)}$ for deciding a display gradation of the third sub-pixel $\mathbf{49}B_{(p,q)}$, and an output signal (the signal value $X_{4-(p,q)}$) of the fourth sub-pixel for deciding a display gradation of the fourth sub-pixel $\mathbf{49}W_{(p,q)}$, and outputs the output signals to the image display panel driving unit 30. The output signal generation process of the output processing unit 26 will be described below in detail.

Figure 15:
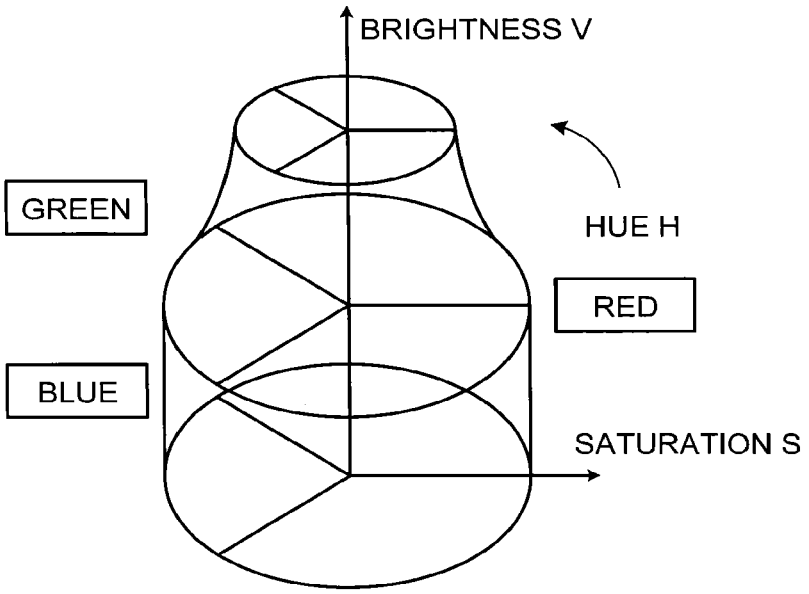
FIG. 15 is a conceptual diagram of an extended HSV color space that is extendable by the display device according to the first embodiment.
Figure 16:
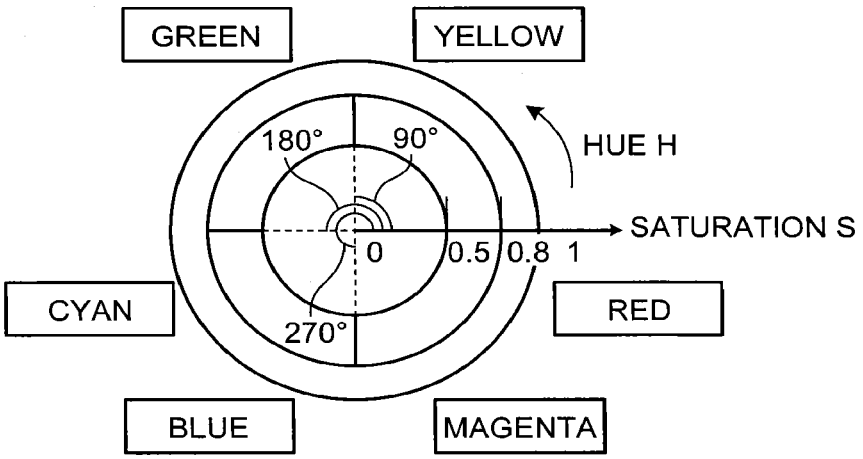
FIG. 16 is a conceptual diagram illustrating a relation between a hue and a saturation of an extended HSV color space.

FIG. 15 is a conceptual diagram of an extended HSV color space that is extendable by the display device of the first embodiment. FIG. 16 is a conceptual diagram a relation between a hue and a saturation of the extended HSV color space. In the display device 10, each of the pixels 48 includes the fourth sub-pixel 49W that outputs the fourth color (white), and thus the dynamic range of brightness is increased in the extended color space (the HSV color space in the first embodiment) as illustrated in FIG. 15. In other words, in the expanded color space extended by the display device 10, as illustrated in FIG. 15, a solid in which a shape in a cross section having a saturation axis and a brightness axis in which as the saturation increases, a maximum value of the brightness decreases is a substantially trapezoidal in which an oblique side is a curve is placed on a cylindrical color space displayable by the first sub-pixel 49R, the second sub-pixel 49G, and the third sub-pixel 49B. A maximum value Vmax(S) of the brightness having a saturation S as a variable in the expanded color space (the HSV color space in the first embodiment) expanded by adding the fourth color (white) is stored in the signal processing unit 20. In other words, the output processing unit 26 stores the value of the maximum value Vmax(S) of the brightness for each coordinate (values) of the saturation and the hue in the three-dimensional shape of the expanded color space illustrated in FIG. 15. Since the input signal is configured with input signals for the first sub-pixel 49R, the second sub-pixel 49G, and the third sub-pixel 49B, the color space of the input signal has a cylindrical shape, that is, the same shape as the cylindrical part of the expanded color space.

First, the α calculating unit 82 of the output processing unit 26 obtains the saturation S and the brightness V(S) in a plurality of pixels 48 based on the input signal values and the rendering input signal values of the pixels 48 in one frame, and calculates the expansion coefficient α common to all the pixels 48 in one frame.

The α calculating unit 82 obtains the saturation S and the brightness V(S) for each of the pixels 48 in one frame. Generally, in the (p, q)-th pixel, a saturation $S_{(p,q)}$ and the brightness (value) $V(S)_{(p,q)}$ of an input color in the cylindrical HSV color space are calculated by the following Equations (1) and (2) based on the input signal (the signal value of $x_{1-(p,q)}$) of the first sub-pixel, the input signal (the signal value of $x_{2-(p,q)}$) of the second sub-pixel, and the input signal (the signal value of $x_{3-(p,q)}$) of the third sub-pixel.

$$S_{(p,q)}=(\mathrm{Max}_{(p,q)}-\mathrm{Min}_{(p,q)})/\mathrm{Max}_{(p,q)} \quad (1)$$

$$V(S)_{(p,q)}=\mathrm{Max}_{(p,q)} \quad (2)$$

$Max_{(p,q)}$ is the maximum value among the input signal values of the three sub-pixels 49, that is, $x_{1-(p,q)}$, $x_{2-(p,q)}$, and $x_{3-(p,q)}$, and $Min_{(p,q)}$ is the minimum value among the input signal values of the three sub-pixels 49, that is, $x_{1-(p,q)}$, $x_{2-(p,q)}$, and $x_{3-(p,q)}$.

When the rendering process is performed on the pixel $\mathbf{48}_{(p,q)}$, the saturation $S_{(p,q)}$ and the brightness $V(S)_{(p,q)}$ are calculated using the rendering input signal values ($x_{A1-(p,q)}$, $x_{A2-(p,q)}$, and $x_{A3-(p,q)}$) instead of the input signal values ($x_{1-(p,q)}$, $x_{2-(p,q)}$, and $x_{3-(p,q)}$).

The α calculating unit 82 calculates the expansion coefficient α(S) of each pixel 48 based on the brightness V(S) of each pixel 48 and Vmax(S) of the extended color space using the following Equation (3).

$$\alpha(S)=V\max(S)/V(S) \tag{3}$$

The α calculating unit 82 calculates the expansion coefficient α common to all the pixels 48 in one frame based on the expansion coefficients α(S) of all the pixels 48 in one frame. In the first embodiment, a minimum value of the expansion coefficients α(S) of all the pixels 48 in one frame is used as the expansion coefficient α. The α calculating unit 82 may decide the expansion coefficient α so that a percentage of pixels in which a value of extended brightness obtained from a product of the brightness V(S) and the expansion coefficient α exceeds the maximum value Vmax(S) with respect to all pixels is a limit value β or less. Here, the limit value β is an upper limit value (percentage) of a width that exceeds a maximum value of brightness of the extended HSV color space with respect to the maximum value in a value combination of a hue and a saturation.

Here, Vmax(S) is a maximum value of brightness that is extendable in the extended color space illustrated in FIG. 15. Vmax(S) can be indicated by the following Equations (4) and (5).

When $S \le S_0$, $$V\max(S)=(\chi+1)\cdot(2^n-1) \tag{4}$$

When $S_0<S\le 1$, $$V\max(S)=(2^n-1)\cdot(1/S) \tag{5}$$

Here, $S_0=1/(\chi+1)$ is held. χ will be described later. In the first embodiment, n is assumed to be 8. That is, the display gradation bit number is 8 bits (the display gradation has 256 gradation values, that is, 0 to 255).

The output signal generating unit 88 acquires the value of the expansion coefficient α, the rendering input signals of the pixels that have undergone the rendering process, and the input signals of the other pixels from the α calculating unit 82. The output signal generating unit 88 calculates an output signal value $X_{4-(p,q)}$ of the fourth sub-pixel based on at least the input signal (the signal value $x_{1-(p,q)}$) of the first sub-pixel, the input signal (the signal value $x_{2-(p,q)}$) of the second sub-pixel, and the input signal (the signal value $x_{3-(p,q)}$) of the third sub-pixel. More specifically, the output signal generating unit 88 calculates the output signal value $X_{4-(p,q)}$ of the fourth sub-pixel based on the product of $Min_{(p,q)}$ and the expansion coefficient α. Specifically, the signal processing unit 20 may obtain the signal value $X_{4-(p,q)}$ based on the following Equation (6). In Equation (6), the product of $Min_{(p,q)}$ and the expansion coefficient α is divided by χ, but the present invention is not limited thereto.

$$X_{4-(p,q)}=Min_{(p,q)}\cdot\alpha/\chi \tag{6}$$

When the rendering process is performed on the pixel $\mathbf{48}_{(p,q)}$, the output signal value $X_{4-(p,q)}$ of the fourth sub-pixel is calculated using the first sub-pixel rendering input signal value $x_{A1-(p,q)}$, the second sub-pixel rendering input signal value $x_{A2-(p,q)}$, and the third sub-pixel input signal value $x_{A3-(p,q)}$ instead of the first sub-pixel input signal value $x_{1-(p,q)}$, the second sub-pixel input signal value $x_{2-(p,q)}$, and the third sub-pixel input signal value $x_{3-(p,q)}$.

χ is a constant depending on the display device 10. No color filter is arranged for the fourth sub-pixel 49W that displays white. The fourth sub-pixel 49W that displays the fourth color is higher in brightness than the first sub-pixel 49R that displays the first color, the second sub-pixel 49G that displays the second color, and the third sub-pixel 49B that displays the third color when they are irradiated with light with the same light source lighting amount. When a signal having a value corresponding to the maximum signal value of the output signal of the first sub-pixel 49R is input to the first sub-pixel 49R, a signal having a value corresponding to the maximum signal value of the output signal of the second sub-pixel 49G is input to the second sub-pixel 49G, and a signal having a value corresponding to the maximum signal value of the output signal of the third sub-pixel 49B is input to the third sub-pixel 49B, luminance of an aggregate of the first sub-pixel 49R, the second sub-pixel 49G, and the third sub-pixel 49B included in the pixel 48 or a group of pixels 48 is assumed to be $BN_{1-3}$. When a signal having a value corresponding to the maximum signal value of the output signal of the fourth sub-pixel 49W is input to the fourth sub-pixel 49W included in the pixel 48 or a group of pixels 48, the luminance of the fourth sub-pixel 49W is assumed to be $BN_4$. That is, white of the maximum luminance is displayed by the aggregate of the first sub-pixel 49R, the second sub-pixel 49G, and the third sub-pixel 49B, and the luminance of the white is indicated by $BN_{1-3}$. In this case, when χ is a constant depending on the display device 10, the constant χ is indicated by $\chi=BN_4/BN_{1-3}$.

Specifically, the luminance $BN_4$ when the input signal having the display gradation value of 255 is assumed to be input to the fourth sub-pixel 49W is, for example, 1.5 times the luminance $BN_{1-3}$ of white when the input signals having the display gradation values such as the signal value $x_{1-(p,q)}=255$, the signal value $x_{2-(p,q)}=255$, and the signal value $x_{3-(p,q)}=255$ are input to the aggregate of the first sub-pixel 49R, the second sub-pixel 49G, and the third sub-pixel 49B. That is, in the first embodiment, χ=1.5.

Then, the output signal generating unit 88 calculates the output signal (the signal value $X_{1-(p,q)}$) of the first sub-pixel based on at least the input signal of the first sub-pixel (the signal value $x_{1-(p,q)}$) and the expansion coefficient α, calculates the output signal (the signal value $X_{2-(p,q)}$) of the second sub-pixel based on at least the input signal (the signal value $x_{2-(p,q)}$) of the second sub-pixel and the expansion coefficient α, and calculates the output signal (the signal value $X_{3-(p,q)}$) of the third sub-pixel based on at least the input signal (the signal value $x_{3-(p,q)}$) of the third sub-pixel and the expansion coefficient α.

Specifically, the output signal generating unit 88 calculates the output signal of the first sub-pixel based on the input signal of the first sub-pixel, the expansion coefficient α, and the output signal of the fourth sub-pixel. The output signal generating unit 88 calculates the output signal of the second sub-pixel based on the input signal of the second sub-pixel, the expansion coefficient α, and the output signal of the fourth sub-pixel. The output signal generating unit 88 calculates the output signal of the third sub-pixel based on the input signal of the third sub-pixel, the expansion coefficient α, and the output signal of the fourth sub-pixel.

In other words, the output signal generating unit 88 calculates the output signal value $X_{1-(p,q)}$ of the first sub-pixel, the output signal value $X_{2-(p,q)}$ of the second sub-pixel, and the output signal value $X_{3-(p,q)}$ of the third sub-pixel which are supplied to the (p, q)-th pixel (or the set of the first sub-pixel 49R, the second sub-pixel 49G, and the third sub-pixel 49B) using Equations (7) to (9), respectively, when $\chi$ is a constant depending on the display device.

$$X_{1-(p,q)}=\alpha\cdot x_{1-(p\ q)}-\chi\cdot X_{4-(p,q)} \tag{7}$$

$$X_{2-(p,q)}=\alpha\cdot x_{2-(p,q)}-\chi\cdot X_{4-(p,q)} \tag{8}$$

$$X_{3-(p,q)}=\alpha\cdot x\cdot x_{3-(p,q)}\chi\cdot X_{4-(p,q)}) \tag{9}$$

When the rendering process is performed on the pixel $\mathbf{48}_{(p,q)}$, the output signal value $X_{1-(p,q)}$ of the first sub-pixel is calculated using the first sub-pixel rendering input signal value $x_{A1-(p,q)}$ instead of the first sub-pixel input signal value $x_{1-(p,q)}$ Similarly, when the rendering process is performed on the pixel $\mathbf{48}_{(p,q)}$, the output signal value $X_{2-(p,q)}$ of the second sub-pixel is calculated using the second sub-pixel rendering input signal value $x_{A2-(p,q)}$ instead of the second sub-pixel input signal value $x_{2-(p,q)}$. Similarly, when the rendering process is performed on the pixel $\mathbf{48}_{(p,q)}$, the output signal value $X_{3-(p,q)}$ of the third sub-pixel is calculated using the third sub-pixel rendering input signal value $x_{A3-(p,q)}$ instead of the third sub-pixel input signal value $x_{3-(p,q)}$.

The output signal generating unit 88 outputs the output signals of the sub-pixels calculated as described above to the image display panel driving unit 30.

Figure 17:
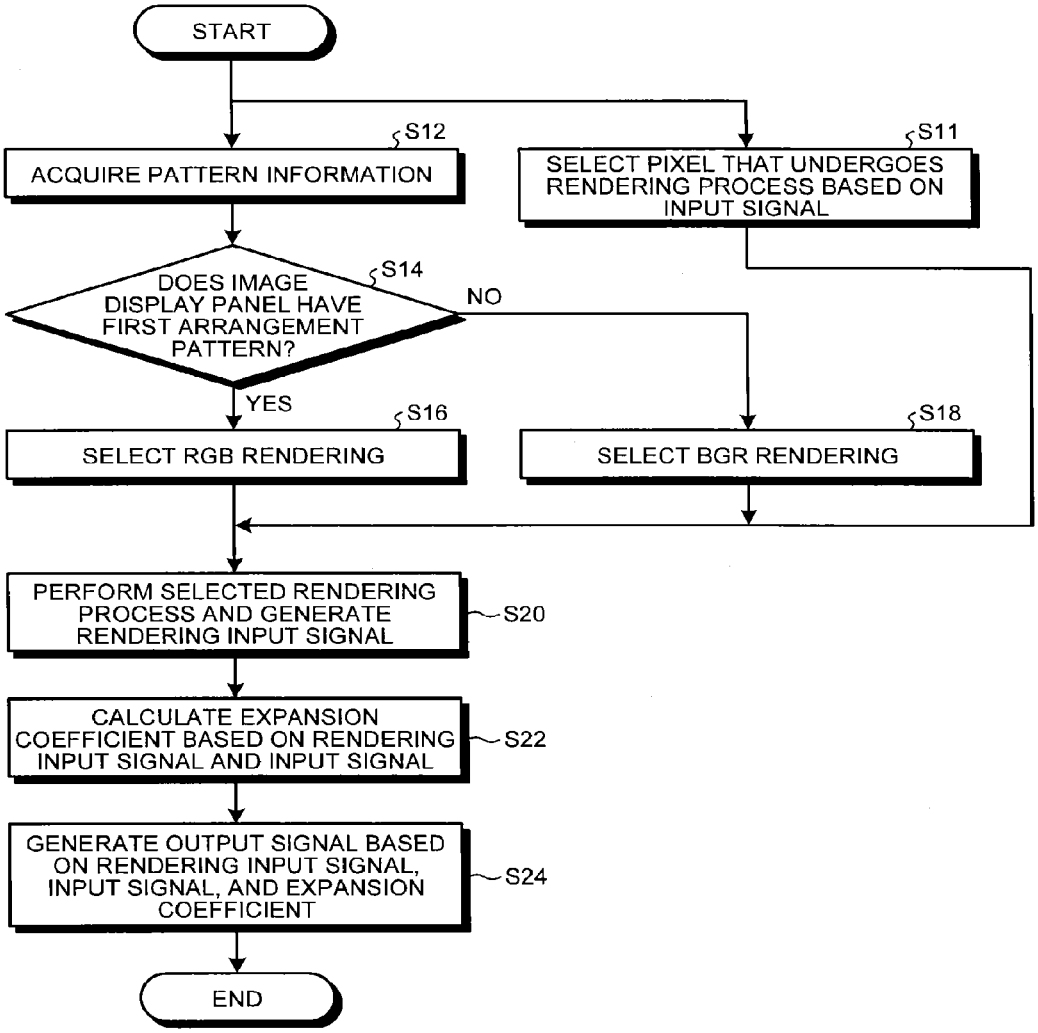
FIG. 17 is a flowchart for describing a process operation a signal processing unit according to the first embodiment.

Next, a process of the above-described process operation of the signal processing unit 20 will be described based on a flowchart. FIG. 17 is a flowchart for describing the process operation of the signal processing unit according to the first embodiment. As illustrated in FIG. 17, first, the rendering position deciding unit 21 of the signal processing unit 20 selects the pixel 48 that undergoes the rendering process based on the input signal of each pixel 48 (step S11). When the difference between the input signal values of the sub-pixels $\mathbf{49}_{(a,b)}$ of the pixel $\mathbf{48}_{(a,b)}$ and the input signal values of the sub-pixels $\mathbf{49}_{(a+2,b)}$ of the pixel $\mathbf{48}_{(a+2,b)}$ is a predetermined threshold value or more, the rendering position deciding unit 21 decides to perform the rendering process on the pixel $\mathbf{48}_{(a+1,b)}$.

The pattern information acquiring unit 22 of the signal processing unit 20 acquires the pattern information indicating whether the image display panel 40 has the first arrangement pattern or the second arrangement pattern (step S12). In the first embodiment, the display mode deciding unit 13 of the control device 11 determines whether the image display panel 40 has the first arrangement pattern or the second arrangement pattern. For example, in the first landscape mode or the second portrait mode, the display mode deciding unit 13 determines that the image display panel 40 has the first arrangement pattern. Further, for example, in the second landscape mode or the first portrait mode, the display mode deciding unit 13 determines that the image display panel 40 has the second arrangement pattern.

After the pattern information acquiring unit 22 acquires the pattern information, the rendering selecting unit 72 of the signal processing unit 20 acquires the pattern information from the pattern information acquiring unit 22, and when the image display panel 40 has the first arrangement pattern (Yes in step S14), execution of the RGB rendering process is selected (step S16). Further, when the image display panel 40 does not have the first arrangement pattern (No in step S14), that is, when the image display panel 40 has the second arrangement pattern, the rendering selecting unit 72 of the signal processing unit 20 selects execution of the BGR rendering process (step S18). As long as step S11 is performed before step S20 which will be described later, step S11 may be performed before, after, or at the same time as steps S12, S14, S16, and step S18.

After the pixel 48 that undergoes the rendering process is selected in step S11, and execution of the RGB rendering or execution of the BGR rendering is selected in step S16 or step S18, the rendering processing unit 74 of the signal processing unit 20 performs the selected rendering process (the RGB rendering or the BGR rendering) on the input signals of the selected pixel 48, and generates the rendering input signals of the selected pixel 48 (step S20).

After the rendering input signals are generated, the $\alpha$ calculating unit 82 of the signal processing unit 20 calculates the expansion coefficient $\alpha$ common to all the pixels 48 in one frame based on the rendering input signals and the input signals (step S22). The $\alpha$ calculating unit 82 calculates the expansion coefficient $\alpha(S)$ of the pixels based on Equation (3), and decides the minimum value of the expansion coefficients $\alpha(S)$ of all the pixels 48 in one frame as the expansion coefficient $\alpha$ common to all the pixels 48 in one frame.

After the expansion coefficient $\alpha$ is calculated, the output signal generating unit 88 of the signal processing unit 20 generates the output signals of the pixels 48 based on the rendering input signals, the input signals, and the expansion coefficient $\alpha$(step S24). The output signal generating unit 88 calculates the output signal value $X_{4-(p,q)}$ of the fourth sub-pixel using Equation (6). Further, the output signal generating unit 88 calculates the output signal value $X_{1-(p,q)}$ of the first sub-pixel, the output signal value $X_{2-(p,q)}$ of the second sub-pixel, and the output signal value $X_{3-(p,q)}$ of the third sub-pixel using Equations (7) to (9). Further, when the rendering process is performed on the pixel $\mathbf{48}_{(p,q)}$, the first sub-pixel rendering input signal value $x_{A1-(p,q)}$, the second sub-pixel rendering input signal value $x_{A2-(p,q)}$, and the third sub-pixel rendering input signal value $x_{A3-(p,q)}$ are used instead of the first sub-pixel input signal value $x_{1-(p,q)}$, the second sub-pixel input signal value $x_{2-(p,q)}$, and the third sub-pixel input signal value $x_{3-(p,q)}$. After step S24, the current process of the signal processing unit 20 ends.

Display Example

Figure 18:
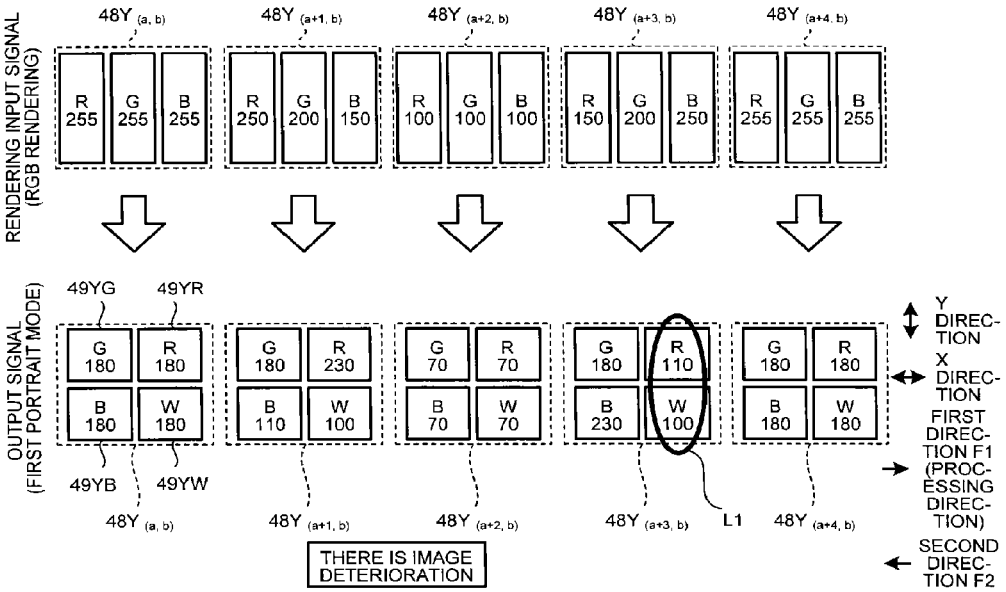
FIG. 18 is a schematic diagram illustrating output signals of sub-pixels when a rendering process according to a first comparative example is performed.

Next, a display example of the sub-pixels when the rendering process according to the first embodiment is performed will be described. First, a rendering process according to a first comparative example will be described. FIG. 18 is a schematic diagram illustrating the output signals of the sub-pixels when a rendering process according to the first comparative example is performed. In a display device 10Y according to the first comparative example, similarly to that of the first embodiment, the display mode (the landscape mode and the portrait mode) is switched. As illustrated in FIG. 18, an image display panel 40Y according to the first comparative example includes a pixel $\mathbf{48}Y_{(a,b)}$, a pixel $\mathbf{48}Y_{(a+1,b)}$, a pixel $\mathbf{48}Y_{(a+2,b)}$, a pixel $\mathbf{48}Y_{(a+3,b)}$, and a pixel $\mathbf{48}Y_{(a+4,b)}$ which are arranged in the first direction F1. The image display panel 40Y according to the first comparative example has the same sub-pixel arrangement as that of the first embodiment. FIG. 18 illustrates a sub-pixel arrangement in the first portrait mode.

The display device 10Y according to the first comparative example does not change the rendering process according to the display mode. The display device 10Y according to the first comparative example performs the RGB rendering even in any display mode. As illustrated in FIG. 18, in the first comparative example, since the RGB rendering is performed, the rendering input signal values of the pixels 48Y according to the first comparative example are the same as those in FIG. 13.

The display device 10Y according to the first comparative example generates the output signals based on the input signals and the rendering input signals using the same method as that of the first embodiment. As illustrated in FIG. 18, the output signals of the sub-pixels of the pixel $\mathbf{48}Y_{(a,b)}$ according to the first comparative example are 180. In the pixel $\mathbf{48}Y_{(a+1,b)}$, an output signal value $X_{Y1-(a+1,b)}$ of the first sub-pixel is 230, an output signal value $X_{Y2-(a+1,b)}$ of the second sub-pixel is 180, an output signal value $X_{Y3-(a+1,b)}$ of the third sub-pixel is 110, and an output signal value $X_{Y4-(a+1,b)}$ of the fourth sub-pixel is 100. The output signals of the sub-pixels of the pixel $\mathbf{48}Y_{(a+2,b)}$ are 70. In the pixel $\mathbf{48}Y_{(a+3,b)}$, an output signal value $X_{Y1-(a+3,b)}$ of the first sub-pixel is 110, an output signal value $X_{Y2-(a+3,b)}$ of the second sub-pixel is 180, an output signal value $X_{Y3-(a+3,b)}$ of the third sub-pixel is 230, and an output signal value $X_{Y4-(a+3,b)}$ of the fourth sub-pixel is 100. The output signals of the sub-pixels of the pixel $\mathbf{48}Y_{(a+4,b)}$ are 180.

Here, a sub-pixel 49YR and a sub-pixel 49YW of the pixel $\mathbf{48}Y_{(a+3,b)}$ are arranged in the Y direction and have the output signal values of 110 and 100. The sub-pixels adjacent to the sub-pixel 49YR and the sub-pixel 49YW of the pixel $\mathbf{48}Y_{(a+3,b)}$ in the X direction are a sub-pixel 49YG and a sub-pixel 49YB of the pixel $\mathbf{48}Y_{(a+3,b)}$ and the sub-pixel 49YG and the sub-pixel 49YB of the pixel $\mathbf{48}Y_{(a+4,b)}$. The output signal values of the sub-pixel 49YG and the sub-pixel 49YB of the pixel $\mathbf{48}Y_{(a+,b)}$ are 180 and 230. The output signal values of the sub-pixel 49YG and the sub-pixel 49YB of the pixel $\mathbf{48}Y_{(a+4,b)}$ are 180. As described above, the sub-pixel 49YR and the sub-pixel 49YW of the pixel $\mathbf{48}Y_{(a+3,b)}$ are smaller in the output signal value than the sub-pixels adjacent to both the sub-pixels 49YR and 49YW in the X direction. For this reason, in the image display panel 40Y according to the first comparative example, a line L1 along the Y direction in which the sub-pixel 49YG and the sub-pixel 49YB of the pixel $\mathbf{48}Y_{(a+4,b)}$ are arranged is darker than a portion therearound and likely to be recognized as a dark line by an observer. As described above, in the display device 10Y according to the first comparative example, since the rendering process does not change according to the display mode, when the rendering process is performed, the dark line is recognized by the observer, and the deterioration of the image is likely to be recognized.

Figure 19:
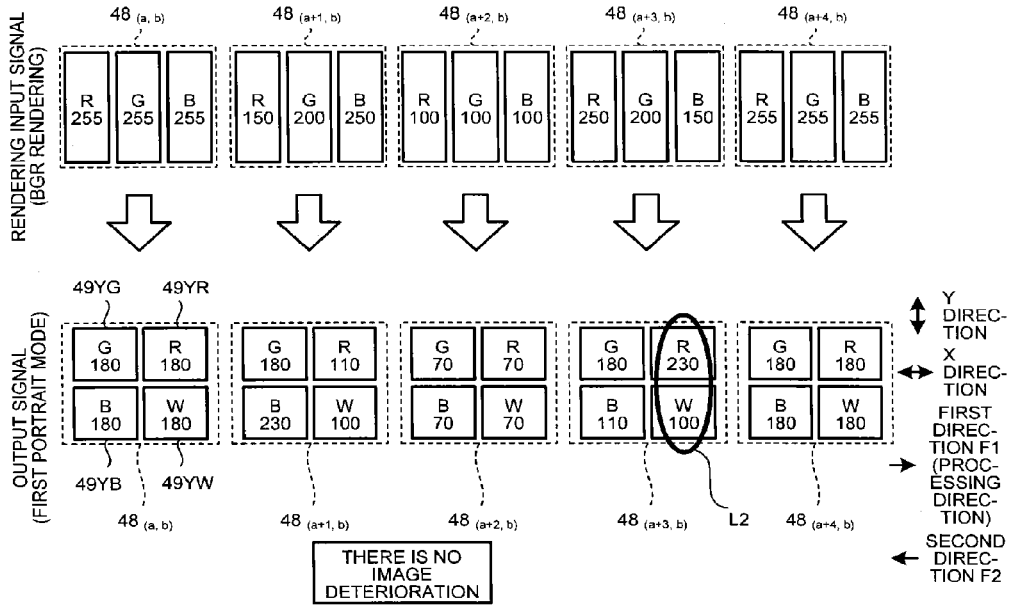
FIG. 19 is a schematic diagram illustrating output signals of sub-pixels when the rendering process according to the first embodiment is performed.

FIG. 19 is a schematic diagram illustrating the output signals of the sub-pixels when the rendering process according to the first embodiment is performed. The display device 10 according to the first embodiment changes the rendering process based on the display mode. In other words, in the display device 10 according to the first embodiment, in the case of the first arrangement pattern, the RGB rendering process is performed, and in the case of the second arrangement pattern, the BGR rendering process is performed. FIG. 19 illustrates an example in which in the same first portrait mode as in FIG. 18, the rendering process according to the first embodiment is performed, and the output signals are displayed. As described above, in the first portrait mode, the signal processing unit 20 according to the first embodiment performs the BGR rendering. As illustrated in FIG. 19, the output signals of the sub-pixels of the pixel $\mathbf{48}_{(a,b)}$, the pixel $\mathbf{48}_{(a+2,b)}$, and the pixel $\mathbf{48}_{(a+4,b)}$ have the same values as in the first comparative example illustrated in FIG. 18. On the other hand, in the pixel $\mathbf{48}_{(a+1,b)}$, an output signal value $X_{1-(a+1,b)}$ of the first sub-pixel is 110, an output signal value $X_{2-(a+1,b)}$ of the second sub-pixel is 180, an output signal value $X_{3-(a+1,b)}$ of the third sub-pixel is 230, and an output signal value $X_{4-(a+1,b)}$ of the fourth sub-pixel is 100. Further, in the pixel $\mathbf{48}_{(a+3,b)}$, an output signal value $X_{1-(a+3,b)}$ of the first sub-pixel is 230, an output signal value $X_{2-(a+3,b)}$ of the second sub-pixel is 180, an output signal value $X_{3-(a+3,b)}$ of the third sub-pixel is 110, and an output signal value $X_{4-(a+3,b)}$ of the fourth sub-pixel is 100.

The sub-pixel 49R and the sub-pixel 49W of the pixel $\mathbf{48}_{(a+,b)}$ have the output signal values of 230 and 100. The output signal values of the second sub-pixel 49G and the sub-pixel 49B of the pixel $\mathbf{48}_{(a+3,b)}$ are 180 and 110. The output signal values of the second sub-pixel 49G and the sub-pixel 49B of the pixel $\mathbf{48}_{(a+4,b)}$ are 180. As described above, the sub-pixel 49R and the sub-pixel 49W of the pixel $\mathbf{48}_{(a+3,b)}$ are suppressed from being smaller in the output signal value than the sub-pixels adjacent to both the sub-pixels 49R and 49W in the X direction. Thus, in the image display panel 40 according to the first embodiment, a line L2 along the Y direction in which the sub-pixel 49R and the sub-pixel 49W of the pixel $\mathbf{48}_{(a+3,b)}$ are arranged can be suppressed from being recognized as a dark line. As described above, in the display device 10 according to the first embodiment, even when the display mode is switched, it is possible to suppress the deterioration of the image that has undergone the rendering process.

As described above, the display device 10 according to the first embodiment includes the image display panel 40 in which a plurality of pixels 48 each of which includes the first sub-pixel 49R, the second sub-pixel 49G, the third sub-pixel 49B, and the fourth sub-pixel 49W arranged in a 2×2 matrix form are arranged on the display region 43 of the square shape having the first side (the short side 41) and the second side (the long side 42) in the matrix form. The image display panel 40 receives the image information corresponding to the portrait mode in which the direction along the first side is a predetermined one direction (here, the X direction) of the display image or the landscape mode in which the direction along the second side is a predetermined one direction (here, the X direction) of the display image. The display device 10 further includes the signal processing unit 20 that generates the output signals from the input values of the input signals for the first sub-pixel 49R, the second sub-pixel 49G, and the third sub-pixel 49B, and outputs the generated output signals to the image display panel 40. The signal processing unit 20 includes the rendering position deciding unit 21 that decides to perform the rendering process on the pixel $\mathbf{48}_{(a+1,b)}$ when, in the pixel $\mathbf{48}_{(a,b)}$, the pixel $\mathbf{48}_{(a+1,b)}$, and the pixel $\mathbf{48}_{(a+2,b)}$ arranged in the processing direction (here, the first direction F1) among the pixels 48, the difference between the input signal values of the sub-pixels $\mathbf{49}_{(a,b)}$ of the pixel $\mathbf{48}_{(a,b)}$ and the input signal values of the sub-pixels $\mathbf{49}_{(a+2,b)}$ of the pixel $\mathbf{48}_{(a+2,b)}$ is a predetermined threshold value or more. The signal processing unit 20 further includes the pattern information acquiring unit 22 that acquires the arrangement of the sub-pixels 49 in the processing direction (here, the first direction F1) of the display mode of either of the portrait mode and the landscape mode as the pattern information indicating either of the first arrangement pattern and the second arrangement pattern that differ in the arrangement of the sub-pixels 49. The signal processing unit 20 further includes the rendering unit 24 that performs the first sub-pixel rendering process (the RGB rendering process) or the second sub-pixel rendering process (the BGR rendering process) on the input signals of the sub-pixels of the pixel 48$_{(a+1,b)}$ based on the decision of the rendering position deciding unit 21 and the pattern information, and generates the rendering input signals of the sub-pixels of the pixel 48$_{(a+1,b)}$. Here, the processing direction (here, the first direction F1) is the direction along the first side (the short side 41) of the display region 43 when the display mode is the portrait mode and the direction along the second side (the long side 42) of the display region 43 when the display mode is the landscape mode.

In the display device 10, the sub-pixels 49 are arranged in a diagonal form of a 2×2 matrix, and the RGB rendering or the BGR rendering is selected according to whether the image display panel 40 has the first arrangement pattern or the second arrangement pattern. Since the display device 10 can perform the rendering process according to the display mode, even when the display mode is switched, for example, it is possible to suppress a black line from being recognized and suppress the deterioration of the image.

Here, in the case of the first arrangement pattern, the second sub-pixel 49G belonging to the same pixel 48 is adjacent to the side of the first sub-pixel 49R in the processing direction (the first direction F1), and the third sub-pixel 49B belonging to the same pixel 48 is adjacent to the side of the second sub-pixel 49G in the processing direction (the first direction F1). In the case of the second arrangement pattern, the first sub-pixel 49R belonging to the same pixel 48 is adjacent to the side of the second sub-pixel 49G in the processing direction (the first direction F1), or the second sub-pixel 49G belonging to the same pixel 48 is adjacent to the side of the third sub-pixel 49B in the processing direction (the first direction F1). The rendering unit 72 performs the RGB rendering in the case of the first arrangement pattern, and performs the BGR rendering process in the case of the second arrangement pattern. When the RGB rendering is performed in the case of the first arrangement pattern, and the BGR rendering is performed in the case of the second arrangement pattern, for example, a black line can be suppressed from being recognized. Thus, the display device 10 can appropriately suppress the deterioration of the image.

Here, when the input signal values of the sub-pixels of the pixel 48$_{(a,b)}$ are larger than the input signal values of the sub-pixels of the pixel 48$_{(a+2,b)}$, the RGB rendering process causes the first sub-pixel rendering input signal value $x_{A1-(a+1,b)}$ to be largest and causes the third sub-pixel rendering input signal value $x_{A3-(a+1,b)}$ to be smallest among the first sub-pixel rendering input signal value $x_{A1-(a+1,b)}$, the second sub-pixel rendering input signal value $x_{A2-(a+1,b)}$, and the third sub-pixel rendering input signal value $x_{A3-(a+1,b)}$ of the pixel 48$_{(a+1,b)}$. Further, the BGR rendering process causes the first sub-pixel rendering input signal value $x_{A1-(a+1,b)}$ to be smallest and causes the third sub-pixel rendering input signal value $x_{A3-(a+1,b)}$ to be largest among the first sub-pixel rendering input signal value $x_{A1-(a+1,b)}$ the second sub-pixel rendering input signal value $X_{A2-(a+1,b)}$, and the third sub-pixel rendering input signal value $x_{A3-(a+1,b)}$ of the pixel 48$_{(a+1,b)}$. The display device 10 gradually changes the output signal of the sub-pixel according to the output signal of the neighboring sub-pixel and thus can make the display image smooth.

A relation among the display mode, the arrangement pattern, and the rendering process in the image display panel according to the first embodiment is described below. FIG. 20A is a table indicating a relation among the display mode, the arrangement pattern, and the rendering process in the image display panel according to the first embodiment. As illustrated in FIG. 20A, when the image display panel 40 displays the image in the first portrait mode, the sub-pixel arrangement has the second arrangement pattern, and the BGR rendering is selected. Further, when the image display panel 40 displays the image in the first landscape mode, the sub-pixel arrangement has the first arrangement pattern, and the RGB rendering is selected. When the image display panel 40 displays the image in the second portrait mode, the sub-pixel arrangement has the first arrangement pattern, and the RGB rendering is selected. When the image display panel 40 displays the image in the second landscape mode, the sub-pixel arrangement has the second arrangement pattern, and the BGR rendering is selected.

The image display panel with which the display device 10 is equipped is not limited to the image display panel 40 having the sub-pixel arrangement illustrated in FIG. 20A. The image display panel with which the display device 10 is equipped may differ in the sub-pixel arrangement from the image display panel 40 when the display mode is fixed as long as the first sub-pixel 49R, the second sub-pixel 49G, the third sub-pixel 49B, and the fourth sub-pixel 49W in the pixel 48 are arranged in the 2×2 matrix. FIG. 20B is a table indicating a relation among the display mode, the arrangement pattern, and the rendering process in another example of the image display panel according to the first embodiment. FIG. 20B illustrates a relation among the display mode, the arrangement pattern, and the rendering process in an image display panel 40S that differs in the sub-pixel arrangement from the image display panel 40. Here, the row direction is assumed to be the processing direction, and a direction orthogonal to the processing direction is assumed to an orthogonal direction. As illustrated in FIG. 20B, each of pixels 48S arranged in the image display panel 40S includes a second sub-pixel 49G arranged in the first row of the first column, a first sub-pixel 49R arranged in the second row of the first column, a third sub-pixel 49B arranged in the first row of the second column, and a fourth sub-pixel 49W arranged in the second row of the second column in the first portrait mode. When the image display panel 40S displays the image in the first portrait mode, the sub-pixel arrangement has the first arrangement pattern, and the RGB rendering is selected. When the image display panel 40S displays the image in the first landscape mode, the sub-pixel arrangement has the second arrangement pattern, and the BGR rendering is selected. When the image display panel 40S displays the image in the second portrait mode, the sub-pixel arrangement has the second arrangement pattern, and the BGR rendering is selected. When the image display panel 40S displays the image in the second landscape mode, the sub-pixel arrangement has the first arrangement pattern, and the RGB rendering is selected.

The display device 10 may include the above-described image display panel 40S. Specifically, the display device 10 may include the image display panel having the sub-pixel arrangement different from those of the image display panels 40 and 40S as long as the first sub-pixel 49R, the second sub-pixel 49G, the third sub-pixel 49B, and the fourth sub-pixel 49W in the pixel 48 are arranged in the 2×2 matrix. Regardless of the sub-pixel arrangement of the image display panel 40 with which the display device 10 is equipped, in a first arrangement mode, it is desirable that the second sub-pixel 49G belonging to the same pixel 48 be adjacent to the side of the first sub-pixel 49R in the processing direction, or the third sub-pixel 49B belonging to the same pixel 48 be adjacent to the side of the second sub-pixel 49G in the processing direction. Further, in a second arrangement mode, it is desirable that the first sub-pixel 49R belonging to the same pixel 48 be adjacent to the side of the second sub-pixel 49G in the processing direction, or the second sub-pixels 49G belonging to the same pixel 48 be adjacent to the side of the third sub-pixel 49B in the processing direction. Here, an arrangement in which the first sub-pixel 49R and the second sub-pixel 49G are arranged in the processing direction in this order is referred to as an "RG arrangement," and an arrangement in which the second sub-pixel 49G and the third sub-pixel 49B are arranged in the processing direction in this order is referred to as a "GB arrangement." Further, an arrangement in which the second sub-pixel 49G and the first sub-pixel 49R are arranged in the processing direction in this order is referred to as a "GR arrangement," and an arrangement in which the third sub-pixel 49B and the second sub-pixel 49G are arranged in the processing direction in this order is referred to as a "BG arrangement." The display device 10 may select the RGB rendering in the case of either the RG arrangement or the GB arrangement and select the BGR rendering in the case of either the GR arrangement or the BG arrangement.

Second Embodiment

Next, a second embodiment will be described. A display device 10A according to the second embodiment (a second aspect) differs from that of the first embodiment in that a correction process is performed on the rendering input signal of the fourth sub-pixel according to the pattern information while performing a predetermined rendering process. In a configuration of the display device 10A according to the second embodiment, a description of portions common to those of the first embodiment will be omitted.

Configuration of Signal Processing Unit

Figure 21:
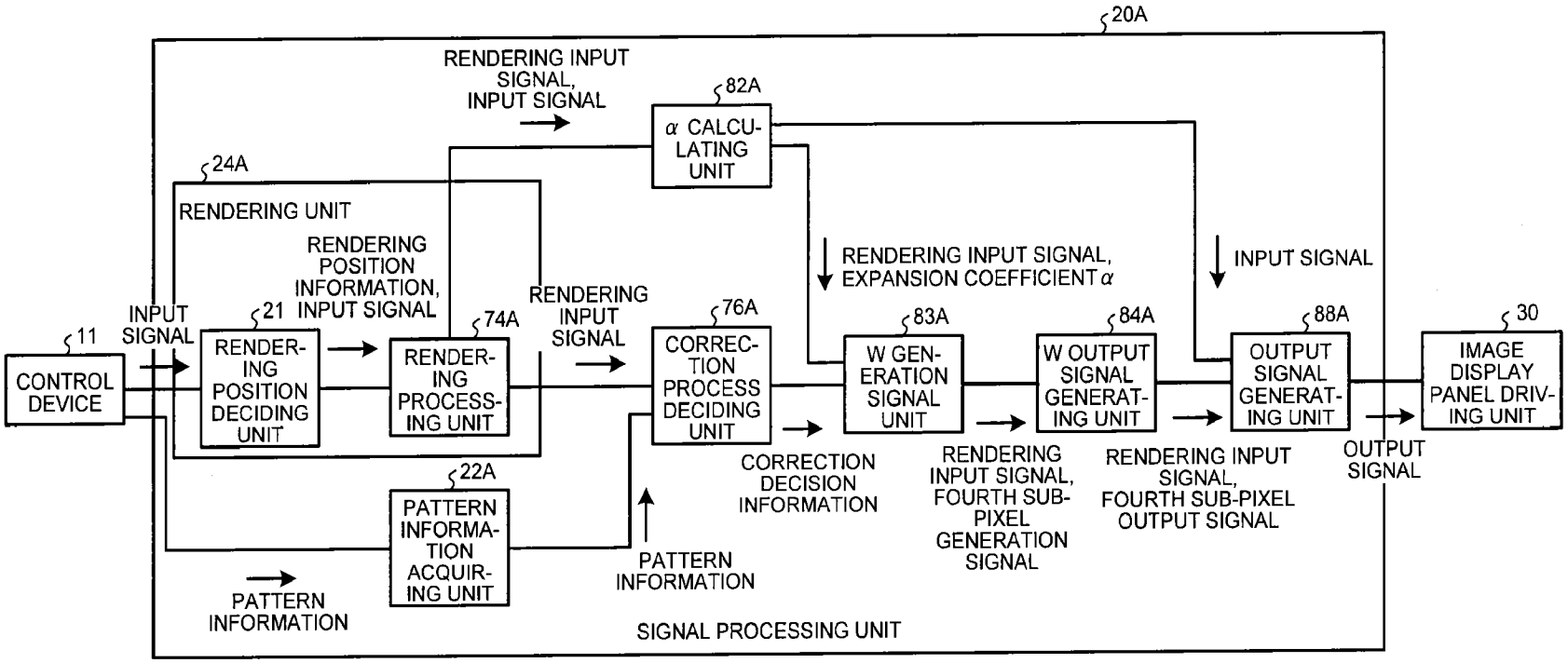
FIG. 21 is a block diagram illustrating a configuration of a signal processing unit according to a second embodiment.

FIG. 21 is a block diagram illustrating a configuration of a signal processing unit according to the second embodiment. As illustrated in FIG. 21, a signal processing unit 20A according to the second embodiment includes a pattern information acquiring unit 22A, a rendering unit 24A, a correction process deciding unit 76A, an α calculating unit 82A, a W generation signal unit 83A (a fourth sub-pixel generation signal unit), a W output signal generating unit 84A (a fourth sub-pixel output signal generating unit), and an output signal generating unit 88A.

As described above, the display mode deciding unit 13 of the control device 11 decides the display mode to which the image display panel 40 is set among the first portrait mode, the second portrait mode, the first landscape mode, and the second landscape mode. The pattern information acquiring unit 22A acquires the pattern information from the display mode deciding unit 13. In the second embodiment, in addition to the information indicating the first arrangement pattern or the second arrangement pattern, the pattern information includes information indicating whether or not the third sub-pixel 49B and the fourth sub-pixel 49W in the same pixel 48 are arranged in the first direction F1 in the corresponding display mode. In the second embodiment, the information indicating whether or not the third sub-pixel 49B and the fourth sub-pixel 49W in the same pixel 48 are arranged in the first direction F1 is information indicating the first BW arrangement or the second BW arrangement. The first BW arrangement is a sub-pixel arrangement in which the third sub-pixel 49B and the fourth sub-pixel 49W in the same pixel 48 are arranged in the first direction F1 (the processing direction) (adjacent to each other in the first direction F1) in the image display panel 40. The second BW arrangement is a sub-pixel arrangement in which the third sub-pixel 49B and the fourth sub-pixel 49W in the same pixel 48 are not arranged in the first direction F1 (the processing direction) (not adjacent to each other in the first direction F1) in the image display panel 40. The second BW arrangement information indicates that the third sub-pixel 49B and the fourth sub-pixel 49W in the same pixel 48 are arranged in a direction orthogonal to the first direction F1 (adjacent to each other in the direction orthogonal to the first direction F1).

As described above, the pattern information according to the second embodiment includes the information indicating the first arrangement pattern or the second arrangement pattern and the information indicating the first BW arrangement or the second BW arrangement. The pattern information according to the second embodiment is uniquely decided according to the information of the display mode. In other words, when the image display panel 40 is in the first portrait mode, the image display panel 40 has the second arrangement pattern and the first BW arrangement (see FIG. 20A). When the image display panel 40 is in the second portrait mode, the image display panel 40 has the first arrangement pattern and the first BW arrangement (see FIG. 20A). When the image display panel 40 is in the first landscape mode, the image display panel 40 has the first arrangement pattern and the second BW arrangement. When the image display panel 40 is in the second landscape mode, the image display panel 40 has the second arrangement pattern and the second BW arrangement (see FIG. 20A). In other words, the pattern information according to the second embodiment is the information of the display mode (the first portrait mode, the second portrait mode, the first landscape mode, or the second landscape mode). The pattern information acquiring unit 22A may acquire the information of the display mod (the first portrait mode, the second portrait mode, the first landscape mode, or the second landscape mode) from the display mode deciding unit 13 instead of the pattern information.

The rendering unit 24A includes a rendering position deciding unit 21 and a rendering processing unit 74A. The rendering processing unit 74A performs a predetermined rendering process on the pixel 48 decided to undergo the rendering process by the rendering position deciding unit 21, and generates the rendering input signal. In the second embodiment, the rendering processing unit 74A performs the RGB rendering process. The rendering processing unit 74A may perform the BGR rendering process or may perform any one of the RGB rendering and the BGR rendering.

The correction process deciding unit 76A acquires the pattern information from the pattern information acquiring unit 22A. The correction process deciding unit 76A acquires the rendering input signal from the rendering processing unit 74A. The correction process deciding unit 76A decides whether or not a fourth sub-pixel output signal of the pixel 48 that has undergone the rendering process is generated through the correction process based on the pattern information and the rendering input signal. The correction process deciding unit 76A outputs correction decision information which includes information indicating whether or not the correction process is performed to the W generation signal unit 83A. A method of deciding whether or not the correction process is performed will be described later.

The α calculating unit 82A calculates the expansion coefficient α based on the rendering input signal of the pixel 48 that has undergone the rendering process and the input signals of the other pixels using the same method as in the first embodiment. The α calculating unit 82A outputs the rendering input signal, and the information of the expansion coefficient α to the W generation signal unit 83A.

When the correction process is decided to be performed, the W generation signal unit 83A generates a fourth sub-pixel generation signal of the pixel 48 that has undergone the rendering process based on the correction decision information, the rendering input signal, and the expansion coefficient α. A process of generating the fourth sub-pixel generation signal will be described later.

The W output signal generating unit 84A generates the fourth sub-pixel output signal of the pixel 48 that has undergone the rendering process, based on the rendering input signal and the fourth sub-pixel generation signal of the pixel 48 that has undergone the rendering process. The fourth sub-pixel output signal generation process will be described later.

The output signal generating unit 88A generates the output signals of the first sub-pixel, the second sub-pixel, and the third sub-pixel of the pixel 48 that has undergone the rendering process, based on the fourth sub-pixel output signal and the rendering input signal. The output signal generating unit 88A generates the output signals of the sub-pixels based on the input signals of the other pixels 48. The output signal generation process will be described later.

Process Operation of Signal Processing Unit

Next, process operations of the respective units of the signal processing unit 20A will be described in detail. The process operation of the rendering position deciding unit 21 is the same as that of the first embodiment. The rendering process of the rendering processing unit 74A is the same as the RGB rendering in the first embodiment. A process of the pattern information acquiring unit 22 is the same as that of the first embodiment.

The correction process deciding unit 76A acquires the pattern information from the pattern information acquiring unit 22. The correction process deciding unit 76A acquires the rendering input signal. The correction process deciding unit 76A decides the pixel that undergoes the correction process based on the pattern information and the rendering input signal. In further detail, the correction process deciding unit 76A decides the pixel that undergoes the correction process based on the pattern information and a magnitude relation among the rendering input signal values of the sub-pixels 49 (the first sub-pixel 49R, the second sub-pixel 49G, and the third sub-pixel 49B) in the same pixel 48.

Specifically, when the image display panel 40 has the second arrangement pattern and the first BW arrangement (is in the first portrait mode according to the present embodiment), if, among the first sub-pixel rendering input signal value $x_{A1-(a+1,b)}$, the second sub-pixel rendering input signal value $x_{A2-(a+1,b)}$, and the third sub-pixel rendering input signal value $x_{A3-(a+1,b)}$ of the pixel $\mathbf{48}_{(a+1,b)}$, the first sub-pixel rendering input signal value $x_{A1-(a+1,b)}$ is smallest, and the third sub-pixel rendering input signal value $x_{A3-(a+1,b)}$ is largest, the correction process deciding unit 76A decides to perform the correction process on the pixel $\mathbf{48}_{(a+1,b)}$.

Further, when the image display panel 40 has the second arrangement pattern and the second BW arrangement (is in the second landscape mode in the present embodiment), if, among the first sub-pixel rendering input signal value $x_{A1-(a+1,b)}$, the second sub-pixel rendering input signal value $x_{A2-(a+1,b)}$, and the third sub-pixel rendering input signal value $x_{A3-(a+1,b)}$ of the pixel $\mathbf{48}_{(a+1,b)}$, the first sub-pixel rendering input signal value $x_{A1-(a+1,b)}$ is largest, and the third sub-pixel rendering input signal value $x_{A3-(a+1,b)}$ is smallest, the correction process deciding unit 76A decides to perform the correction process on the pixel $\mathbf{48}_{(a+1,b)}$.

Further, when the BGR rendering is performed, the correction process deciding unit 76A decides that the correction process is performed for the following case. When the image display panel 40 has the first arrangement pattern and the first BW arrangement (is in the second portrait mode in the present embodiment), if, among the first sub-pixel rendering input signal value $x_{A1-(a+1,b)}$, the second sub-pixel rendering input signal value $x_{A2-(a+1,b)}$, and the third sub-pixel rendering input signal value $x_{A3-(a+1,b)}$ of the pixel $\mathbf{48}_{(a+1,b)}$, the first sub-pixel rendering input signal value $x_{A1-(a+1,b)}$ is smallest, and the third sub-pixel rendering input signal value $x_{A3-(a+1,b)}$ is largest, the correction process deciding unit 76A decides to perform the correction process on the pixel $\mathbf{48}_{(a+1,b)}$.

Further, when the BGR rendering is performed, and the image display panel 40 has the first arrangement pattern and the second BW arrangement (is in the first landscape mode in the present embodiment), if, among the first sub-pixel rendering input signal value $x_{A1-(a+1,b)}$, the second sub-pixel rendering input signal value $x_{A2-(a+1,b)}$, and the third sub-pixel rendering input signal value $x_{A3-(a+1,b)}$ of the pixel $\mathbf{48}_{(a+1,b)}$, the first sub-pixel rendering input signal value $x_{A1-(a+1,b)}$ is largest, and the third sub-pixel rendering input signal value $x_{A3-(a+1,b)}$ is smallest, the correction process deciding unit 76A decides to perform the correction process on the pixel $\mathbf{48}_{(a+1,b)}$.

When the correction process is decided to be performed, the W generation signal unit 83A generates the fourth sub-pixel generation signal of the pixel 48 that has undergone the rendering process. Here, an example in which the rendering process is performed on the pixel $\mathbf{48}_{(a+1,b)}$, and the correction process is decided to be performed will be described. The W generation signal unit 83A calculates a fourth sub-pixel generation signal value $X_{A4-(a+1,b)}$ of the pixel $\mathbf{48}_{(a+1,b)}$ using the following Equation (10).

$$X_{A4-(a+1,b)}=\mathrm{Min}_{(a+1,b)}\cdot\alpha/\chi \tag{10}$$

Here, $\mathrm{Min}_{(a+1,b)}$ is a minimum value among a first sub-pixel rendering input signal value $x_{A1-(a+1,b)}$, a second sub-pixel rendering input signal value $x_{A2-(a+1,b)}$, and a third sub-pixel input signal value $x_{A3-(a+1,b)}$. In other words, the fourth sub-pixel generation signal value $X_{A4-(a+1,b)}$ is calculated using the same method as that for the fourth sub-pixel output signal according to the first embodiment.

The W output signal generating unit 84A generates the output signal of the fourth sub-pixel for the pixel $\mathbf{48}_{(a+1,b)}$ for which the fourth sub-pixel generation signal is generated. The W output signal generating unit 84A performs the correction process by performing an averaging process of averaging the fourth sub-pixel generation signal value $X_{A4-(a+1,b)}$ and the values based on the input signal values of the other sub-pixel 49, so as to calculate the fourth sub-pixel output signal value $X_{4-(a+1,b)}$ of the pixel $\mathbf{48}_{(a+1,b)}$. Specifically, the W output signal generating unit 84A calculates the fourth sub-pixel output signal value $X_{4-(a+1,b)}$ of the pixel $\mathbf{48}_{(a+1,b)}$ based on the following Equation (11).

$$X_{4-(a+1,b)}=(a\cdot x_{A4-(a+1,b)}b\cdot\mathrm{Max}_{(a+1,b)}/(a+b) \tag{11}$$

Here, $\mathrm{Max}_{(a+1,b)}$ is a maximum value of the first sub-pixel rendering input signal value $x_{A1-(a+1,b)}$, the second sub-pixel rendering input signal value $x_{A2-(a+1,b)}$, and the third sub-pixel input signal value $x_{A3-(a+1,b)}$. Further, "a" and "b" are arbitrary coefficients, and both "a" and "b" are 1 in the second embodiment. The W output signal generating unit 84A calculates the fourth sub-pixel output signal value $X_{4-(a+1,b)}$ of the pixel $\mathbf{48}_{(a+1,b)}$ by averaging the fourth sub-pixel generation signal value $X_{A4-(a+1,b)}$ of the pixel $48_{(a+1,b)}$ and the maximum value of the rendering input signal values of the first sub-pixel, the second sub-pixel, and the third sub-pixel of the pixel $48_{(a+1,b)}$. In Equation (11), arithmetic averaging is performed, but an embodiment is not limited thereto, and an arbitrary averaging process such as geometric averaging may be performed. The W output signal generating unit 84A performs the averaging process using $Mid_{(a+1,b)}$ instead of $Max_{(a+1,b)}$. $Mid_{(a+1,b)}$ is an intermediate value (a value that is neither the maximum value nor the minimum value) of the rendering input signal values of the first sub-pixel, the second sub-pixel, and the third sub-pixel of the pixel $48_{(a+1,b)}$. The W output signal generating unit 84A may perform the averaging process using the average value of the rendering input signal values of the first sub-pixel, the second sub-pixel, and the third sub-pixel of the pixel $48_{(a+1,b)}$ instead of $Max_{(a+1,b)}$. The W output signal generating unit 84A may perform the averaging process based on any one of the first sub-pixel input signal value $x_{1-(a+1,b)}$, the second sub-pixel input signal value $x_{2-(a+1,b)}$, and the third sub-pixel input signal value $x_{3-(a+1,b)}$ as long as the fourth sub-pixel output signal value $X_{4-(a+1,b)}$ is larger than the fourth sub-pixel generation signal value $X_{A4-(a+1,b)}$.

Further, the W output signal generating unit 84A may calculate a first sub-pixel generation signal value $X_{A1-(a+1,b)}$ a second sub-pixel generation signal value $X_{A2-(a+1,b)}$ and a third sub-pixel generation signal value $X_{A3-(a+1,b)}$ of the pixel $48_{(a+1,b)}$ using the following Equations (12) to (14) and perform the averaging process using these values. For example, the W output signal generating unit 84A may perform the averaging process using the fourth sub-pixel generation signal value $X_{A4-(a+1,b)}$ and the maximum value or the intermediate value of $X_{A1-(a+1,b)}$, $X_{A2-(a+1,b)}$, and $X_{A3-(a+1,b)}$ so as to calculate the fourth sub-pixel output signal value $X_{4-(a+1,b)}$.

$$X_{A1-(a+1,b)}=\alpha\cdot x_{A1-(a+1,b)}\chi\cdot X_{4-(a+1,b)} \tag{12}$$

$$X_{A2-(a+1,b)}=\alpha\cdot x_{A2-(a+1,b)}\chi\cdot X_{4-(a+1,b)} \tag{13}$$

$$X_{A3-(a+1,b)}=\alpha\cdot x_{A3-(a+1,b)}-\chi\cdot X_{4-(a+1,b)} \tag{14}$$

The output signal generating unit 88A generates the output signals of the first sub-pixel, the second sub-pixel, and the third sub-pixel of the pixel $48_{(a+1,b)}$ that has undergone the correction process. The output signal generating unit 88A generates the output signals of the first sub-pixel, the second sub-pixel, the third sub-pixel, and the fourth sub-pixel of the other pixels 48. The output signal generation process is the same as that of the first embodiment.

Figure 22A:
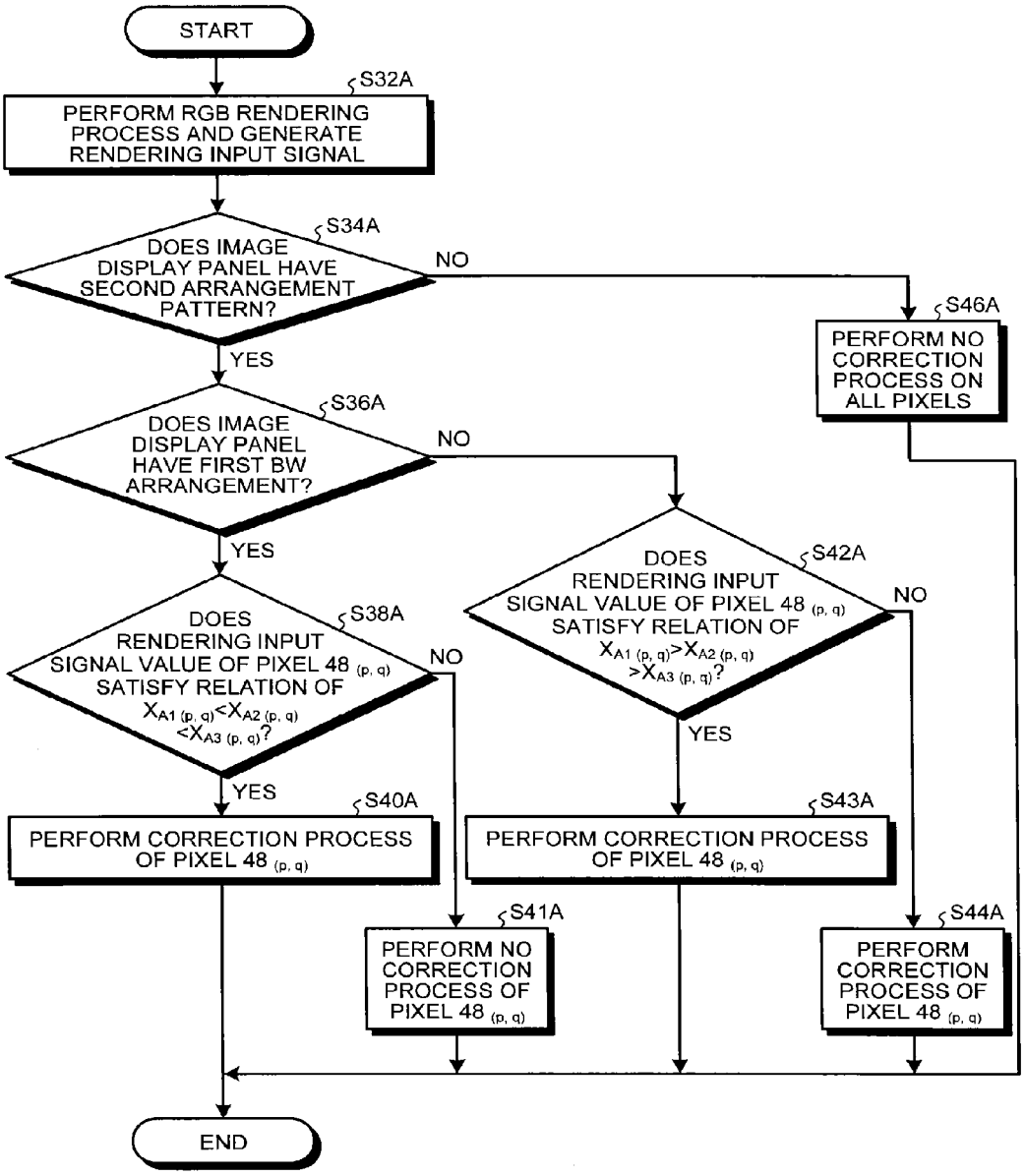
FIG. 22A is a flowchart for describing process operations of a rendering processing unit and a correction process deciding unit according to the second embodiment.

Next, the rendering process of the rendering processing unit 74A and a process of the correction process decision operation by the correction process deciding unit 76A will be described using flowcharts. FIG. 22A is a flowchart for describing process operations of the rendering processing unit and the correction process deciding unit according to the second embodiment. As illustrated in FIG. 22A, first, the rendering processing unit 74A performs the RGB rendering process, and generates the rendering input signal (step S32A).

After the rendering input signal is generated, the correction process deciding unit 76A acquires the pattern information from the pattern information acquiring unit 22, and when the image display panel 40 has the second arrangement pattern (Yes in step S34A), and the image display panel 40 has the first BW arrangement (Yes in step S36A), the correction process deciding unit 76A determines whether or not the rendering input signal value of the pixel $48_{(p,q)}$ satisfies a relation of $x_{A1-(p,q)}<x_{A2-(p,q)}<x_{A3-(p,q)}$ (step S38A). The relation of $x_{A1-(p,q)}<x_{A2-(p,q)}<x_{A3-(p,q)}$ refers to a relation in which, among the first sub-pixel rendering input signal value $x_{A1-(p,q)}$, the second sub-pixel rendering input signal value $x_{A2-(p,q)}$, the third sub-pixel rendering input signal value $x_{A3-(p,q)}$ of the pixel $48_{(p,q)}$, the first sub-pixel rendering input signal value $x_{A1-(p,q)}$ is smallest, and the third sub-pixel rendering input signal value $x_{A3-(p,q)}$ is largest.

When the image display panel 40 has the second arrangement pattern and the first BW arrangement, and the relation of $x_{A1-(p,q)}<x_{A2-(p,q)}<x_{A3-(p,q)}$ is satisfied (Yes in step S38A), the correction process deciding unit 76A decides to perform the correction process on the pixel $48_{(p,q)}$ satisfying the relation (step S40A). The correction process is a process of generating the fourth sub-pixel output signal based on the fourth sub-pixel generation signal using Equations (10) and (11).

When the image display panel 40 has the second arrangement pattern and the first BW arrangement, but the pixel $48_{(p,q)}$ does not satisfy the relation of $x_{A1-(p,q)}<x_{A2-(p,q)}<x_{A3-(p,q)}$ (No in step S38A), the correction process deciding unit 76A decides not to perform the correction process on the pixel $48_{(p,q)}$ (step S41A).

Further, when the image display panel 40 is determined not to have the first BW arrangement, that is, determined to have the second BW arrangement in step S36A (No in step S36A), the correction process deciding unit 76A determines whether or not the rendering input signal value of the pixel $48_{(p,q)}$ satisfies the relation of $x_{A1-(p,q)}>x_{A2-(p,q)}>x_{A3-(p,q)}$ (step S42A). The relation of $x_{A1-(p,q)}>x_{A2-(p,q)}>x_{A3-(p,q)}$ refers to a relation in which, among the first sub-pixel rendering input signal value $x_{A1-(p,q)}$, the second sub-pixel rendering input signal value $x_{A2-(p,q)}$, and the third sub-pixel rendering input signal value $x_{A3-(p,q)}$ of the pixel $48_{(p,q)}$, the first sub-pixel rendering input signal value $X_{A1-(p,q)}$ is largest, and the third sub-pixel rendering input signal value $x_{A3-(p,q)}$ is smallest.

When the image display panel 40 has the second arrangement pattern but does not have the first BW arrangement (has the second BW arrangement), and the relation of $x_{A-(p,q)}>x_{A2-(p,q)}>x_{A3-(p,q)}$ is satisfied (Yes in step S42A), the correction process deciding unit 76A decides to perform the correction process on the pixel $48_{(p,q)}$ satisfying the relation (step S43A).

When the image display panel 40 has the second arrangement pattern but does not have the first BW arrangement (has the second BW arrangement), and the pixel $48_{(p,q)}$ does not satisfy the relation of $x_{A-(p,q)}>x_{A2-(p,q)}>x_{A3-(p,q)}$ (No in step S42A), the correction process deciding unit 76A decides not to perform the correction process on the pixel $48_{(p,q)}$ (step S44A).

Further, when the image display panel 40 does not have the second arrangement pattern (No in step S34A), that is, when the image display panel 40 has the first arrangement pattern, the correction process deciding unit 76A decides not to perform the correction process on all the pixels 48 in one frame (step S46A). After the process of any one of steps S40A, S41A, S43A, S44A, and S46A is performed, the current process ends.

Figure 22B:
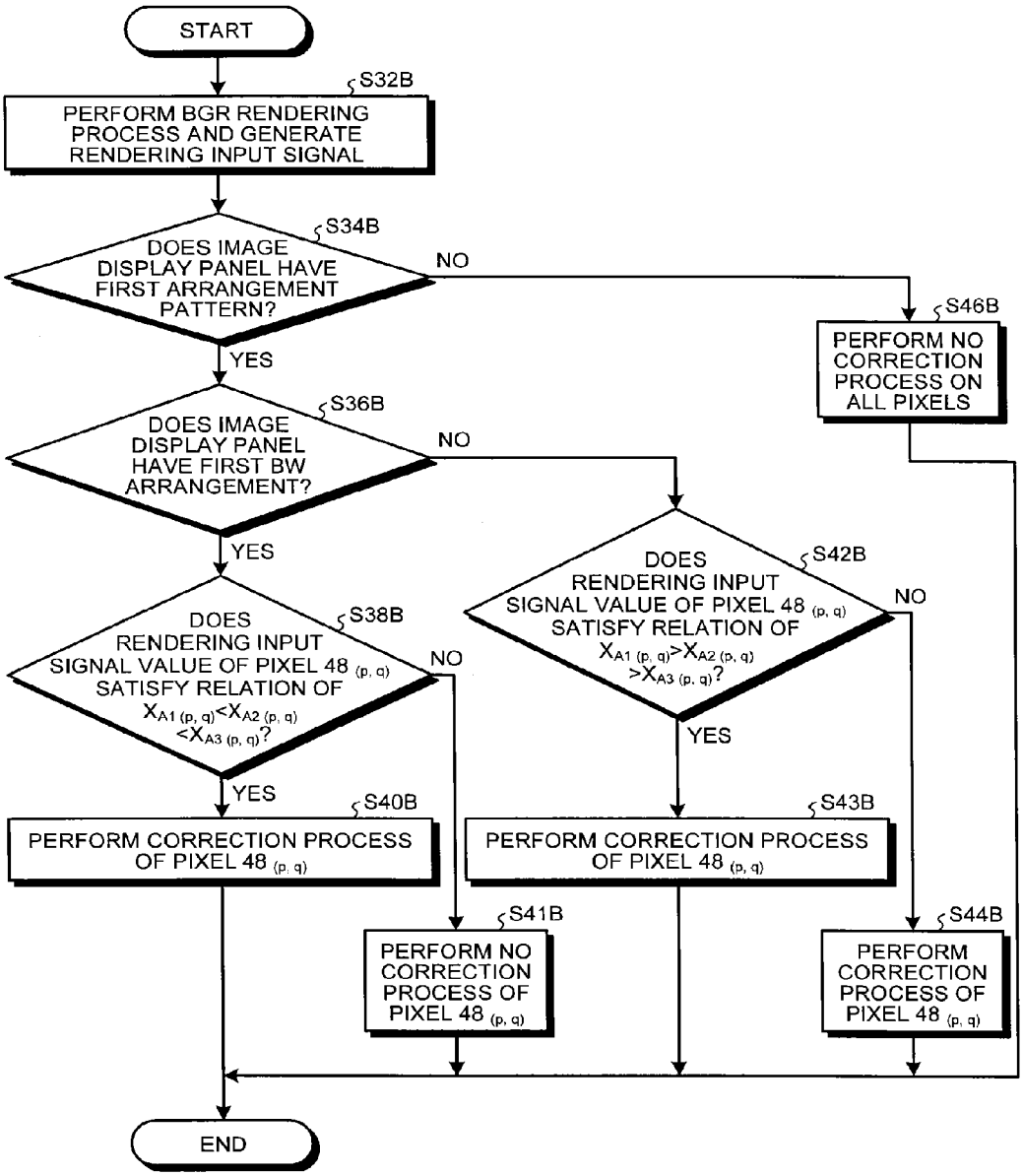
FIG. 22B is a flowchart for describing process operations of a rendering processing unit and a correction process deciding unit according to another example of the second embodiment.

Further, when the BGR rendering process is performed, the correction process decision flow differs from that of FIG. 22A. FIG. 22B is a flowchart for describing process operations of the rendering processing unit and the correction process deciding unit according to another example of the second embodiment. FIG. 22B illustrates the correction process decision flow when the BGR rendering process is performed. In this case, as illustrated in FIG. 22B, the rendering processing unit 74A performs the BGR rendering process, and generates the rendering input signal (step S32B).

After the rendering input signal is generated, the correction process deciding unit 76A acquires the pattern information from the pattern information acquiring unit 22, and determines whether or not the image display panel 40 has the first arrangement pattern (step S34B). When the image display panel 40 has the first arrangement pattern (Yes in step S34B), the correction process deciding unit 76A performs step S36B. A subsequent process including step S36B, that is, steps S36B, S38B, S40B, S41B, S42B, S43B, and S44B have the same processing content as steps S36A, S38A, S40A, S41A, S42A, S43A, and S44A of FIG. 22A, and thus a description thereof is omitted. Further, when the image display panel 40 does not have the first arrangement pattern (No in step S34B), the correction process deciding unit 76A decides not to perform the correction process on all the pixels 48 in one frame (step S46B). After the process of any one of steps S40B, S41B, S43B, S44B, and S46B is performed, the current process ends.

Display Example

Next, a display example of the sub-pixels when the rendering process and the correction process according to the second embodiment are performed will be described. As described above with reference to FIG. 18, the display device 10Y according to the first comparative example does not change the rendering process according to the display mode and does not perform the correction process described in the second embodiment, and thus the line L1 of FIG. 18 is likely to be recognized as the dark line when the rendering process is performed.

Figure 23A:
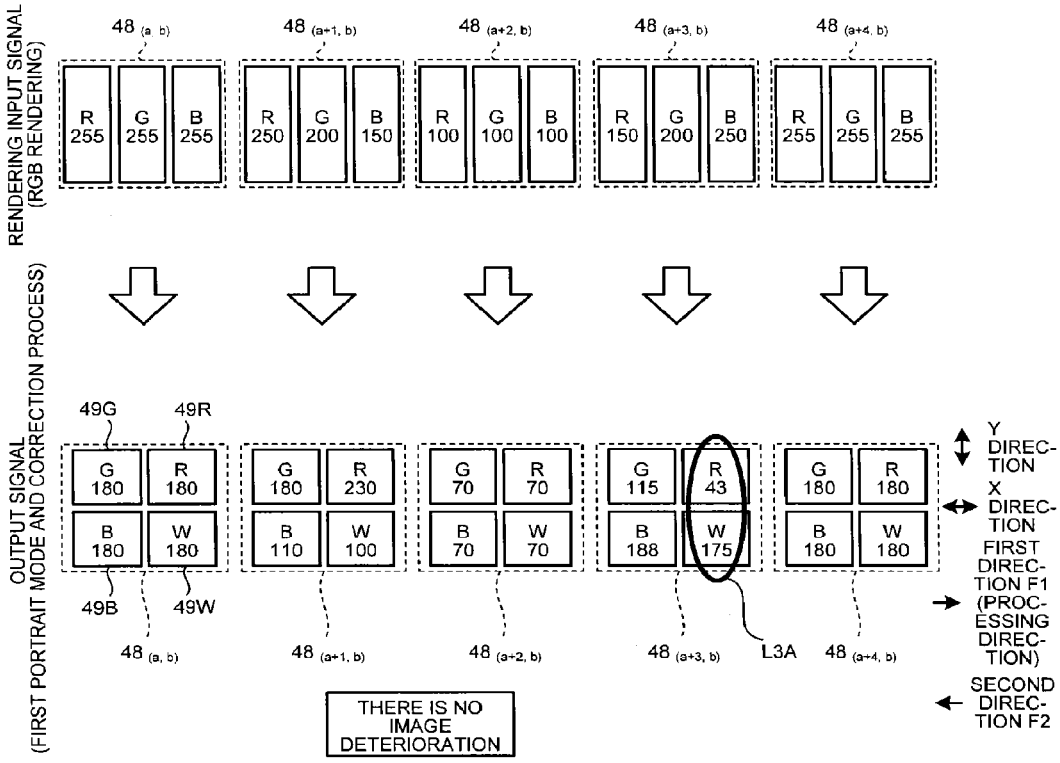
FIG. 23A is a schematic diagram illustrating an example of output signals of sub-pixels when a rendering process and a correction process according to the second embodiment are performed.

FIG. 23A is a schematic diagram illustrating an example of the output signals of the sub-pixels when the rendering process and the correction process according to the second embodiment are performed. In the example illustrated in FIG. 23A, the image display panel 40 is assumed to be in the first portrait mode. As illustrated in FIG. 23A, in the second embodiment, similarly to the first comparative example, the RGB rendering process is performed even in the first portrait mode. Here, as described above, in the first portrait mode, the image display panel 40 has the second arrangement pattern and the first BW arrangement. Further, as illustrated in FIG. 23A, among the rendering input signal values of the pixel $\mathbf{48}_{(a+3,b)}$ the first sub-pixel rendering input signal value $x_{A1-(a+3,b)}$ is smallest, and the third sub-pixel rendering input signal value $x_{A3-(a+3,b)}$ is largest. Thus, the signal processing unit 20A according to the second embodiment performs the correction process on the pixel $\mathbf{48}_{(a+3,b)}$. In other words, the signal processing unit 20A generates the fourth sub-pixel generation signal for the pixel $\mathbf{48}_{(a+3,b)}$, and generates the fourth sub-pixel output signal by performing the averaging process using the fourth sub-pixel generation signal value $X_{A4-(a+3,b)}$ and $Max_{(a+3,b)}$. On the other hand, among the rendering input signal values of the pixel $\mathbf{48}_{(a+1,b)}$ the first sub-pixel rendering input signal value $x_{A1-(a+1,b)}$ is largest, and the third sub-pixel rendering input signal value $x_{A3-(a+1,b)}$ is smallest. Thus, the signal processing unit 20A according to the second embodiment does not perform the correction process on the pixel $\mathbf{48}_{(a+1,b)}$.

As illustrated in FIG. 23A, in the pixel $\mathbf{48}_{(a+3,b)}$ that has undergone the correction process, an output signal value $X_{1-(a+3,b)}$ of the first sub-pixels is 43, an output signal value $X_{2-(a+3,b)}$ of the second sub-pixel is 115, an output signal value $X_{3-(a+3,b)}$ of the third sub-pixel is 188, and an output signal value $X_{4-(a+3,b)}$ of the fourth sub-pixel is 175. In the pixel $\mathbf{48}_{(a+3,b)}$, the output signal value $X_{4-(a+3,b)}$ of the fourth sub-pixel is increased through the correction process. The display device 10A according to the second embodiment can increase luminance of a line L3A along the Y direction in which the sub-pixel 49R and the sub-pixel 49W of the pixel $\mathbf{48}_{(a+3,b)}$ are arranged by increasing the output value of the sub-pixel 49W of the pixel $\mathbf{48}_{(a+3,b)}$. Thus, the display device 10A can suppress, for example, the black line from being recognized and suppress the deterioration of the image. Further, the display device 10A does not perform the correction process on the pixel $\mathbf{48}_{(a+1,b)}$ in which the black line is unlikely to be recognized. Thus, the display device 10A can suppress the deterioration of the image such as recognition of the black line and can smoothly display the image by appropriately performing the rendering process.

Figure 23B:
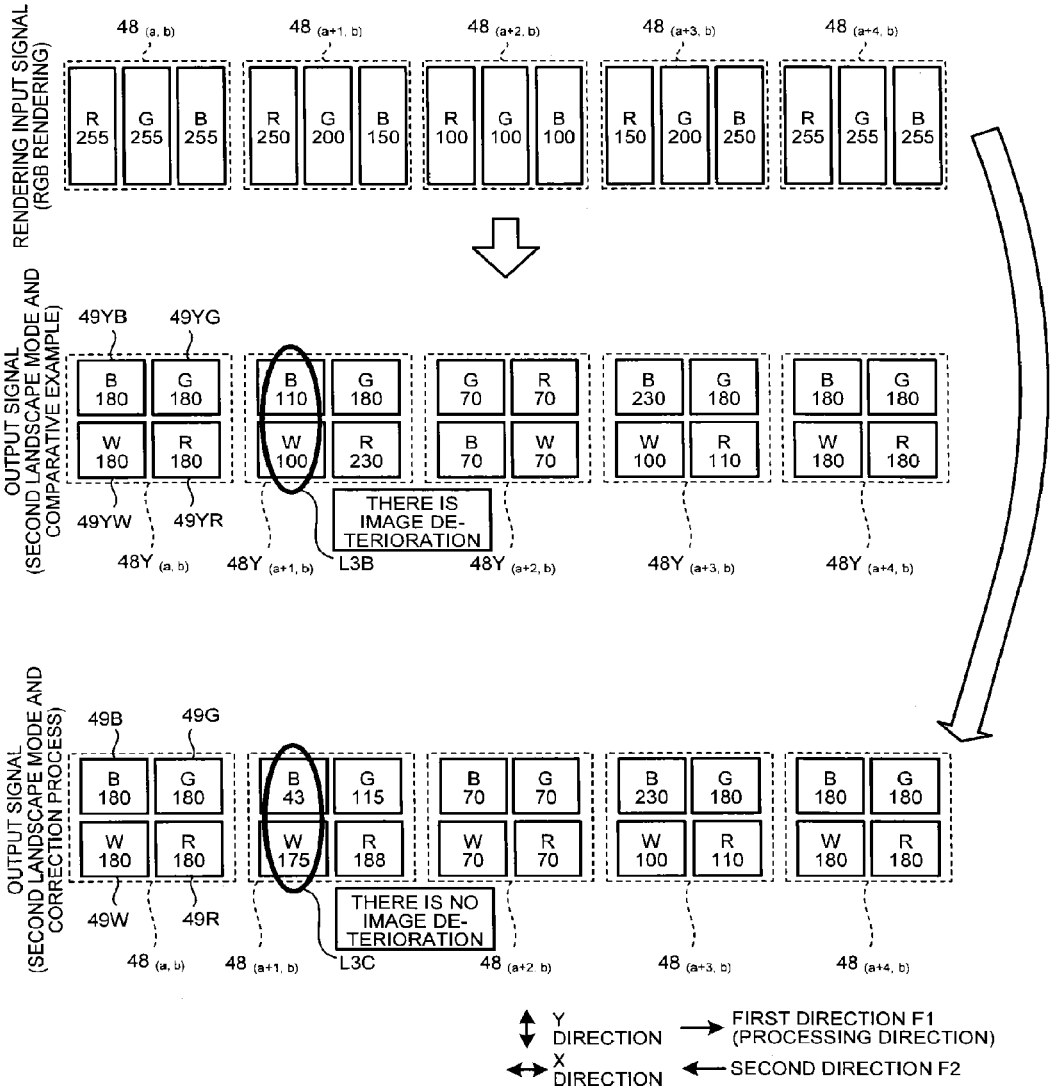
FIG. 23B is a schematic diagram illustrating another example of output signals of sub-pixels when the rendering process and the correction process according to the second embodiment are performed.

FIG. 23B is a schematic diagram illustrating another example of the output signals of the sub-pixels when the rendering process and the correction process according to the second embodiment are performed. In the example illustrated in FIG. 23B, the image display panel 40 is assumed to be in the second landscape mode. As illustrated in FIG. 23B, the display device 10Y according to the first comparative example does not change the rendering process according to the display mode and does not perform the correction process described in the second embodiment. Here, as described above, in the second landscape mode, the image display panel 40 has the second arrangement pattern and the second BW arrangement. Further, as illustrated in FIG. 23B, among the rendering input signal values of the pixel $\mathbf{48}_{(a+1,b)}$, the first sub-pixel rendering input signal value $x_{A1-(a+1,b)}$ is largest, and the third sub-pixel rendering input signal value $x_{A3-(a+1,b)}$ is smallest. Thus, the signal processing unit 20A according to the second embodiment performs the correction process on the pixel $\mathbf{48}_{(a+1,b)}$. In other words, the signal processing unit 20A generates the fourth sub-pixel generation signal on the pixel $\mathbf{48}_{(a+1,b)}$, and generates the fourth sub-pixel output signal by performing the averaging process using the fourth sub-pixel generation signal value $X_{A4-(a+1,b)}$ and $Max_{(a+1,b)}$. On the other hand, among the rendering input signal values of the pixel $\mathbf{48}_{(a+3,b)}$, the first sub-pixel rendering input signal value $x_{A1-(a+3,b)}$ is smallest, the third sub-pixel rendering input signal value $x_{A3-(a+3,b)}$ is largest. Thus, the signal processing unit 20A according to the second embodiment does not perform the correction process on the pixel $\mathbf{48}_{(a+3,b)}$.

As illustrated in FIG. 23B, in the first comparative example, the sub-pixel 49YB and the sub-pixel 49YW in the pixel $\mathbf{48}Y_{(a+1,b)}$ are arranged in the Y direction (the direction orthogonal to the first direction F1) and have the signal values of 110 and 100. Thus, in the image display panel 40Y according to the first comparative example, in the second landscape mode, the sub-pixel 49YB and the sub-pixel 49YW in the pixel $\mathbf{48}Y_{(a+1,b)}$ are smaller in the signal value than the sub-pixels adjacent to both sides in the X direction, and a line L3B formed by the sub-pixel 49YB and the sub-pixel 49YW is likely to be recognized as the dark line.

On the other hand, when the correction process according to the second embodiment is performed, in the pixel $\mathbf{48}_{(a+1,b)}$ that has undergone the correction process, the output signal value $X_{1-(a+1,b)}$ of the first sub-pixel is 188, the output signal value $X_{2-(a+1,b)}$ of the second sub-pixel is 115, the output signal value $X_{3-(a+1,b)}$ of the third sub-pixel is 43, and the output signal value $X_{4-(a+1,b)}$ of the fourth sub-pixel is 175. In the pixel $\mathbf{48}_{(a+1,b)}$ the output signal value $X_{4-(a+1,b)}$ of the fourth sub-pixel is increased through the correction process. The display device 10A according to the second embodiment can increase luminance of a line L3C along the Y direction in which the sub-pixel 49B and the sub-pixel 49W of the pixel $\mathbf{48}_{(a+1,b)}$ are arranged by increasing the output value of the sub-pixel 49W of the pixel $\mathbf{48}_{(a+1,b)}$. Thus, the display device 10A can suppress, for example, the black line from being recognized and suppress the deterioration of the image. Further, the display device 10A does not perform the correction process on the pixel $\mathbf{48}_{(a+3,b)}$ in which the black line is unlikely to be recognized. Thus, the display device 10A can suppress the deterioration of the image such as the recognition of the black line and can smoothly display the image by appropriately performing the rendering process.

As described above, the display device 10A according to the second embodiment includes the image display panel 40 in which a plurality of pixels 48 each of which includes the first sub-pixel 49R, the second sub-pixel 49G, the third sub-pixel 49B, and the fourth sub-pixel 49W arranged in a 2×2 matrix form are arranged on the display region 43 of the square shape having the first side (the short side 41) and the second side (the long side 42) in the matrix form. The image display panel 40 receives the image information corresponding to the portrait mode in which the direction along the first side is a predetermined one direction (here, the X direction) of the display image or the landscape mode in which the direction along the second side is a predetermined one direction (here, the X direction) of the display image. The signal processing unit 20A according to the second embodiment includes the rendering unit 24A that performs the rendering process on the pixel $\mathbf{48}_{(a+1,b)}$, the pixel $\mathbf{48}_{(a,b)}$, the pixel $\mathbf{48}_{(a+1,b)}$, and the pixel $\mathbf{48}_{(a+2,b)}$ arranged in the processing direction (here, the first direction F1), when the difference between the input signal values of the sub-pixel $\mathbf{49}_{(a,b)}$ of the pixel $\mathbf{48}_{(a,b)}$ and the input signal values of the sub-pixels $\mathbf{49}_{(a+2,b)}$ of the pixel $\mathbf{48}_{(a+2,b)}$ is a predetermined threshold value or more. The signal processing unit 20A further includes the pattern information acquiring unit 22 that acquires the arrangement of the sub-pixels 49 in the processing direction (here, the first direction F1) of the display mode of either of the portrait mode and the landscape mode as the pattern information indicating either of the first arrangement pattern and the second arrangement pattern that differ in the arrangement of the sub-pixels 49. The signal processing unit 20A further includes the correction process deciding unit 76A that decides whether or not the output signal of the fourth sub-pixel in the pixel $\mathbf{48}_{(a+1,b)}$ is generated through the correction process based on the pattern information. The signal processing unit 20A includes the W generation signal unit 83A that obtains the fourth sub-pixel generation signal in the pixel $\mathbf{48}_{(a+1,b)}$ based on the rendering input signals of the first sub-pixel 49R, the second sub-pixel 49G, and the third sub-pixel 49B in the pixel $\mathbf{48}_{(a+1,b)}$, and the expansion coefficient α, based on the decision of the correction process deciding unit 76A. The signal processing unit 20A further includes the W output signal generating unit 84A that performs the correction process by performing the averaging process based on the fourth sub-pixel generation signal in the pixel $\mathbf{48}_{(a+1,b)}$ and the input signal of the other sub-pixels 49, and generates the fourth sub-pixel output signal in the pixel $\mathbf{48}_{(a+1,b)}$. The signal processing unit 20A further includes the output signal generating unit 88A that generates the output signals of the first sub-pixel 49R, the second sub-pixel 49G, and the third sub-pixel 49B in the pixel $\mathbf{48}_{(a+1,b)}$.

In the display device 10A, the sub-pixels 49 are arranged in a diagonal form of a 2×2 matrix The output signal value of the fourth sub-pixel 49W of the pixel 48 that has undergone the rendering process is increased by performing the correction process on the pixel 48 that has undergone the rendering process according to whether the image display panel 40 has the first arrangement pattern or the second arrangement pattern. Since the display device 10A can increase the luminance of the fourth sub-pixel 49W of the pixel 48 that has undergone the rendering process according to the display mode, even when the display mode is switched, for example, it is possible to suppress the black line from being recognized and suppress the deterioration of the image.

Further, when the rendering process to be performed is the RGB rendering process, the display device 10A performs the correction process on a predetermined pixel 48 in the case of the second arrangement pattern. Further, when the rendering process to be performed is the BGR rendering process, the display device 10A performs the correction process on a predetermined pixel 48 in the case of the first arrangement pattern. Thus, for example, when the black line is likely to be recognized, the display device 10A can appropriately increase the luminance of the fourth sub-pixel 49W of the pixel 48 that has undergone the rendering process. Thus, the display device 10A can appropriately suppress the deterioration of the image.

In addition, when the rendering process to be performed is the RGB rendering process, and the image display panel 40 has the second arrangement pattern, the display device 10A selects a predetermined pixel 48 that undergoes the correction process based on the magnitude relation of the rendering input signal values among the sub-pixels 49 in the same pixel 48. For example, when the RGB rendering process is performed, and the image display panel 40 has the second arrangement pattern and the first BW arrangement, the display device 10A performs the correction process on the pixel $\mathbf{48}_{(a+3,b)}$ in which, among the first sub-pixel rendering input signal value $x_{A1-(a+3,b)}$, the second sub-pixel rendering input signal value $x_{A2-(a+3,b)}$, the third sub-pixel rendering input signal value $x_{A3-(a+3,b)}$, the first sub-pixel rendering input signal value $x_{A1-(a+3,b)}$ is smallest, and the third sub-pixel rendering input signal value $x_{A3-(a+3,b)}$ is largest. Further, when the RGB rendering process is performed, and the image display panel 40 has the second arrangement pattern and the second BW arrangement, the display device 10A performs the correction process on the pixel $\mathbf{48}_{(a+1,b)}$ in which, among the first sub-pixel rendering input signal value $x_{A1-(a+1,b)}$, the second sub-pixel rendering input signal value $x_{A2-(a+1,b)}$, and the third sub-pixel rendering input signal value $x_{A3-(a+1,b)}$, the first sub-pixel rendering input signal value $x_{A1-(a+1,b)}$ is largest, and the third sub-pixel rendering input signal value $x_{A3-(a+1,b)}$ is smallest.

Thus, the display device 10A can appropriately suppress the deterioration of the image by increasing the luminance of the fourth sub-pixel 49W, for example, for the pixel in which the black line is likely to be recognized. Further, the display device 10A performs the correction process on only on the pixel 48 satisfying the conditions and does not perform the correction process on the other pixels 48. Thus, the display device 10A performs the correction process on only on the pixel in which the black line is likely to be recognized and thus can smoothly display the image by appropriately performing the rendering process while suppressing the deterioration of the image such as the recognition of the black line. However, when the rendering process to be performed is the RGB rendering process, in the case of the second arrangement pattern, the display device 10A may perform the correction process on all the pixels 48 that have undergone the rendering process.

Further, when the rendering process to be performed is the BGR rendering process, and the image display panel 40 has the first arrangement pattern, the display device 10A selects a predetermined pixel 48 that undergoes the correction process based on the magnitude relation among the rendering input signal values of the sub-pixels 49 in the same pixel 48. For example, when the BGR rendering process is performed, and the image display panel 40 has the first arrangement pattern and the first BW arrangement, the display device 10A performs the correction process on the pixel $\mathbf{48}_{(a+3,b)}$ in which, among the first sub-pixel rendering input signal value $x_{A1-(a+3,b)}$, the second sub-pixel rendering input signal value $x_{A2-(a+3,b)}$, the third sub-pixel rendering input signal value $x_{A3-(a+3,b)}$, the first sub-pixel rendering input signal value $x_{A1-(a+3,b)}$ is smallest, and the third sub-pixel rendering input signal value $x_{A3-(a+3,b)}$ is largest. Further, when the BGR rendering process is performed, and the image display panel 40 has the first arrangement pattern and the second BW arrangement, the display device 10A performs the correction process on the pixel $\mathbf{48}_{(a+1,b)}$ in which, among the first sub-pixel rendering input signal value $x_{A1-(ail,b)}$, the second sub-pixel rendering input signal value $x_{A2-(a+1,b)}$, the third sub-pixel rendering input signal value $x_{A3-(a+1,b)}$, the first sub-pixel rendering input signal value $x_{A1-(a+1,b)}$ is largest and, the third sub-pixel rendering input signal value $x_{A3-(a+1,b)}$ is smallest. The display device 10A performs the correction process on only the pixel 48 satisfying the conditions, and does not perform the correction process on the other pixels 48. However, when the rendering process to be performed is the BGR rendering process, the display device 10A may perform the correction process on all the pixels 48 that have undergone the rendering process in the case of the first arrangement pattern.

As described above, the rendering processing unit 74A may perform any one of the RGB rendering and the BGR rendering which is decided in advance. Thus, the rendering process of the rendering processing unit 74A is a process of causing the rendering input signal values of the first sub-pixel, the second sub-pixel, and the third sub-pixel ($x_{A1-(a+1,b)}$, $x_{A2-(a+1,b)}$, $x_{A3-(a+1,b)}$) in the pixel $\mathbf{48}_{(a+1,b)}$ to be values between the input signal values of the sub-pixels of the pixel $\mathbf{48}_{(a,b)}$ and the input signal values of the sub-pixels of the pixel $\mathbf{48}_{(a+2,b)}$. Further, the rendering process of the rendering processing unit 74A is a process of causing the second sub-pixel rendering input signal value $x_{A2-(a+1,b)}$ to be a value between the first sub-pixel rendering input signal value $x_{A1-(a+1,b)}$ and the third sub-pixel rendering input signal value $x_{A3-(a+1,b)}$.

The W output signal generating unit 84A calculates the fourth sub-pixel output signal value $X_{4-(a+1,b)}$ of the pixel $\mathbf{48}_{(a+1,b)}$ based on the fourth sub-pixel generation signal value $X_{A4-(a+1,b)}$ and the first sub-pixel input signal value $x_{1-(a+1,b)}$ the second sub-pixel input signal value $x_{2-(a+1,b)}$, or the third sub-pixel input signal value $x_{3-(a+1,b)}$ in the pixel $\mathbf{48}_{(a+1,b)}$. The W output signal generating unit 84A performs the averaging process based on the input signal values of the same pixels and thus can suppress the deterioration of the image by appropriately increasing the luminance of the fourth sub-pixel 49W of the pixel that has undergone the rendering process.

The W output signal generating unit 84A may generate the output signal of the fourth sub-pixel 49W of the pixel $\mathbf{48}_{(a+1,b)}$ based on the generation signal of the fourth sub-pixel 49W of the pixel $\mathbf{48}_{(a+1,b)}$ and the output signal or the generation signal of the fourth sub-pixel of the pixel adjacent to the pixel $\mathbf{48}_{(a+1,b)}$. In this case, the W output signal generating unit 84A preferably performs the averaging process of the generation signal of the fourth sub-pixel $\mathbf{49}_{(a+1,b)}$ of the pixel $\mathbf{48}_{(a+1,b)}$ and the output signal or the generation signal of the fourth sub-pixel of the pixel neighboring the pixel $\mathbf{48}_{(a+1,b)}$ using the same method (Equation (11) or the like) as the averaging process based on the input signal values of the same pixels described above. Even when the neighboring pixel undergoes the averaging process, the W output signal generating unit 84A can suppress the deterioration of the image by appropriately increasing the luminance of the fourth sub-pixel 49W of the pixel that has undergone the rendering process. In this case, the neighboring pixel of the pixel $\mathbf{48}_{(a+1,b)}$ is the pixel $\mathbf{48}_{(a+2,b)}$ that is adjacent in the first direction F1, but the pixel that is adjacent in the second direction F2, the third direction F3, or the fourth direction F4 may be used as the neighboring pixel of the pixel $\mathbf{48}_{(a+1,b)}$.

The W output signal generating unit 84A calculates the fourth sub-pixel output signal value $X_{4-(a+1,b)}$ of the pixel $\mathbf{48}_{(a+1,b)}$ by averaging the fourth sub-pixel generation signal value $X_{A4-(a+1,b)}$ and the maximum value of the first sub-pixel rendering input signal value $x_{A1-(a+1,b)}$, the second sub-pixel rendering input signal value $x_{A2-(a+1,b)}$, and the third sub-pixel rendering input signal value $x_{A3-(a+1,b)}$ of the pixel $\mathbf{48}_{(a+1,b)}$. The W output signal generating unit 84A performs the averaging process based on the maximum rendering input signal value of the same pixel and thus can suppress the deterioration of the image by appropriately increasing the luminance of the fourth sub-pixel 49W of the pixel that has undergone the rendering process.

Next, a relation between the display mode (the pattern information) and a pixel that undergoes the correction process in the image display panel according to the second embodiment will be described. FIG. 24A is a table indicating a relation between the display mode and a condition of a pixel that undergoes the correction process in the image display panel according to the second embodiment. As illustrated in FIG. 24A, the display device 10A performs the correction process on the pixel $\mathbf{48}_{(p,q)}$ in which the relation of $x_{A-(p,q)}<x_{A2-(p,q)}<x_{A3-(p,q)}$ is satisfied when the image display panel 40 is in the first portrait mode and has the second arrangement pattern and the first BW arrangement, and the RGB rendering is performed. Further, when the image display panel 40 is in the first landscape mode and has the first arrangement pattern and the second BW arrangement, and the BGR rendering is performed, the display device 10A performs the correction process on the pixel $\mathbf{48}_{(p,q)}$ in which the relation of $x_{A-(p,q)}>x_{A2-(p,q)}>x_{A3-(p,q)}$ is satisfied. When the image display panel 40 is in the second portrait mode and has the first arrangement pattern and the first BW arrangement, and the BGR rendering is performed, the display device 10A performs the correction process on the pixel $\mathbf{48}_{(p,q)}$ in which the relation of $x_{A1-(p,q)}<x_{A2-(p,q)}<x_{A3-(p,q)}$ is satisfied. Further, when the image display panel 40 is in the second landscape mode and has the second arrangement pattern and the second BW arrangement, and the RGB rendering is performed, the display device 10A performs the correction process on the pixel $\mathbf{48}_{(p,q)}$ in which the relation of $x_{A1-(p,q)}>x_{A2-(p,q)}>x_{A3-(p,q)}$ is satisfied.

An image display panel with which the display device 10A is equipped is not limited to the image display panel 40 having the sub-pixel arrangement illustrated in FIG. 24A. An image display panel with which the display device 10A is equipped may differ in the sub-pixel arrangement from the image display panel 40 when the display mode is fixed as long as the first sub-pixel 49R, the second sub-pixel 49G, the third sub-pixel 49B, the fourth sub-pixel 49W are arranged in the pixel 48 in the 2×2 matrix form. FIG. 24B is a table indicating a relation between the display mode and a condition of a pixel that undergoes the correction process in another example of the image display panel according to the second embodiment. FIG. 24B illustrates a relation between the display mode and the pixel that undergoes the correction process in the image display panel 40S illustrated in FIG. 20B.

As illustrated in FIG. 24B, when the image display panel 40S is in the first portrait mode and has the first arrangement pattern and the second BW arrangement, and the BGR rendering is performed, the display device 10A performs the correction process on the pixel $\mathbf{48}_{(p,q)}$ in which the relation of $x_{A1-(p,q)}>x_{A2-(p,q)}>x_{A3-(p,q)}$ is satisfied. When the image display panel 40S is in the first landscape mode and has the second arrangement pattern and the first BW arrangement, and the RGB rendering is performed, the display device 10A performs the correction process on the pixel $\mathbf{48}_{(p,q)}$ in which the relation of $x_{A1-(p,q)}<x_{A2-(p,q)}<x_{(A3-(p,q)}$ is satisfied. When the image display panel 40S is in the second portrait mode and has the second arrangement pattern and the second BW arrangement, and the RGB rendering is performed, the display device 10A performs the correction process on the pixel $\mathbf{48}_{(p,q)}$ in which the relation of $x_{A-(p,q)}>x_{A2-(p,q)}>x_{A3-(p,q)}$ is satisfied. Further, when the image display panel 40S is in the second landscape mode and has the first arrangement pattern and the first BW arrangement, and the BGR rendering is performed, the display device 10A performs the correction process on the pixel $\mathbf{48}_{(p,q)}$ in which the relation of $x_{A1-(p,q)}<x_{A2-(p,q)}<x_{A3-(p,q)}$ is satisfied.

The display device 10A may include the image display panel 40S described above, similarly to the first embodiment. Specifically, the display device 10A may include the image display panel having a different sub-pixel arrangement from those of the image display panels 40 and 40S as long as the first sub-pixel 49R, the second sub-pixel 49G, the third sub-pixel 49B, and the fourth sub-pixel 49W are arranged in the pixel 48 in the 2×2 matrix form, similarly to the first embodiment.

Third Embodiment

Next, a third embodiment will be described. A display device 10B according to the third embodiment (a third aspect) differs from that of the second embodiment in that the pattern information is not acquired, an output signal difference between the sub-pixel that has undergone the rendering process and the neighboring sub-pixel is detected, and the correction process is performed on the rendering input signal of the fourth sub-pixel based on the output signal difference. In a configuration of the display device 10B according to the third embodiment, a description of portions common to those of the second embodiment will be omitted.

Configuration of Signal Processing Unit

Figure 25:
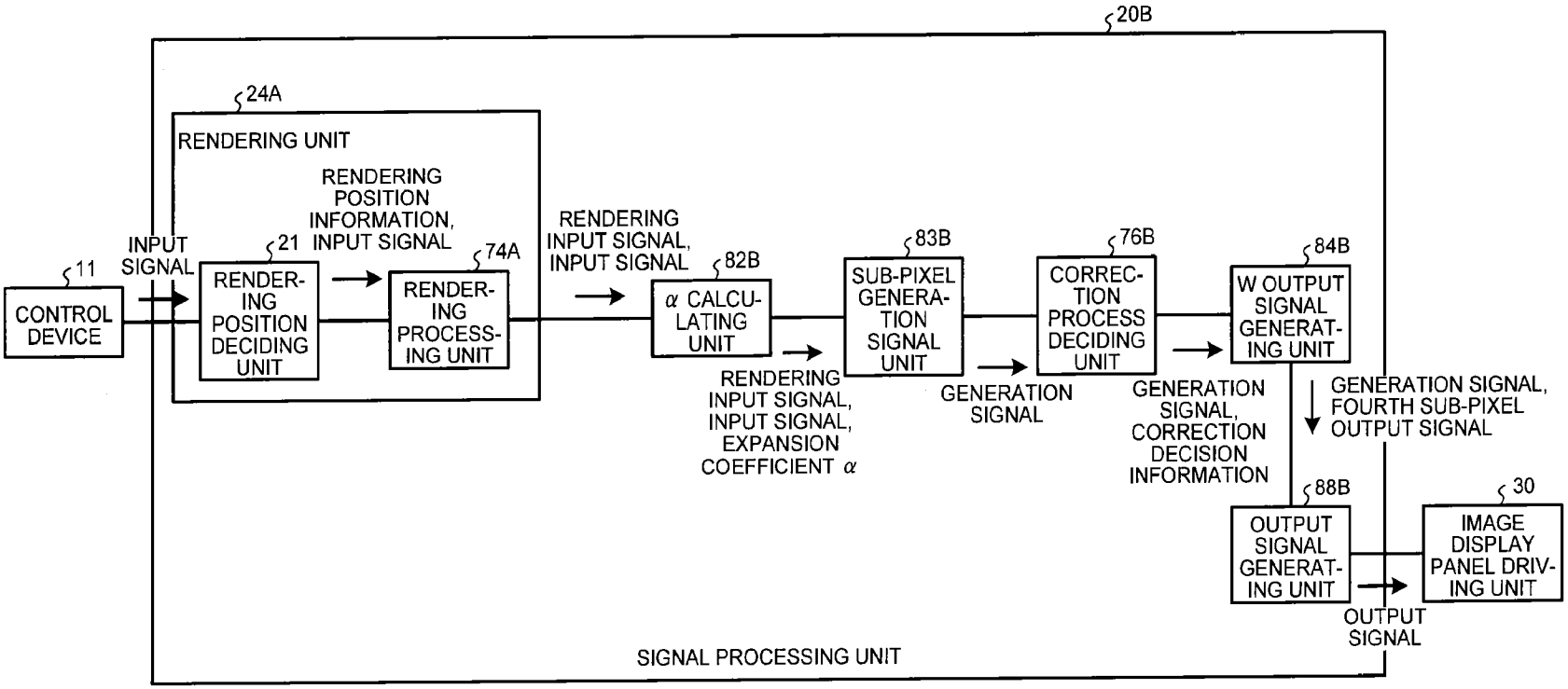
FIG. 25 is a block diagram illustrating a configuration of a signal processing unit according to a third embodiment.

FIG. 25 is a block diagram illustrating a configuration of the signal processing unit according to the third embodiment. As illustrated in FIG. 25, a signal processing unit 20B according to the third embodiment includes a rendering unit 24A, an α calculating unit 82B, a sub-pixel generation signal unit 83B, a correction process deciding unit 76B, a W output signal generating unit 84B, and an output signal generating unit 88B. The signal processing unit 20B does not include the pattern information acquiring unit and does not acquire the pattern information indicating the first arrangement pattern or the second arrangement pattern.

The rendering unit 24A performs a predetermined rendering process (here, the RGB rendering), and generates the rendering input signal, similarly to the second embodiment.

The α calculating unit 82B acquires the rendering input signal of the pixel 48 that has undergone the rendering process and the input signals of the other pixels from the rendering unit 24A, and calculates the expansion coefficient α using the same method as that of the second embodiment. The α calculating unit 82B outputs the input signals, the rendering input signals, and the information of the expansion coefficient α to the sub-pixel generation signal unit 83B.

The sub-pixel generation signal unit 83B generates generation signals of the first sub-pixel, the second sub-pixel, the third sub-pixel, and the fourth sub-pixel in all the pixels 48 in one frame based on the input signals, the rendering input signals, and the expansion coefficient α. The sub-pixel generation signal unit 83B generates generation signals of the first sub-pixel, the second sub-pixel, the third sub-pixel, and the fourth sub-pixel for the pixel 48 that has undergone the rendering process based on the rendering input signals and the expansion coefficient α. Further, the sub-pixel generation signal unit 83B generates generation signals of the first sub-pixel, the second sub-pixel, the third sub-pixel, and the fourth sub-pixel for the other pixels 48 based on the input signals and the expansion coefficient α. A process of generating the generation signal through the sub-pixel generation signal unit 83B will be described later.

The correction process deciding unit 76B acquires the generation signals of the sub-pixels in all the pixels 48 in one frame from the sub-pixel generation signal unit 83B. The correction process deciding unit 76B decides to generate the output signal of the fourth sub-pixel 49W through the correction process for the pixel 48 that has undergone the rendering process based on the generation signals of the sub-pixels. The correction process deciding unit 76B generates the correction decision information which includes the information indicating whether or not the correction process is performed. However, the correction process deciding unit 76B may not acquire the generation signals of the sub-pixels in all the pixels 48 in one frame as long as the generation signal of the pixel 48 that has undergone the rendering process and the generation signal of the pixel neighboring the pixel 48 in the X direction are acquired. A method of deciding the correction process through the correction process deciding unit 76B will be described later.

The W output signal generating unit 84B generates the fourth sub-pixel output signal of the pixel 48 that is decided to perform the correction process based on the correction decision information and the generation signal.

The output signal generating unit 88B generates and outputs the output signals of the first sub-pixel, the second sub-pixel, and the third sub-pixel for the pixel 48 that has undergone the correction process based on the fourth sub-pixel output signal and the generation signal. The output signal generating unit 88B outputs the generation signals as the output signal for the other pixels 48.

Process Operation of Signal Processing Unit

Next, a process operation of the signal processing unit 20B will be described. The rendering unit 24A and the α calculating unit 82B perform the rendering process and calculate the expansion coefficient α using the same method as that of the second embodiment.

When the rendering process is assumed to be performed on the pixel $\mathbf{48}_{(a+1,b)}$, the sub-pixel generation signal unit 83B calculates the fourth sub-pixel generation signal value $x_{A4-(a+1,b)}$ based on Equation (10) for the pixel $\mathbf{48}_{(a+1,b)}$.

Further, the sub-pixel generation signal unit 83B calculates the first sub-pixel generation signal value $X_{A1-(a+1,b)}$, the second sub-pixel generation signal value $X_{A2-(a+1,b)}$, and the third sub-pixel generation signal value $X_{A2-(a+1,b)}$ based on Equations (12) to (14) for the pixel $\mathbf{48}_{(a+1,b)}$. The sub-pixel generation signal unit 83B calculates the fourth sub-pixel generation signal value based on Equation (10) using the input signal value instead of the rendering input signal value for the pixel 48 that has not undergone the rendering process. Further, the sub-pixel generation signal unit 83B calculates the generation signal values of the first sub-pixel, the second sub-pixel, and the third sub-pixel based on Equations (12) to (14) using the input signal value instead of the rendering input signal value for the pixel 48 that has not undergone the rendering process. In other words, the sub-pixel generation signal unit 83B calculates the generation signal values of the sub-pixels for all the pixels 48 in one frame.

Figure 26:
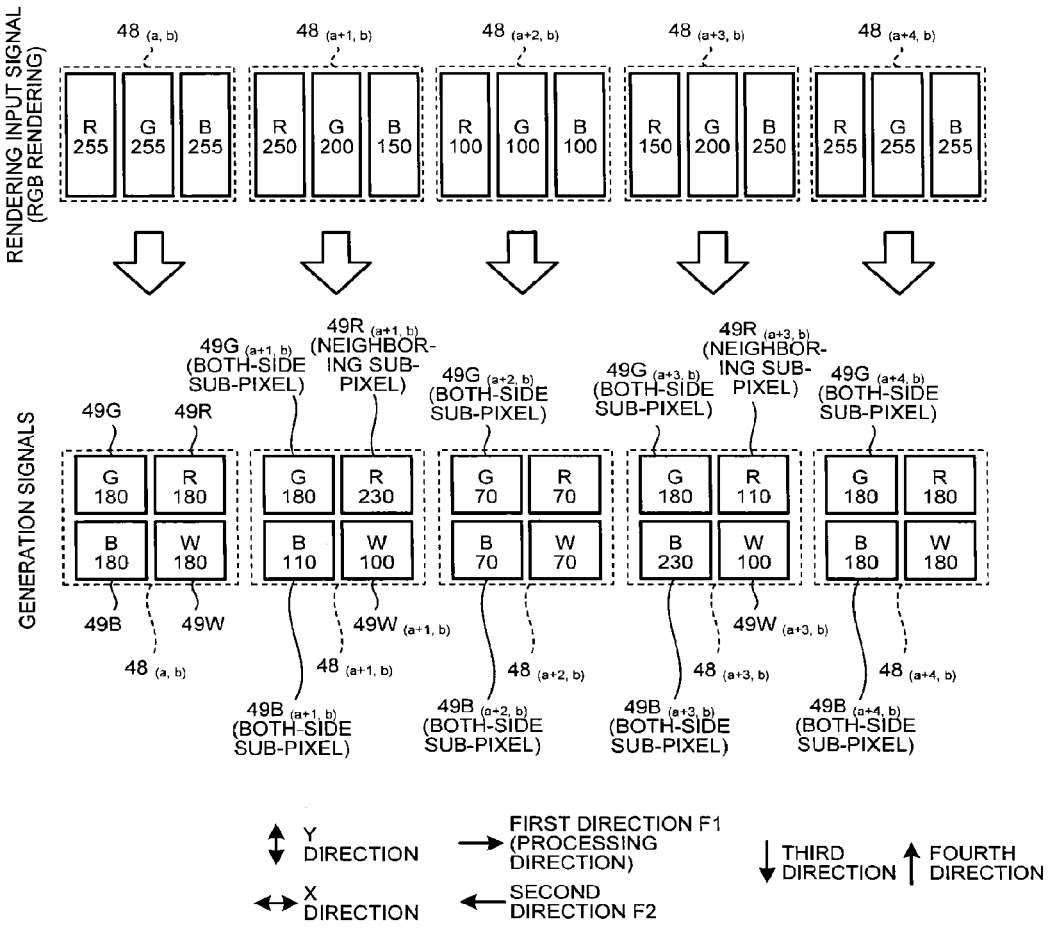
FIG. 26 is a schematic diagram illustrating an arrangement of sub-pixels and generation signal values thereof.

Next, a method of deciding the correction process through the correction process deciding unit 76B will be described. FIG. 26 is a schematic diagram illustrating an arrangement of the sub-pixels and the generation signal values. FIG. 26 illustrates the generation signal values that are generated based on the rendering input signal values and the rendering input signals by the display device 10B. As illustrated in FIG. 26, the rendering input signal values of the pixels 48 are the same as those in the second embodiment. Further, as illustrated in FIG. 26, the generation signal values of the pixels 48 according to the third embodiment are the same as, for example, the output signal values of the display device 10Y according to the first comparative example described with reference to FIG. 18.

Here, a sub-pixel is referred to as a "neighboring sub-pixel" that neighbors the fourth sub-pixel 49W of the pixel 48 that has undergone the rendering process in the orthogonal direction (here, the Y direction) orthogonal to the processing direction and belongs to the same pixel 48. Further, a plurality of sub-pixels 49 (four sub pixels 49) are referred to as "both-side sub-pixels" that neighbor the fourth sub-pixel 49W of the pixel 48 that has undergone the rendering process or the neighboring sub-pixel in the first direction F1 or the second direction F2. The correction process deciding unit 76B decides whether or not the output signal of the fourth sub-pixel 49W of the pixel 48 that has undergone the rendering process is generated through the correction process, based on the generation signal value of the neighboring sub-pixel and the generation signal values of the both-side sub-pixels. In further detail, the correction process deciding unit 76B decides that the output signal of the fourth sub-pixel 49W of the pixel 48 that has undergone the rendering process is generated through the correction process when the generation signal value of the neighboring sub-pixel is smaller than the generation signal values of the four both-side sub-pixels, and a difference between the generation signal value of the neighboring sub-pixel and the generation signal values of the four both-side sub-pixels is a predetermined value or more.

Next, a method of deciding whether or not the correction process is performed on the pixel $\mathbf{48}_{(a+1,b)}$ that has undergone the rendering process will be described. Among the sub-pixels of the pixel $\mathbf{48}_{(a+1,b)}$, a sub-pixel neighboring the fourth sub-pixel $\mathbf{49}W_{(a+1,b)}$ in the orthogonal direction (here, the Y direction) is a first sub-pixel $\mathbf{49}R_{(a+1,b)}$. Thus, in this case, the first sub-pixel $\mathbf{49}R_{(a+1,b)}$ is the neighboring sub-pixel. Further, sub-pixels neighboring the fourth sub-pixel $\mathbf{49}W_{(a+1,b)}$ or the first sub-pixel $\mathbf{49}R_{(a+1,b)}$ in the processing direction (here, the first direction F1) or an opposite direction (here, the second direction F2) opposite to the processing direction are a second sub-pixel $\mathbf{49}G_{(a+1,b)}$ a third sub-pixel $\mathbf{49}B_{(a+1,b)}$, second sub-pixel $\mathbf{49}G_{(a+2,b)}$, and a third sub-pixel $\mathbf{49}B_{(a+2,b)}$. Thus, in this case, the second sub-pixel $\mathbf{49}G_{(a+1,b)}$ the third sub-pixel $\mathbf{49}B_{(a+1,b)}$ the second sub-pixel $\mathbf{49}G_{(a+2,b)}$, and the third sub-pixel $\mathbf{49}B_{(a+2,b)}$ are the both-side sub-pixels. The correction process deciding unit 76B decides to perform the correction process on the fourth sub-pixel $\mathbf{49}W_{(a+1,b)}$ of the pixel $\mathbf{48}_{(a+1,b)}$ when the generation signal value of the first sub-pixel $\mathbf{49}R_{(a+1,b)}$ is smaller than the generation signal values of the second sub-pixel $\mathbf{49}G_{(a+1,b)}$, the third sub-pixel $\mathbf{49}B_{(a+1,b)}$, the second sub-pixel $\mathbf{49}G_{(a+2,b)}$, and the third sub-pixel $\mathbf{49}B_{(a+2,b)}$, and a difference between the generation signal values is a predetermined value or more. Here, the generation signal value of the first sub-pixel $\mathbf{49}R_{(a+1,b)}$ serving as the neighboring sub-pixel is larger than the generation signal values of the both-side sub-pixels. Thus, the correction process deciding unit 76B decides not to perform the correction process on the pixel $\mathbf{48}_{(a+1,b)}$.

Next, a method of deciding whether or not the correction process is performed on the pixel $\mathbf{48}_{(a+3,b)}$ that has undergone the rendering process will be described. Among the sub-pixels of the pixel $\mathbf{48}_{(a+3,b)}$, a sub-pixel neighboring the fourth sub-pixel $\mathbf{49}W_{(a+3,b)}$ in the orthogonal direction (here, the Y direction) is a first sub-pixel $\mathbf{49}R_{(a+3,b)}$. Thus, in this case, the first sub-pixel $\mathbf{49}R_{(a+3,b)}$ is the neighboring sub-pixel. Further, sub-pixels neighboring the fourth sub-pixel $\mathbf{49}W_{(a+3,b)}$ or the first sub-pixel $\mathbf{49}R_{(a+3,b)}$ in the processing direction (here, the first direction F1) or the opposite direction (here, the second direction F2) are a second sub-pixel $\mathbf{49}G_{(a+3,b)}$, a third sub-pixel $\mathbf{49}B_{(a+3,b)}$, a second sub-pixel $\mathbf{49}G_{(a+4,b)}$ and a third sub-pixel $\mathbf{49}B_{(a+4,b)}$ Thus, in this case, the second sub-pixel $\mathbf{49}G_{(a+3,b)}$, the third sub-pixel $\mathbf{49}B_{(a+3,b)}$, the second sub-pixel $\mathbf{49}G_{(a+4,b)}$ and the third sub-pixel $\mathbf{49}B_{(a+4,b)}$ are the both-side sub-pixels. The correction process deciding unit 76B decides to perform the correction process on the fourth sub-pixel $\mathbf{49}W_{(a+3,b)}$ of the pixel $\mathbf{48}_{(a+3,b)}$ when the generation signal value of the first sub-pixel $\mathbf{49}R_{(a+3,b)}$ is smaller than the generation signal values of the second sub-pixel $\mathbf{49}G_{(a+3,b)}$, the third sub-pixel $\mathbf{49}B_{(a+3,b)}$, the second sub-pixel $\mathbf{49}G_{(a+4,b)}$ and the third sub-pixel $\mathbf{49}B_{(a+4,b)}$, and the difference between the generation signal values is a predetermined value or more. Here, for example, the predetermined value is set to 50. In this case, the generation signal value of the first sub-pixel $\mathbf{49}R_{(a+3,b)}$ serving as the neighboring sub-pixel is smaller than the generation signal values of the both-side sub-pixels, and the difference between the values is 50 serving as the predetermined value or more. Thus, the correction process deciding unit 76B decides to perform the correction process on the pixel $\mathbf{48}_{(a+3,b)}$.

The W output signal generating unit 84B generates the fourth sub-pixel output signal of the pixel 48 that is decided to perform the correction process using the same method as that of the W output signal generating unit 84A according to the second embodiment. The W output signal generating unit 84B calculates the fourth sub-pixel output signal value of the pixel 48 that is decided to perform the correction process by performing the averaging process, that is, the correction process based on Equation (11).

For the pixel 48 that has undergone the correction process, the output signal generating unit 88B generates the output signals of the first sub-pixel, the second sub-pixel, and the third sub-pixel of the pixel 48 that has undergone the correction process using the same method as that of the output signal generating unit 88A according to the second embodiment. The output signal generating unit 88B has not performed the correction process on the other pixels 48 and thus outputs the generation signals of the sub-pixels calculated by the sub-pixel generation signal unit 83B to the image display panel driving unit 30 as the output signal.

Figure 27:
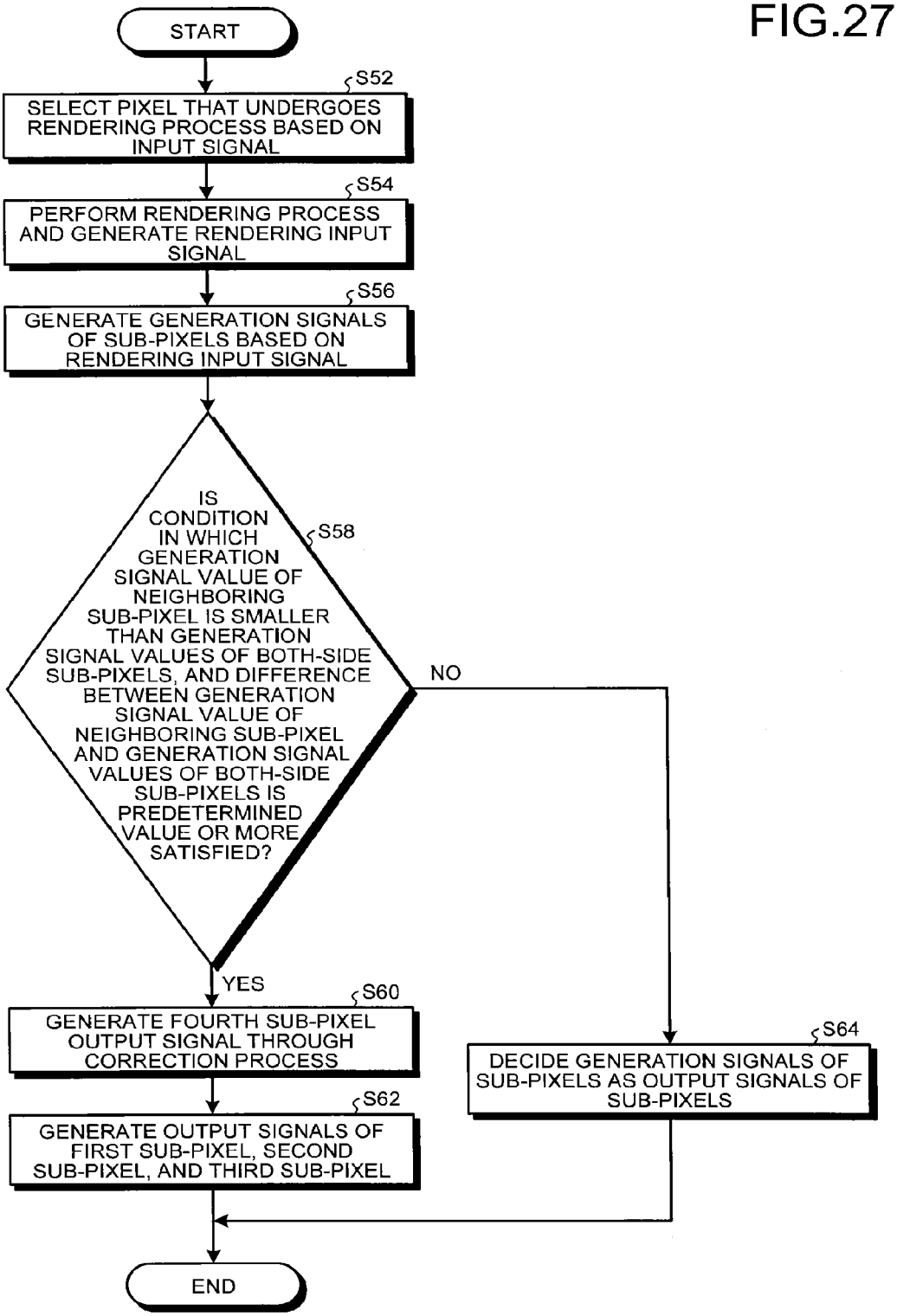
FIG. 27 is a flowchart for describing a process operation of the signal processing unit according to the third embodiment.

Next, a process of the process operation of the signal processing unit 20B will be described based on a flowchart. FIG. 27 is a flowchart for describing a process operation of the signal processing unit according to the third embodiment. As illustrated in FIG. 27, first, the rendering position deciding unit 21 of the signal processing unit 20B selects the pixel 48 that undergoes the rendering process based on the input signal (step S52). After the pixel 48 that undergoes the rendering process is selected, the rendering processing unit 74A performs the rendering process on the selected pixel 48, and generates the rendering input signal (step S54). In the third embodiment, the rendering process is the RGB rendering.

After the rendering input signal is generated in step S54, the sub-pixel generation signal unit 83B generates the generation signals of the sub-pixels 49 of the pixel 48 that has undergone the rendering process based on the rendering input signal (step S56). The sub-pixel generation signal unit 83B calculates the fourth sub-pixel generation signal value $X_{A4-(a+1,b)}$ based on Equation (11) for the pixel $\mathbf{48}_{(a+1,b)}$ that has undergone the rendering process.

The sub-pixel generation signal unit 83B calculates the first sub-pixel generation signal value $X_{A1-(a+1,b)}$, the second sub-pixel generation signal value $X_{A2-(a+1,b)}$, and the third sub-pixel generation signal value $X_{A3-(a+1,b)}$ based on Equations (12) to (14) for the pixel $\mathbf{48}_{(a+1,b)}$.

After the generation signals of the sub-pixels 49 of the pixel 48 that has undergone the rendering process are generated, the correction process deciding unit 76B determines whether or not the generation signal value of the neighboring sub-pixel is smaller than the generation signal values of the both-side sub-pixels, and the difference between the generation signal value of the neighboring sub-pixel and the generation signal values of the both-side sub-pixels is a predetermined value or more (step S58).

When the generation signal value of the neighboring sub-pixel is smaller than the generation signal values of the both-side sub-pixels, and the difference between the generation signal value of the neighboring sub-pixel and the generation signal values of the both-side sub-pixels is the predetermined value or more (Yes in step S58), the correction process deciding unit 76B decides to perform the correction process on the pixel 48 that has undergone the rendering process, and the W output signal generating unit 84B generates the fourth sub-pixel output signal through the correction process for the pixel 48 decided to perform the correction process (step S60). The W output signal generating unit 84B performs the correction process based on Equation (11), and generates the fourth sub-pixel output signal of the pixel 48 decided to perform the correction process.

After the fourth sub-pixel output signal of the pixel 48 decided to perform the correction process is generated through the correction process, the output signal generating unit 88B generates the output signals of the first sub-pixel, the second sub-pixel, and the third sub-pixel of the pixel 48 that has undergone the correction process (step S62). The output signal generating unit 88B generates the output signals of the first sub-pixel, the second sub-pixel, and the third sub-pixel of the pixel 48 that has undergone the correction process using the same method as that of the output signal generating unit 88A according to the second embodiment.

When the generation signal value of the neighboring sub-pixel is smaller than the generation signal values of the both-side sub-pixels, and the difference between the generation signal value of the neighboring sub-pixel and the generation signal values of the both-side sub-pixels is not the predetermined value or more (No in step S58), the correction process deciding unit 76B decides not to perform the correction process on the pixel 48 that has undergone the rendering process, and the output signal generating unit 88B outputs the generation signals of the sub-pixels generated in step S56 as the output signal (step S64). When the generation signal value of the neighboring sub-pixel is larger than the generation signal values of the both-side sub-pixels, the correction process deciding unit 76B decides not to perform the correction process. Further, even when the generation signal value of the neighboring sub-pixel is smaller than the generation signal values of the both-side sub-pixels, but the difference between the generation signal value of the neighboring sub-pixel and the generation signal values of the both-side sub-pixels is not the predetermined value or more, the correction process deciding unit 76B decides not to perform the correction process. After step S62 or step S64 is performed, the current process ends.

Display Example

Next, a display example of the sub-pixels when the rendering process and the correction process according to the third embodiment are performed will be described. As described above with reference to FIG. 18, the display device 10Y according to the first comparative example does not perform the correction process described in the third embodiment, and thus the line L1 of FIG. 18 is likely to be recognized as the dark line when the rendering process is performed.

Figure 28:
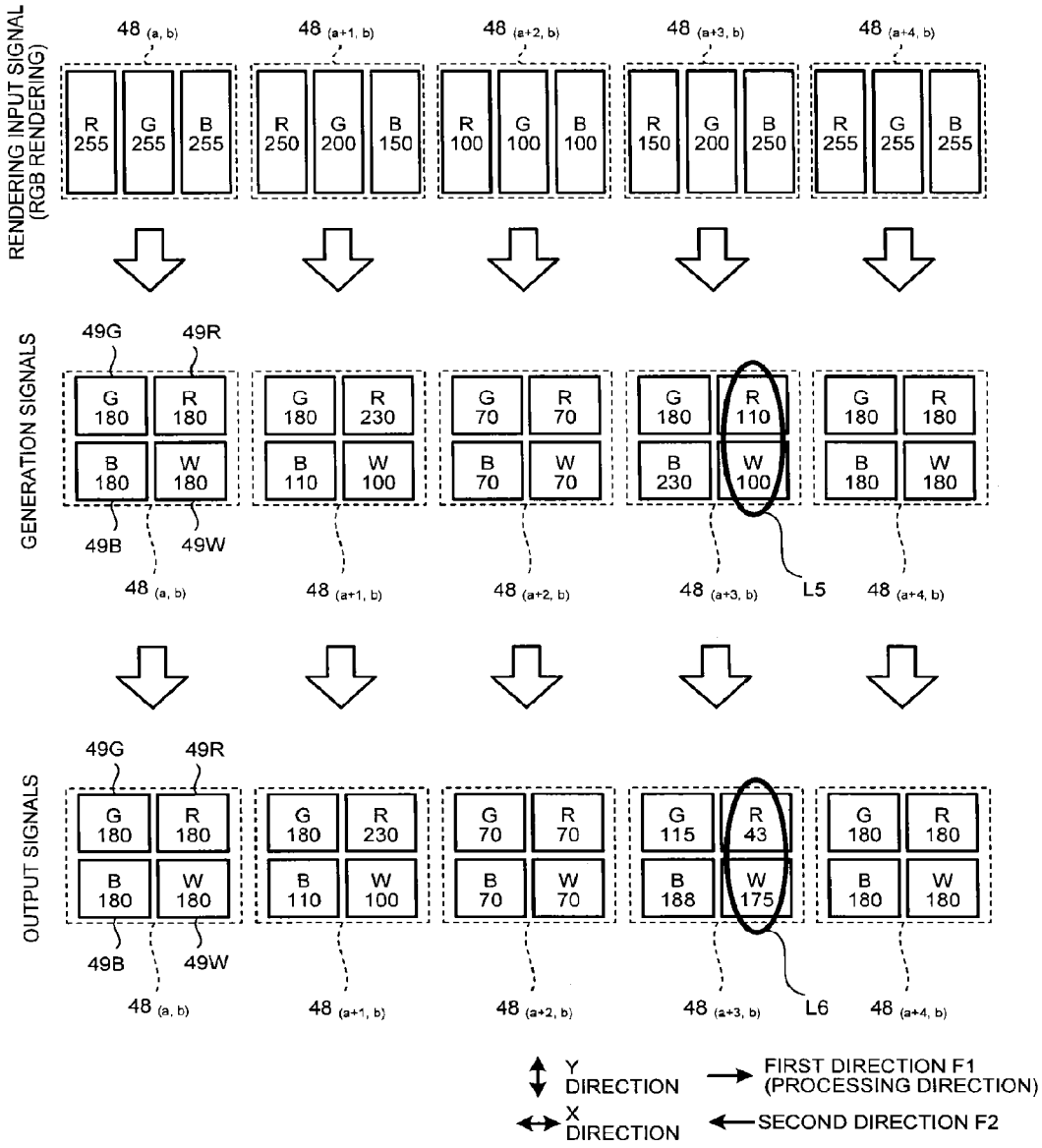
FIG. 28 is a schematic diagram illustrating output signals of sub-pixels when a rendering process and a correction process according to the third embodiment are performed.

FIG. 28 is a schematic diagram illustrating the output signals of the sub-pixels when the rendering process and the correction process according to the third embodiment are performed. FIG. 28 illustrates the generation signal values which are generated based on the input signal and the rendering input signal and the output signal values which are generated based on the generation signal values by the display device 10B. The rendering input signal values and the generation signal values of the pixels illustrated in FIG. 28 are the same as those of FIG. 26.

The generation signal values illustrated in FIG. 28 are provisional signal values calculated based on the rendering input signal value before the correction process is performed and have the same values as the output signal values according to the first comparative example. Thus, when the generation signal is output as the output signal without change, as illustrated in FIG. 28, a line L5 formed by the first sub-pixel $\mathbf{49}R_{(a+3,b)}$ and the fourth sub-pixel $\mathbf{49}W_{(a+3,b)}$ in the pixel $\mathbf{48}_{(a+3,b)}$ is likely to be recognized as the dark line, similarly to the line L1 of FIG. 18. However, the display device 10B according to the third embodiment performs the correction process on the pixel $\mathbf{48}_{(a+3,b)}$ since the generation signal value of the neighboring sub-pixel of the pixel $\mathbf{48}_{(a+3,b)}$ is smaller than the generation signal values of the both-side sub-pixels, and the difference between the generation signal value of the neighboring sub-pixel and the generation signal values of the both-side sub-pixels is the predetermined value or more as described above.

As illustrated in FIG. 28, in the pixel $\mathbf{48}_{(a+3,b)}$, that is, the pixel $\mathbf{48}_{(a+3,b)}$ that has undergone the correction process, the output signal value $X_{1-(a+3,b)}$ of the first sub-pixel is 43, the output signal value $X_{2-(a+3,b)}$ of the second sub-pixel is 115, the output signal value $X_{3-(a+3,b)}$ of the third sub-pixel is 188, and the output signal value $X_{4-(a+3,b)}$ of the fourth sub-pixel is 175. In the pixel 48$_{(a+3,b)}$, the output signal value $X_{4-(a+3,b)}$ of the fourth sub-pixel is increased to be larger than the generation signal value through correction process. The display device 10B according to the third embodiment can increase the luminance of a line L6 along the Y direction in which the sub-pixel 49R and the sub-pixel 49W of the pixel 48$_{(a+3,b)}$ are arranged by increasing the output value of the sub-pixel 49W of the pixel 48$_{(a+3,b)}$ that is large in the difference of the output signal value with the both-side sub-pixels. Thus, the display device 10B can suppress, for example, the black line from being recognized and suppress the deterioration of the image. In addition, the display device 10B does not perform the correction process on the pixel 48$_{(a+1,b)}$ in which the difference of the output signal value with the both-side sub-pixels is small, and the black line is unlikely to be recognized. Thus, the display device 10B can suppress the deterioration of the image such as recognition of the black line and can smoothly display the image by appropriately performing the rendering process.

As described above, the display device 10B according to the third embodiment includes the image display panel 40 in which a plurality of pixels 48 each of which includes the first sub-pixel 49R, the second sub-pixel 49G, the third sub-pixel 49B, and the fourth sub-pixel 49W arranged in a 2×2 matrix form are arranged on the display region 43 of the square shape having the first side (the short side 41) and the second side (the long side 42) in the matrix form. The image display panel 40 receives the image information corresponding to the portrait mode in which the direction along the first side is a predetermined one direction (here, the X direction) of the display image or the landscape mode in which the direction along the second side is a predetermined one direction (here, the X direction) of the display image. The signal processing unit 20B according to the third embodiment further includes the rendering unit 24A that performs the rendering process on the pixel 48$_{(a+1,b)}$ when the difference between the input signal values of the sub-pixel 49$_{(a,b)}$ of the pixel 48$_{(a,b)}$ and the input signal values of the sub-pixels 49$_{(a+2,b)}$ of the pixel 48$_{(a+2,b)}$ is a predetermined threshold value or more. The signal processing unit 20B further includes the sub-pixel generation signal unit 83B that generates the generation signals of the first sub-pixel 49R, the second sub-pixel 49G, the third sub-pixel 49B, and the fourth sub-pixel 49W based on the input signal values and the rendering input signal values of the sub-pixels 49 in each pixel 48. The signal processing unit 20B further includes the correction process deciding unit 76B that decides whether or not the output signal of the fourth sub-pixel 49W$_{(a+1,b)}$ is generated through the correction process based on the generation signal value of the neighboring sub-pixel and the generation signal values of the both-side sub-pixels. The neighboring sub-pixel is served as the sub-pixel of the pixel 48$_{(a+1,b)}$ neighboring the fourth sub-pixel 49W$_{(a+1,b)}$ of the pixel 48$_{(a+1,b)}$ in the orthogonal direction (here, the Y direction). The both-side sub-pixels are served as a plurality of sub-pixels 49 neighboring the fourth sub-pixel 49W$_{(a+1,b)}$ or the neighboring sub-pixel in the processing direction (here, the first direction F1) or the opposite direction (here, the second direction F2). The signal processing unit 20B performs the correction process based on the decision of the correction process deciding unit 76B, by performing the correction process by performing the averaging process, based on the generation signal of the fourth sub-pixel 49W$_{(a+1,b)}$ and the input signals of the other sub-pixels, and generates the output signal of the fourth sub-pixel 49W$_{(a+1,b)}$.

The display device 10B decides whether or not the correction process is performed on the pixel 48 that has undergone the rendering process based on the output signal value of the neighboring sub-pixel in the same column as the sub-pixel 49W and the output signal values of the both-side sub-pixels adjacent to both sides thereof. Thus, the display device 10B can suppress, for example, the recognition of the black line and suppress the deterioration of the image when the dark line is likely to be recognized by, for example, the output signal difference between the neighboring sub-pixel and the both-side sub-pixels caused by the rendering process.

The correction process deciding unit 76B decides to generate the output signal of the fourth sub-pixel 49W of the pixel 48 that has undergone the rendering process through the correction process when the generation signal value of the neighboring sub-pixel is smaller than the generation signal values of the four both-side sub-pixels, and the difference between the generation signal value of the neighboring sub-pixel and the generation signal values of the four both-side sub-pixels is a predetermined value or more. For the pixel 48 that has undergone the rendering process, the display device 10B increases luminance of a column in which the sub-pixel 49W is positioned by increasing the output value of the sub-pixel 49W when the difference between the output signal value of the sub-pixel in the same column as the sub-pixel 49W and the output signal value of the sub-pixel adjacent to both sides thereof is large. Thus, the display device 10B can suppress, for example, the recognition of the dark line and suppress the deterioration of the image.

The W output signal generating unit 84B performs the same averaging process as that of the W output signal generating unit 84A according to the second embodiment as described above. Thus, the W output signal generating unit 84B may generate the output signal of the fourth sub-pixel 49$_{(a+1,b)}$ of the pixel 48$_{(a+1,b)}$ based on the generation signal of the fourth sub-pixel 49$_{(a+1,b)}$ of the pixel 48$_{(a+1,b)}$ and the output signal or the generation signal of the fourth sub-pixel of the pixel neighboring the pixel 48$_{(a+1,b)}$ using the same method as that of the W output signal generating unit 84A according to the second embodiment.

Modification

Next, a modification of the first embodiment will be described. A display device 10D according to the modification differs from that of the first embodiment in that one pixel includes three sub-pixels. In the display device 10D according to the modification, a description of portions common to those of the first embodiment will be omitted.

Figure 29:
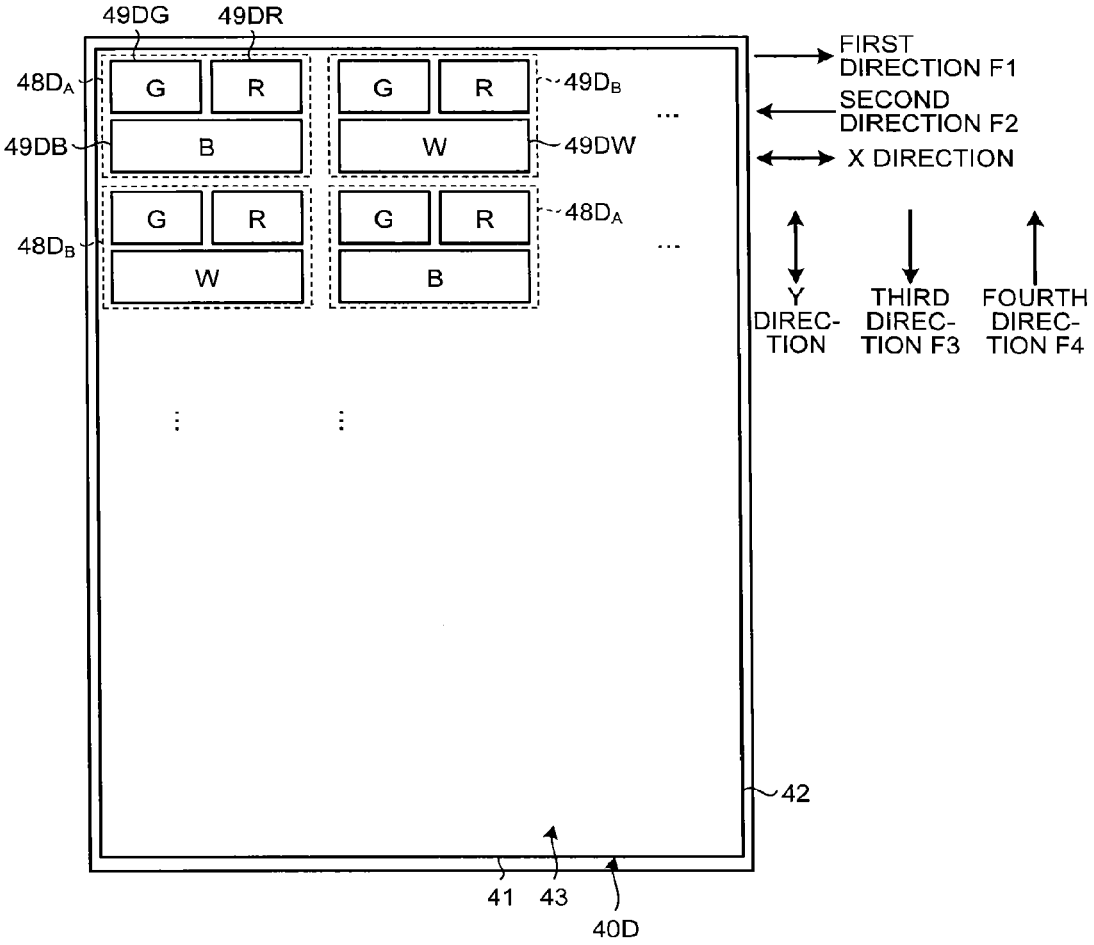
FIG. 29 is a schematic diagram illustrating an example of a sub-pixel arrangement in a portrait mode according to a modification.
Figure 30:
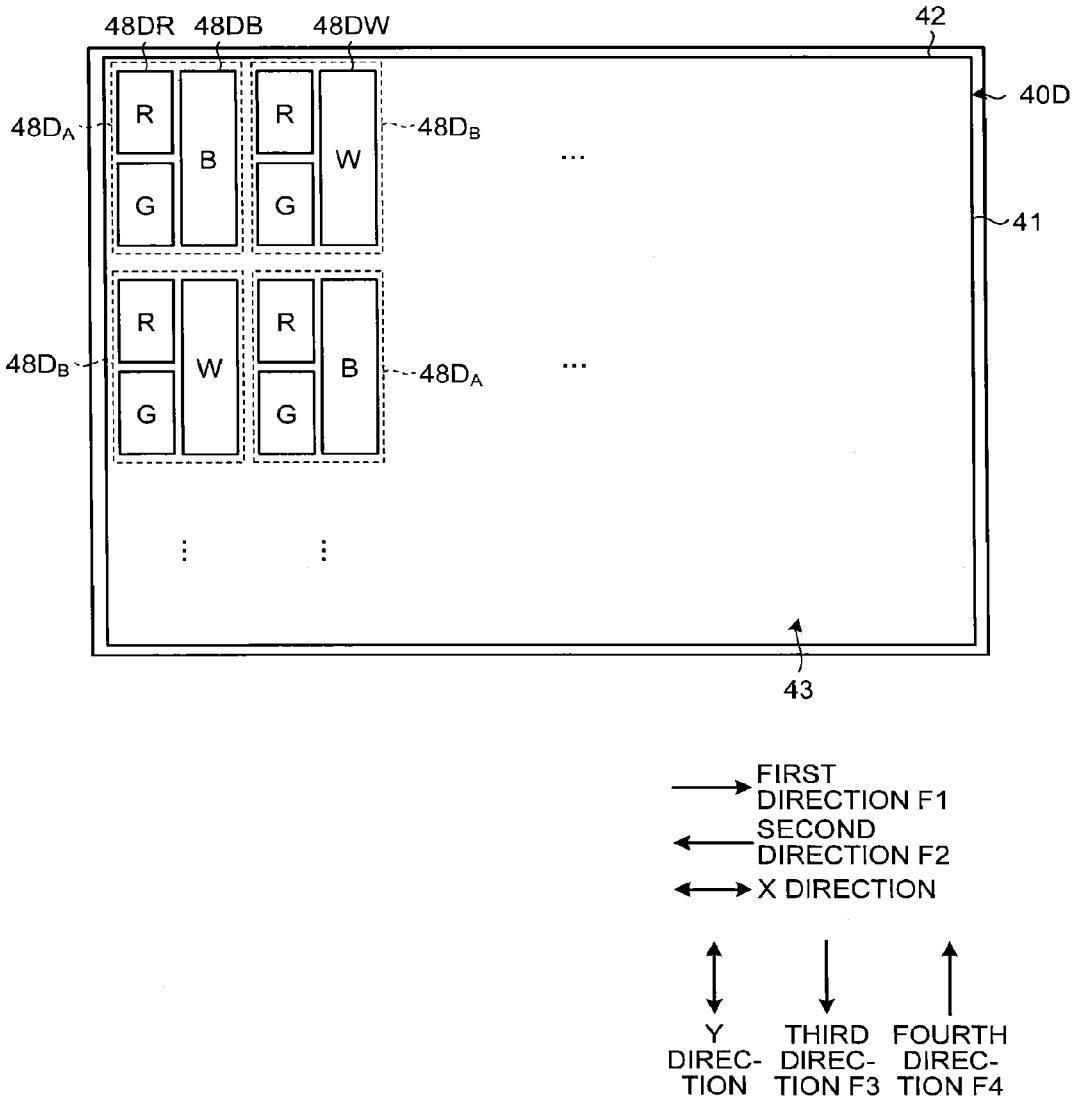
FIG. 30 is a schematic diagram illustrating an example of a sub-pixel arrangement in a landscape mode according to a modification.

FIG. 29 is a schematic diagram illustrating an example of an arrangement of the sub-pixels in the portrait mode according to the modification. FIG. 30 is a schematic diagram illustrating an example of an arrangement of the sub-pixels in the landscape mode according to the modification. FIG. 29 illustrates the first portrait mode in which the short side 41 is positioned at the side of the image in the third direction F3. FIG. 30 illustrates the first landscape mode in which the short side 41 is positioned at the side of the image in the first direction F1.

As illustrated in FIGS. 29 and 30, in an image display panel 40D, a pixel 48D$_A$ serving as a first thinned pixel including a first sub-pixel 49DR, a second sub-pixel 49DG, and a third sub-pixel 49DB and a pixel 48D$_B$ serving as a second thinned pixel including a first sub-pixel 49DR, a second sub-pixel 49DG, and a fourth sub-pixel 49DW are alternately arranged in the X direction and the Y direction. However, an arrangement of the pixel 48$D_A$ and the pixel 48$D_B$ is not limited thereto. For example, the pixel 48$D_A$ and the pixel 48$D_B$ are alternately arranged in the X direction, but the pixel 48$D_A$ may be consecutively arranged in the Y direction, and the pixel 48$D_B$ may be consecutively arranged in the Y direction. Alternatively, the pixel 48$D_A$ and the pixel 48$D_B$ are alternately arranged in the Y direction, but the pixel 48$D_A$ may be consecutively arranged in the X direction, and the pixel 48$D_B$ may be consecutively arranged in the X direction. In both of the arrangements of the pixel 48$D_A$ and the pixel 48$D_B$, in the two pixels in the X direction and the two pixels in the Y direction, the number of third sub-pixels 49DB is equal to the number of fourth sub-pixels 49DW, and a color balance is kept even though the third color is replaced with the fourth color. In any other pixel arrangement, a color balance is kept even though the third color is replaced with the fourth color as long as the arrangement of the pixel 48$D_A$ and the pixel 48$D_B$ is an arrangement in which in the four pixels in the X direction and the four pixels in the Y direction, the number of third sub-pixels 49DB is equal to the number of fourth sub-pixels 49DW.

As illustrated in FIG. 29, in the pixel 48$D_A$, in the first portrait mode, the second sub-pixel 49DG and the first sub-pixel 49DR are arranged in the first row along the X direction, the first sub-pixel 49DR neighbors the second sub-pixel 49DG at the side of the second sub-pixel 49DG in the first direction F1. Further, in the pixel 48$D_A$, in the first portrait mode, the third sub-pixel 49DB is arranged in the second row adjacent to the first row in the third direction F3, the third sub-pixel 49DB neighbors the first sub-pixel 49DR and the second sub-pixel 49DG in the third direction F3. Furthermore, in the pixel 48$D_B$, in the first portrait mode, the second sub-pixel 49DG and the first sub-pixel 49DR are arranged in the first row along the X direction, the first sub-pixel 49DR neighbors the second sub-pixel 49DG at the side of the second sub-pixel 49DG in the first direction F1. Moreover, in the pixel 48$D_B$, in the first portrait mode, the fourth sub-pixel 49DW is arranged in the second row adjacent to the first row in the third direction F3, the fourth sub-pixel 49DW neighbors the first sub-pixel 49DR and the second sub-pixel 49DG in the third direction F3.

As illustrated in FIG. 30, in the pixel 48$D_A$, in the first landscape mode, the first sub-pixel 49DR and the second sub-pixel 49DG are arranged in the first column along the Y direction, the second sub-pixel 49DG neighbors the first sub-pixel 49DR at the side of the first sub-pixel 49DR in the third direction F3. Further, in the pixel 48$D_A$, in the first landscape mode, the third sub-pixel 49DB neighboring the side of the second sub-pixel 49DG in the first direction F1 is arranged in the second column adjacent to the first column in the first direction F1, the third sub-pixel 49DB neighbors the first sub-pixel 49DR and the second sub-pixel 49DG in the first direction F1. a In the pixel 48$D_B$, in the first landscape mode, the first sub-pixel 49DR and the second sub-pixel 49DG are arranged in the first column along the Y direction, the second sub-pixel 49DG neighbors the first sub-pixel 49DR at the side of the first sub-pixel 49DR in the third direction F3. Furthermore, in the pixel 48$D_B$, in the first landscape mode, the fourth sub-pixel 49DW is arranged in the second column adjacent to the first column in the first direction F1, the fourth sub-pixel 49DW neighbors the first sub-pixel 49DR and the second sub-pixel 49DG in the first direction F1.

As described above, the sub-pixel arrangement in the X direction and the Y direction according to the modification changes according to the display mode. In the pixel 48$D_A$ and the pixel 48$D_B$ according to the modification, sub-pixels 49D are arranged as follows regardless of the display mode. In other words, in the pixel 48$D_A$ serving as the first pixel, the first sub-pixel 49DR and the second sub-pixel 49DG are arranged in a first arrangement along a predetermined direction to be adjacent to each other in the predetermined direction. The third sub-pixel 49DB neighbors the first sub-pixel 49DR and the second sub-pixel 49DG in an intersection direction serving as a direction intersecting with the predetermined direction is arranged in a second arrangement neighboring the first arrangement in the intersection direction. Further, in the pixel 48$D_B$ serving as the second pixel, the first sub-pixel 49DR and the second sub-pixel 49DG are arranged in a first arrangement along a predetermined direction to be adjacent to each other in the predetermined direction. The fourth sub-pixel 49DW neighbors the first sub-pixel 49DR and the second sub-pixel 49DG in the intersection direction is arranged in a second arrangement neighboring the first arrangement in the intersection direction.

In the modification, the arrangement of the sub-pixels 49 in the first arrangement pattern is an arrangement in which the second sub-pixel 49DG or the third sub-pixel 49DB belonging to the same pixel 48 neighbors the side of the first sub-pixel 49DR in the processing direction (here, the first direction F1) or an arrangement in which the third sub-pixel 49DB belonging to the same pixel 48 neighbors the side of the second sub-pixel 49DG in the processing direction (here, the first direction F1). Further, in the modification, the arrangement of the sub-pixels 49 in the second arrangement pattern is an arrangement in which the first sub-pixel 49DR belonging to the same pixel 48 neighbors the side of the second sub-pixel 49DG in the processing direction (here, the first direction F1) or an arrangement in which the second sub-pixel 49DG or the first sub-pixel 49DR belonging to the same pixel 48 neighbors the side of the third sub-pixel 49DB in the processing direction (here, the first direction F1). Thus, in the modification, the first landscape mode and the second portrait mode have the first arrangement pattern, and the first portrait mode and the second landscape mode have the second arrangement pattern. The relation between the first and second arrangement patterns and the display mode differs according to a design of the sub-pixel arrangement and is not limited to the relation of the modification.

A process of the signal processing unit 20 according to the modification is the same as that of the signal processing unit 20 according to the first embodiment. However, in the signal processing unit 20 according to the modification, the output signal generating unit 88 may generate a corrected output signal of the fourth sub-pixel 49DW of the pixel 48$D_A$ by performing the averaging process using the output signal of the fourth sub-pixel 49DW of the pixel 48$D_A$ and the output signal of the fourth sub-pixel 49DW of the pixel 48$D_B$ neighboring the pixel 48$D_A$ in the orthogonal direction (here, the Y direction) orthogonal to the processing direction. In this case, the output signal generating unit 88 outputs the corrected output signal to the image display panel driving unit 30 as the output signal of the fourth sub-pixel 49DW of the pixel 48$D_A$. Further, the output signal generating unit 88 may generate a corrected output signal of the third sub-pixel 49DB of the pixel 48$D_B$ by performing the averaging process using the output signal of the third sub-pixel 49DB of the pixel 48$D_B$ and the output signal of the third sub-pixel 49DB of the pixel 48$D_A$ neighboring the pixel 48$D_B$ in the orthogonal direction (here, the Y direction) orthogonal to the processing direction. In this case, the output signal generating unit 88 outputs the corrected output signal to the image display panel driving unit 30 as the output signal of the third sub-pixel 49DB of the pixel 48$D_B$.

Figure 31:
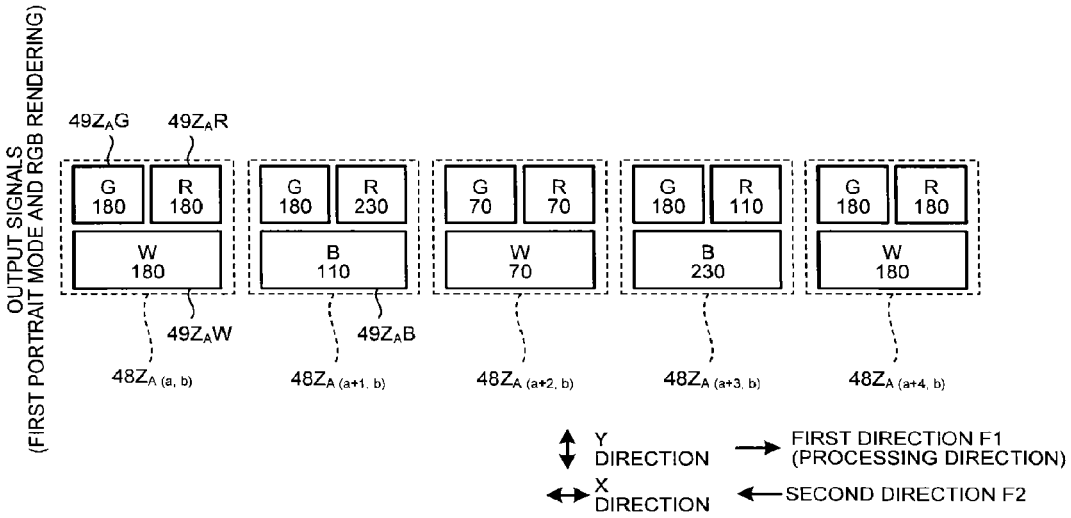
FIG. 31 is a schematic diagram illustrating output signals of sub-pixels when a rendering process according to a second comparative example is performed.

Next, a display example of the sub-pixels when the rendering process is performed in the display device 10D according to the modification will be described. FIG. 31 is a schematic diagram illustrating the output signals of the sub-pixels when a rendering process according to a second comparative example is performed. A display device 10$Z_A$ according to the second comparative example has the same sub-pixel arrangement as the display device 10D according to the modification and can perform switching of the display mode (the landscape mode and the portrait mode). As illustrated in FIG. 31, an image display panel 40$Z_A$ according to the second comparative example includes a pixel 48$Z_{A(a,b)}$, a pixel 48$Z_{A(a+1,b)}$, a pixel 48$Z_{A(a+2,b)}$, a pixel 48$Z_{A(a+3,b)}$, and a pixel 48$Z_{A(a+4,b)}$ which are arranged in the first direction F1. FIG. 31 illustrates the sub-pixel arrangement in the first portrait mode.

The display device 10$Z_A$ according to the second comparative example performs the RGB rendering in all the display modes. In the example of FIG. 31, the display device 10$Z_A$ according to the second comparative example performs the RGB rendering in the first portrait mode, and generates the same rendering input signals as those of FIG. 13. As illustrated in FIG. 31, output signal values of a first sub-pixel 49$Z_A$R, a second sub-pixel 49$Z_A$G, and a fourth sub-pixel 49$Z_A$W of the pixel 48$Z_{A(a,b)}$ according to the second comparative example are 180. In the pixel 48$Z_{A(a+1,b)}$, an output signal value of the first sub-pixel 49$Z_A$R is 230, an output signal value of the second sub-pixel 49$Z_A$G is 180, and an output signal value of a third sub-pixel 49$Z_A$B is 110. Output signals of output signal values of the first sub-pixel 49$Z_A$R, the second sub-pixel 49$Z_A$G, and the fourth sub-pixel 49$Z_A$W of the pixel 48$Z_{A(a+2,b)}$ are 70. Further, in the pixel 48$Z_{A+3,b)}$, an output signal value of the first sub-pixel 49$Z_A$R is 110, an output signal value of the second sub-pixel 49$Z_A$G is 180, and an output signal value of the third sub-pixel 49$Z_A$B is 230. In the pixel 48$Z_{A(a+4,b)}$, output signal values of the first sub-pixel 49$Z_A$R, the second sub-pixel 49$Z_A$G, and the fourth sub-pixel 49$Z_A$W are 180.

Figure 32:
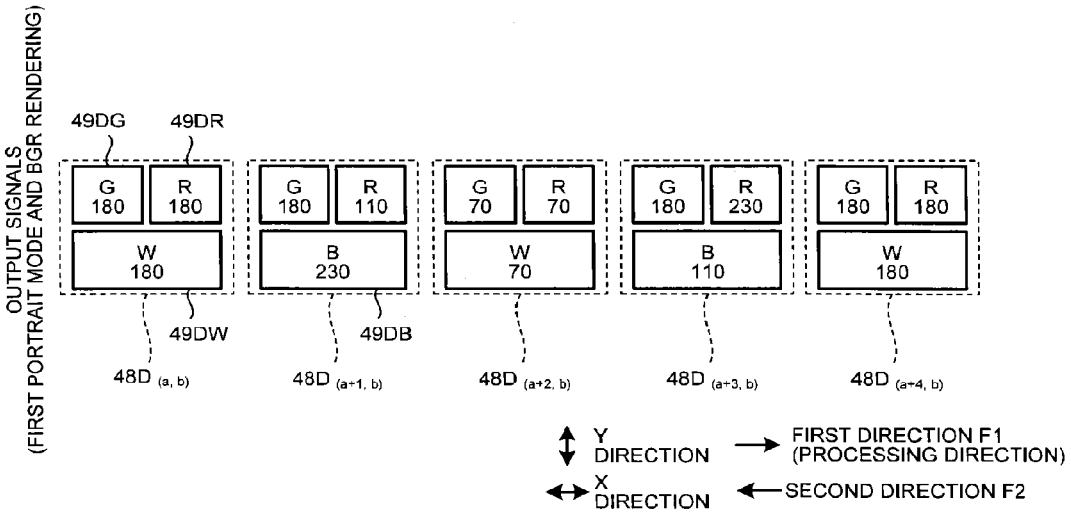
FIG. 32 is a schematic diagram illustrating output signals of sub-pixels when a rendering process according to a modification is performed.

FIG. 32 is a schematic diagram illustrating the output signals of the sub-pixels when a rendering process according to a modification is performed. FIG. 32 illustrates an example in which, in the same first portrait mode as in FIG. 31, the rendering process according to the modification is performed, and the output signals are displayed. As described above, in the first portrait mode, the signal processing unit 20 according to the modification performs the BGR rendering. As illustrated in FIG. 32, output signals of sub-pixels of a pixel 48$D_{(a,b)}$, a pixel 48$D_{(a+2,b)}$, and a pixel 48$D_{(a+4,b)}$ have the same values as those of the second comparative example illustrated in FIG. 31. In the pixel 48$D_{(a+1,b)}$, an output signal value of the first sub-pixel 49DR is 110, an output signal value of the second sub-pixel 49DG is 180, and an output signal value of the third sub-pixel 49DB is 230. Further, in the pixel 48$D_{(a+3,b)}$, an output signal value of the first sub-pixel 49DR is 230, an output signal value of the second sub-pixel 49DG is 180, and an output signal value of the third sub-pixel 49DB is 110.

In the pixel 48$Z_{A(a+3,b)}$ according to the second comparative example, the output signal value of the third sub-pixel 49$Z_A$B is larger than the output signal values of the fourth sub-pixel 49$Z_A$W of the pixel 48$Z_{A(a+2,b)}$ adjacent thereto in the second direction F2 and the fourth sub-pixel 49$Z_A$W of the pixel 48$Z_{A(a+4,b)}$ adjacent thereto in the first direction F1. On the other hand, the output signal value of the third sub-pixel 49DB of the pixel 48$D_{(a+3,b)}$ according to the modification is larger than the fourth sub-pixel 49DW of the pixel 48$D_{(a+2,b)}$ adjacent thereto in the second direction F2 and smaller than the output signal value of the fourth sub-pixel 49DW of the pixel 48$D_{(a+4,b)}$ adjacent thereto in the first direction F1. Thus, the display device 10D according to the modification can change the output signals of the sub-pixels in the first direction F1 more appropriately than the display device 10$Z_A$ according to the second comparative example and thus can smoothly display an image and improve visibility. Generally, the first sub-pixel 49DR of the first color is higher in recognized luminance than the third sub-pixel 49DB of the third color even when the output signal value of the first sub-pixel 49DR of the first color is increased by the same value as the third sub-pixel 49DB of the third color. In the display device 10D according to the modification, since the output signal of the first sub-pixel 49DR is larger than that of the third sub-pixel 49DB in the pixel 48$D_{(a+3,b)}$, the luminance of the pixel 48$D_{(a+3,b)}$ is increased, and a display can be more smoothly performed.

Figure 33:
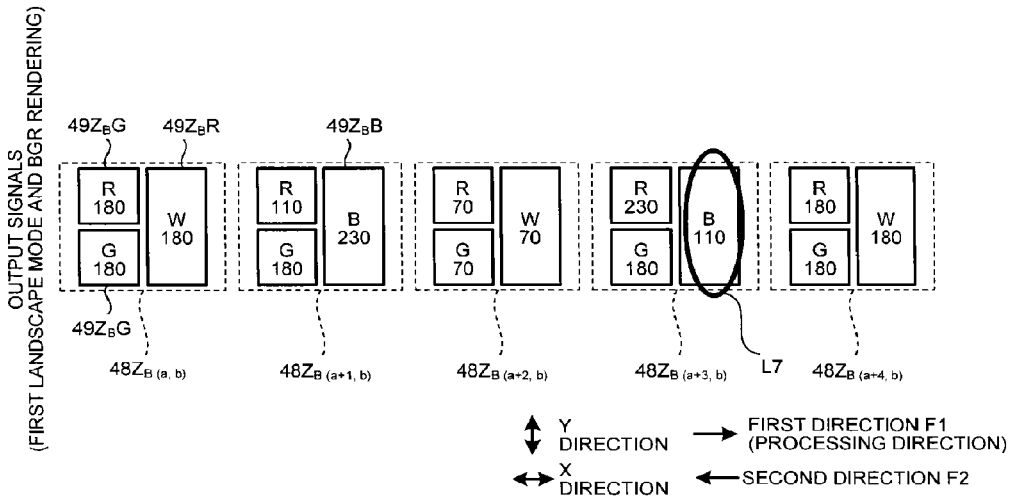
FIG. 33 is a schematic diagram illustrating output signals of sub-pixels when a rendering process according to a third comparative example is performed.

Next, a display example in the first landscape mode will be described. FIG. 33 is a schematic diagram illustrating the output signals of the sub-pixels when a rendering process according to a third comparative example is performed. FIG. 33 illustrates the output signals in the first landscape mode in a display device 10$Z_B$ according to the third comparative example.

The display device 10$Z_B$ according to the third comparative example performs the BGR rendering in all the display modes. In the example of FIG. 33, the display device 10$Z_B$ according to the third comparative example performs the BGR rendering in the first landscape mode, and generates the same rendering input signals as those of FIG. 14. As illustrated in FIG. 33, output signals of sub-pixels of a pixel 48$Z_{B\ (a,b)}$, a pixel 48$Z_{B(a+2,b)}$, and a pixel 48$Z_{B(a+4,b)}$ have the same values as those of the second comparative example illustrated in FIG. 31. In the pixel 48$Z_{B(a+1,b)}$, an output signal value of the first sub-pixel 49$Z_B$R is 110, an output signal value of the second sub-pixel 49$Z_B$G is 180, and an output signal value of a third sub-pixel 49$Z_B$B is 230. Further, in the pixel 48$Z_{B(a+3,b)}$, an output signal value of the first sub-pixel 49$Z_B$R is 230, an output signal value of the second sub-pixel 49$Z_B$G is 180, and an output signal value of the third sub-pixel 49$Z_B$B is 110. The third sub-pixel 49$Z_B$B of the pixel 48$Z_{B(a+3,b)}$ is smaller in the output signal value than the sub-pixels adjacent to both sides in the X direction. For this reason, in the image display panel 40$Z_B$ according to the third comparative example, a line L7 in which the third sub-pixel 49$Z_B$B of the pixel 48$Z_{B(a+3,b)}$ is arranged is darker than a portion therearound, recognized as a bark portion by the observer, and thus the deterioration of the image is likely to be recognized.

Figure 34:
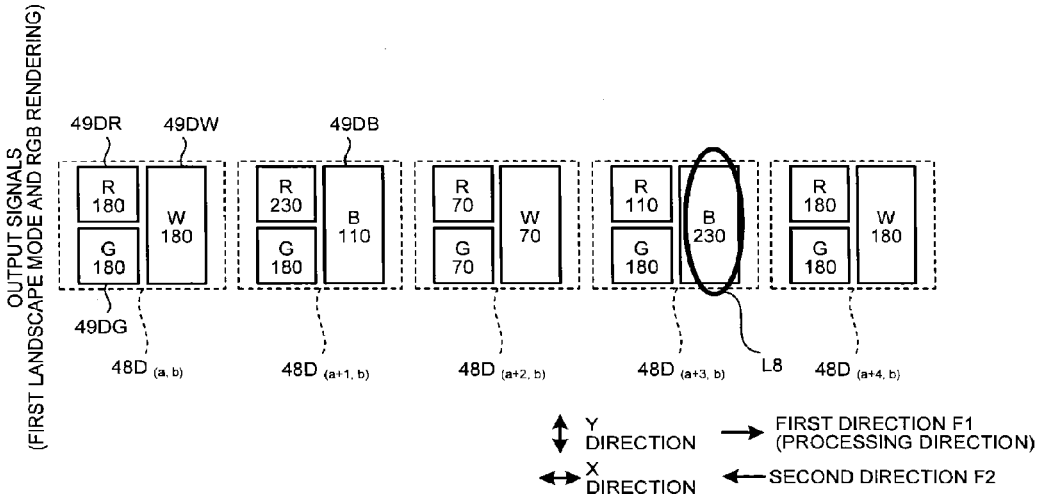
FIG. 34 is a schematic diagram illustrating output signals of sub-pixels when a rendering process according to a modification is performed.

FIG. 34 is a schematic diagram illustrating the output signals of the sub-pixels when a rendering process according to a modification is performed. FIG. 34 illustrates an example in which, in the same first landscape mode as in FIG. 33, the rendering process according to the modification is performed, and the output signals are displayed. As described above, in the first landscape mode, the signal processing unit 20 according to the modification performs the RGB rendering. As illustrated in FIG. 34, output signals of sub-pixels of a pixel 48$D_{(a,b)}$, a pixel 48$D_{(a+2,b)}$ and a pixel 48$D_{(a+4,b)}$ have the same values as those of the second comparative example illustrated in FIG. 31. On the other hand, in the pixel 48$D_{(a+1,b)}$, an output signal value of the first sub-pixel 49DR is 230, an output signal value of the second sub-pixel 49DG is 180, and an output signal value of the third sub-pixel 49DB is 110. Further, in the pixel 48$D_{(a+3,b)}$, an output signal value of the first sub-pixel 49DR is 110, an output signal value of the second sub-pixel 49DG is 180, and an output signal value of the third sub-pixel 49DB is 230. The third sub-pixel 49DB of the pixel 48$D_{(a+3,b)}$ is suppressed from being smaller in the output signal value than the sub-pixels adjacent to both sides in the X direction. For this reason, in the image display panel 40D according to the modification, since a line L8 in which the third sub-pixel 49DB of the pixel 48$D_{(a+3,b)}$ is arranged is suppressed from being darker than a portion therearound, and thus the deterioration of the image is suppressed.

As described above, the display device 10D according to the modification includes the image display panel in which a plurality of first thinned pixels each of which includes the first sub-pixel, the second sub-pixel, and the third sub-pixel and a plurality of second thinned pixels each of which includes the first sub-pixel, the second sub-pixel, and the fourth sub-pixel are arranged in the display region of the square shape having the first side and the second side intersecting with the first side in the matrix form. In the first thinned pixel, the first sub-pixel and the second sub-pixel are arranged in the first arrangement along a predetermined direction to be adjacent to each other in the predetermined direction, and the third sub-pixel neighboring the first sub-pixel and the second sub-pixel in the intersection direction is arranged in the second arrangement neighboring the first arrangement in the intersection direction serving as the direction intersecting the predetermined direction. In the second thinned pixel, the first sub-pixel and the second sub-pixel are arranged in the first arrangement along the predetermined direction to be adjacent to each other in the predetermined direction, and the fourth sub-pixel neighboring the first sub-pixel and the second sub-pixel in the intersection direction is arranged in the second arrangement neighboring the first arrangement in the intersection direction. The image display panel receives the image information of the portrait mode in which a direction along the first side is a predetermined one direction of the display image or the landscape mode in which a direction along the second side is the one direction of the display image. The display device 10D further includes the signal processing unit that generates the output signals from the input values of the input signals for the first sub-pixel, the second sub-pixel, and the third sub-pixel, and outputs the generated output signals to the image display panel. The signal processing unit includes the rendering position deciding unit that decides whether or not the sub-pixel rendering process of changing the input signal values of the sub-pixels is performed when, in the first pixel, the second pixel neighboring the first pixel at the side in the predetermined processing direction, and the third pixel neighboring the second pixel at the side in the processing direction among the first thinned pixel and the second thinned pixel, the difference between the input signal values of the sub-pixels of the first pixel and the input signal values of the sub-pixels of the third pixel is a predetermined threshold value or more. The signal processing unit further includes the pattern information acquiring unit that acquires an arrangement of the sub-pixels in the processing direction of a display mode indicating either of the portrait mode and the landscape mode as pattern information indicating any one of a first arrangement pattern and a second arrangement pattern that differ in the arrangement of the sub-pixels. The signal processing unit further includes the rendering unit that generates rendering input signals of the sub-pixels of the second pixel by performing either of a first sub-pixel rendering process and a second sub-pixel rendering process of the sub-pixel rendering process which differ in a change in signal values of the input signals of the sub-pixels on input signals of the sub-pixels of the second pixel based on the decision of the rendering position deciding unit and the pattern information. Here, the processing direction is a direction along the first side of the image display panel when the display mode is the portrait mode and a direction along the second side of the image display panel when the display mode is the landscape mode.

Further, in the display device 10D, preferably, the first sub-pixel rendering process is a process of causing an input signal value of the first sub-pixel in the second pixel to be a signal value between a first pixel input signal value and a third pixel input signal value, causing an input signal value of the second sub-pixel in the second pixel to be a value between the input signal value of the first sub-pixel in the second pixel and the third pixel input signal value, and causing an input signal value of the third sub-pixel in the second pixel to be a value between the input signal value of the second sub-pixel in the second pixel and the third pixel input signal value, and the second sub-pixel rendering process is a process of causing the input signal value of the first sub-pixel in the second pixel to be a signal value between the first pixel input signal value and the third pixel input signal value, causing the input signal value of the second sub-pixel in the second pixel to be a value between the input signal value of the first sub-pixel in the second pixel and the first pixel input signal value, and causing the input signal value of the third sub-pixel in the second pixel to be a value between the input signal value of the second sub-pixel in the second pixel and the first pixel input signal value.

Further, in the display device 10D, preferably, when the pattern information indicates the first arrangement pattern, the second sub-pixel of the second pixel neighbors a side of the first sub-pixel of the second pixel in the processing direction, or the third sub-pixel of the second pixel neighbors a side of the second sub-pixel of the second pixel in the processing direction, when the pattern information indicates the second arrangement pattern, the first sub-pixel of the second pixel neighbors a side of the second sub-pixel of the second pixel in the processing direction, or the second sub-pixel of the second pixel neighbors a side of the third sub-pixel of the second pixel in the processing direction, and the rendering unit decides to perform the first sub-pixel rendering process when the pattern information indicates the first arrangement pattern, and decides to perform the second sub-pixel rendering process when the pattern information indicates the second arrangement pattern.

Further, in the display device 10D, preferably, when the first pixel input signal value is larger than the third pixel input signal value, the first sub-pixel rendering process is a process of causing the input signal value of the first sub-pixel to be largest and causing the input signal value of the third sub-pixel to be smallest among the input signal values of the first sub-pixel, the second sub-pixel, and the third sub-pixel of the second pixel, and the second sub-pixel rendering process is a process of causing the input signal value of the third sub-pixel to be largest and causing the input signal value of the first sub-pixel to be smallest among the input signal values of the first sub-pixel, the second sub-pixel, and the third sub-pixel of the second pixel.

Further, in the display device 10D, preferably, the signal processing unit includes an output processing unit that generates the output signals of the first sub-pixel, the second sub-pixel, the third sub-pixel, and the fourth sub-pixel of the second pixel based on the rendering input signal, and the output processing unit decides an expansion coefficient related to the image display panel, obtains the output signal of the fourth sub-pixel of the second pixel based on the rendering input signals of the first sub-pixel, the second sub-pixel, and the third sub-pixel of the second pixel and the expansion coefficient, obtains the output signal of the first sub-pixel of the second pixel based on the rendering input signal of the first sub-pixel of the second pixel, the output signal of the fourth sub-pixel of the second pixel, and the expansion coefficient, obtains the output signal of the second sub-pixel of the second pixel based on the rendering input signal of the second sub-pixel of the second pixel, the output signal of the fourth sub-pixel of the second pixel, and the expansion coefficient, and obtains the output signal of the third sub-pixel of the second pixel based on the rendering input signal of the third sub-pixel of the second pixel, the output signal of the fourth sub-pixel of the second pixel, and the expansion coefficient.

Further, the pixel arrangement of the display device 10D according to the modification can be applied to the second embodiment. The display device 10D according to the modification includes the image display panel in which a plurality of first thinned pixels each of which includes the first sub-pixel, the second sub-pixel, and the third sub-pixel and a plurality of second thinned pixels each of which includes the first sub-pixel, the second sub-pixel, and the fourth sub-pixel are arranged in the display region of the square shape having the first side and the second side intersecting with the first side in the matrix form. In the first thinned pixel, the first sub-pixel and the second sub-pixel are arranged in the first arrangement along a predetermined direction to be adjacent to each other in the predetermined direction, and the third sub-pixel neighboring the first sub-pixel and the second sub-pixel in the intersection direction is arranged in the second arrangement neighboring the first arrangement in the intersection direction serving as the direction intersecting the predetermined direction. In the second thinned pixel, the first sub-pixel and the second sub-pixel are arranged in the first arrangement along the predetermined direction to be adjacent to each other in the predetermined direction, and the fourth sub-pixel neighboring the first sub-pixel and the second sub-pixel in the intersection direction is arranged in the second arrangement neighboring the first arrangement in the intersection direction. The image display panel receives the image information of the portrait mode in which a direction along the first side is a predetermined one direction of the display image or the landscape mode in which a direction along the second side is the one direction of the display image. The display device 10D further includes the signal processing unit that generates the output signals from the input values of the input signals for the first sub-pixel, the second sub-pixel, and the third sub-pixel, and outputs the generated output signals to the image display panel. The signal processing unit includes the rendering unit that generates the rendering input signal by performing a predetermined sub-pixel rendering process of changing the signal values of the input signals of the sub-pixels of the second pixel when, in the first pixel, the second pixel neighboring the first pixel at a side in a predetermined processing direction, and the third pixel neighboring the second pixel at the side in the processing direction among the plurality of arranged pixels, the difference between the input signal values of the sub-pixels of the first pixel and the input signal values of the sub-pixels of the third pixel is a predetermined threshold value or more. The signal processing unit further includes the pattern information acquiring unit that acquires an arrangement of the sub-pixels in the processing direction of a display mode indicating either of the portrait mode and the landscape mode as pattern information indicating any one of a first arrangement pattern and a second arrangement pattern that differ in the arrangement of the sub-pixels. The signal processing unit further includes the correction process deciding unit that decides whether or not an output signal of the fourth sub-pixel of the second pixel is generated based on the pattern information through a correction process and a fourth sub-pixel generation signal unit that obtains a generation signal of the fourth sub-pixel of the second pixel based on the rendering input signals of the first sub-pixel, the second sub-pixel, and the third sub-pixel of the second pixel, and an expansion coefficient related to the image display panel, based on the decision of the correction process deciding unit. The signal processing unit further includes the fourth sub-pixel output signal generating unit that performs the correction process by performing an averaging process based on the generation signal of the fourth sub-pixel of the second pixel and input signals of other sub-pixels, and generates the output signal of the fourth sub-pixel of the second pixel. The signal processing unit further includes the output signal generating unit that obtains the output signal of the first sub-pixel of the second pixel based on the rendering input signal of the first sub-pixel of the second pixel, the output signal of the fourth sub-pixel of the second pixel, and the expansion coefficient, obtains the output signal of the second sub-pixel of the second pixel based on the rendering input signal of the second sub-pixel of the second pixel, the output signal of the fourth sub-pixel of the second pixel, and the expansion coefficient, and obtains the output signal of the third sub-pixel of the second pixel based on the rendering input signal of the third sub-pixel of the second pixel, the output signal of the fourth sub-pixel of the second pixel, and the expansion coefficient. Here, the processing direction is a direction along the first side of the image display panel when the display mode is the portrait mode and a direction along the second side of the image display panel when the display mode is the landscape mode.

Further, in the display device 10D, preferably, the sub-pixel rendering process is a process of causing the input signal values of the first sub-pixel, the second sub-pixel, and the third sub-pixel of the second pixel to be a value between the first pixel input signal value and the third pixel input signal value and causing the input signal value of the second sub-pixel of the second pixel to be a value between the input signal value of the first sub-pixel of the second pixel and the input signal value of the third sub-pixel of the second pixel.

Further, in the display device 10D, preferably, the sub-pixel rendering process is a process of causing the input signal value of the second sub-pixel of the second pixel to be a value between the input signal value of the first sub-pixel of the second pixel and the third pixel input signal value and causing the input signal value of the third sub-pixel of the second pixel to be a value between the input signal value of the second sub-pixel of the second pixel and the third pixel input signal value.

Further, in the display device 10D, preferably, when the pattern information indicates the second arrangement pattern, the first sub-pixel of the second pixel neighbors a side of the second sub-pixel of the second pixel in the processing direction, or the second sub-pixel of the second pixel neighbors a side of the third sub-pixel of the second pixel in the processing direction, and the correction process deciding unit decides to generate the output signal of the fourth sub-pixel of the second pixel through the correction process when the pattern information indicates the second arrangement pattern.

Further, in the display device 10D, preferably, the sub-pixel rendering process is a process of causing the input signal value of the second sub-pixel in the second pixel to be a value between the input signal value of the first sub-pixel in the second pixel and the first pixel input signal value and causing the input signal value of the third sub-pixel in the second pixel to be a value between the input signal value of the second sub-pixel in the second pixel and the first pixel input signal value.

Further, in the display device 10D, preferably, when the pattern information indicates the first arrangement pattern, the second sub-pixel of the second pixel neighbors a side of the first sub-pixel of the second pixel in the processing direction, or the third sub-pixel of the second pixel neighbors a side of the second sub-pixel of the second pixel in the processing direction, and the correction process deciding unit decides to generate the output signal of the fourth sub-pixel of the second pixel through the correction process when the pattern information indicates the first arrangement pattern.

Further, in the display device 10D, preferably, the correction process deciding unit further decides whether or not the correction process is performed on the second pixel based on a magnitude relation of the rendering input signal values of the first sub-pixel, the second sub-pixel, and the third sub-pixel of the second pixel.

Further, in the display device 10D, preferably, the fourth sub-pixel output signal generating unit generates the output signal of the fourth sub-pixel of the second pixel based on the generation signal of the fourth sub-pixel of the second pixel and the input signal of the first sub-pixel, the input signal of the second sub-pixel or the input signal of the third sub-pixel of the second pixel.

Further, in the display device 10D, preferably, the fourth sub-pixel output signal generating unit generates the output signal of the fourth sub-pixel of the second pixel by averaging the generation signal value of the fourth sub-pixel of the second pixel and a maximum value of the rendering input signal of the first sub-pixel, the rendering input signal of the second sub-pixel, and the rendering input signal of the third sub-pixel of the second pixel.

Further, in the display device 10D, preferably, the fourth sub-pixel output signal generating unit generates the output signal of the fourth sub-pixel of the second pixel based on the generation signal of the fourth sub-pixel of the second pixel and the output signal of the fourth sub-pixel of a pixel neighboring the second pixel.

Further, the pixel arrangement of the display device 10D according to the modification can be applied to the third embodiment. The display device 10D according to the modification includes the image display panel in which a plurality of first thinned pixels each of which includes the first sub-pixel, the second sub-pixel, and the third sub-pixel and a plurality of second thinned pixels each of which includes the first sub-pixel, the second sub-pixel, and the fourth sub-pixel are arranged in the display region of the square shape having the first side and the second side intersecting with the first side in the matrix form. In the first thinned pixel, the first sub-pixel and the second sub-pixel are arranged in the first arrangement along a predetermined direction to be adjacent to each other in the predetermined direction, and the third sub-pixel neighboring the first sub-pixel and the second sub-pixel in the intersection direction is arranged in the second arrangement neighboring the first arrangement in the intersection direction serving as the direction intersecting the predetermined direction. In the second thinned pixel, the first sub-pixel and the second sub-pixel are arranged in the first arrangement along the predetermined direction to be adjacent to each other in the predetermined direction, and the fourth sub-pixel neighboring the first sub-pixel and the second sub-pixel in the intersection direction is arranged in the second arrangement neighboring the first arrangement in the intersection direction. The image display panel receives the image information of the portrait mode in which a direction along the first side is a predetermined one direction of the display image or the landscape mode in which a direction along the second side is the one direction of the display image. The display device 10D includes the signal processing unit that generates the output signals from the input values of the input signals for the first sub-pixel, the second sub-pixel, and the third sub-pixel, and outputs the generated output signals to the image display panel. The signal processing unit includes the rendering unit that generates the rendering input signal by performing a predetermined sub-pixel rendering process of changing the signal values of the input signals of the sub-pixels of the second pixel when, in the first pixel, the second pixel neighboring the first pixel at a side in a predetermined processing direction, and the third pixel neighboring the second pixel at the side in the processing direction among the plurality of arranged pixels, the difference between the input signal values of the sub-pixels of the first pixel and the input signal values of the sub-pixels of the third pixel is a predetermined threshold value or more. The signal processing unit further includes the sub-pixel generation signal unit that generates generation signals of the first sub-pixel, the second sub-pixel, the third sub-pixel, and the fourth sub-pixel based on the input signal values and the rendering input signal values of the sub-pixels in each of the pixels. The signal processing unit further includes the correction process deciding unit that decides whether or not the output signal of the fourth sub-pixel of the second pixel is generated through a correction process based on a generation signal value of a neighboring sub-pixel and generation signal values of both-side sub-pixels, the neighboring sub-pixel is served as a sub-pixel of the second pixel neighboring the fourth sub-pixel of the second pixel in an orthogonal direction serving as a direction orthogonal to the processing direction and the both-side sub-pixels are served as a plurality of sub-pixels neighboring the neighboring sub-pixel or the fourth sub-pixel of the second pixel in the processing direction or an opposite direction serving as a direction opposite to the processing direction. The signal processing unit further includes the fourth sub-pixel output signal generating unit that performs the correction process based on the decision of the correction process deciding unit, by performing an averaging process based on the generation signal of the fourth sub-pixel of the second pixel and input signals of other sub-pixels, and generates the output signal of the fourth sub-pixel of the second pixel. The signal processing unit further includes the output signal generating unit that obtains the output signal of the first sub-pixel of the second pixel based on the rendering input signal of the first sub-pixel of the second pixel, the output signal of the fourth sub-pixel of the second pixel, and the expansion coefficient, obtains the output signal of the second sub-pixel of the second pixel based on the rendering input signal of the second sub-pixel of the second pixel, the output signal of the fourth sub-pixel of the second pixel, and the expansion coefficient, and obtains the output signal of the third sub-pixel of the second pixel based on the rendering input signal of the third sub-pixel of the second pixel, the output signal of the fourth sub-pixel of the second pixel, and the expansion coefficient. The processing direction is a direction along the first side of the image display panel when the image information corresponds to the portrait mode and a direction along the second side of the image display panel when the image information corresponds to the landscape mode.

Further, in the display device 10D, preferably, the correction process deciding unit decides whether or not the output signal of the fourth sub-pixel of the second pixel is generated based on the generation signal of the fourth sub-pixel of the second pixel when the generation signal value of the neighboring sub-pixel is smaller than the generation signal values of the both-side sub-pixels, and a difference between the generation signal value of the neighboring sub-pixel and the generation signal values of the both-side sub-pixels is a predetermined value or more.

Further, in the display device 10D, preferably, the sub-pixel rendering process is a process of causing the input signal values of the first sub-pixel, the second sub-pixel, and the third sub-pixel of the second pixel to be a value between the first pixel input signal value and the third pixel input signal value and causing the input signal value of the second sub-pixel of the second pixel to be a value between the input signal value of the first sub-pixel of the second pixel and the input signal value of the third sub-pixel of the second pixel.

Further, in the display device 10D, preferably, the sub-pixel rendering process is a process of causing the input signal value of the second sub-pixel of the second pixel to be a value between the input signal value of the first sub-pixel of the second pixel and the third pixel input signal value and causing the input signal value of the third sub-pixel of the second pixel to be a value between the input signal value of the second sub-pixel of the second pixel and the third pixel input signal value.

Further, in the display device 10D, preferably, the sub-pixel rendering process is a process of causing the input signal value of the second sub-pixel in the second pixel to be a value between the input signal value of the first sub-pixel in the second pixel and the first pixel input signal value and causing the input signal value of the third sub-pixel in the second pixel to be a value between the input signal value of the second sub-pixel in the second pixel and the first pixel input signal value.

Further, in the display device 10D, preferably, the fourth sub-pixel output signal generating unit generates the output signal of the fourth sub-pixel of the second pixel based on the generation signal of the fourth sub-pixel of the second pixel and the input signal of the first sub-pixel, the input signal of the second sub-pixel or the input signal of the third sub-pixel of the second pixel.

Further, in the display device 10D, preferably, the fourth sub-pixel output signal generating unit generates the output signal of the fourth sub-pixel of the second pixel by averaging the generation signal value of the fourth sub-pixel of the second pixel and a maximum value of the rendering input signal of the first sub-pixel, the rendering input signal of the second sub-pixel, and the rendering input signal of the third sub-pixel of the second pixel.

Further, in the display device 10D, preferably, the fourth sub-pixel output signal generating unit generates the output signal of the fourth sub-pixel of the second pixel based on the generation signal of the fourth sub-pixel of the second pixel and the output signal of the fourth sub-pixel of a pixel neighboring the second pixel.

Application Examples

Figure 35:
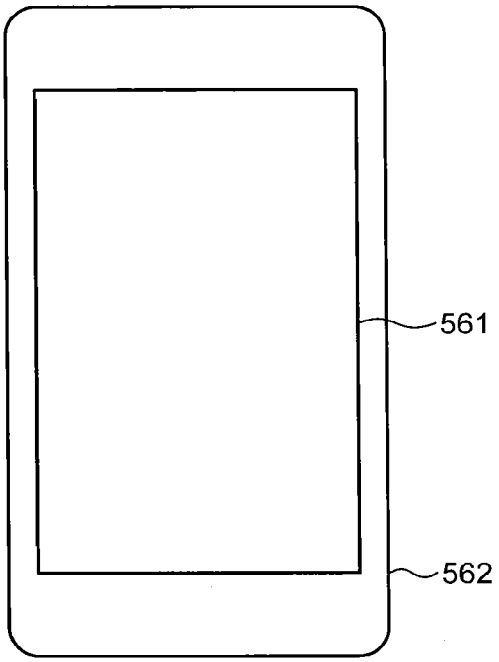
FIG. 35 is a diagram illustrating an example of an electronic apparatus to which the display device according to the first embodiment is applied.

Next, an application example of the display device 10 according to the first embodiment will be described with reference to FIG. 35. FIG. 35 is a diagram illustrating an example of an electronic apparatus to which the display device according to the first embodiment is applied. The display device 10 according to the first embodiment is applicable to electronic apparatuses of all fields such as portable terminal devices such as a mobile phone illustrated in FIG. 35 or video cameras. In other words, the display device 10 according to the first embodiment is applicable to electronic apparatuses of all fields that display video signals input from the outside or internally generated video signals as an image or video. The electronic apparatus includes the control device 11 (see FIG. 1) that supplies the video signals to the display device and controls the operation of the display device. The present application example may also be applicable to the display devices according to the other embodiments and the modifications described above in addition to the display device 10 according to the first embodiment.

An electronic apparatus illustrated in FIG. 35 is a portable information terminal to which the display device 10 according to the first embodiment is applied and that operates as a mobile computer, a multi-functional mobile phone, a mobile computer with a voice call function, or a mobile computer with a communication function and is also called a smartphone or a tablet terminal. The portable information terminal includes a display unit 561 on the surface of a housing 562, for example. The display unit 561 includes the display device 10 according to the first embodiment and a touch detection (so-called a touch panel) function capable of detecting an external proximity object.

The exemplary embodiments according to the present invention have been described above, but the embodiments are not limited to content thereof. The components described above include components that are easily conceivable by those skilled in the art, substantially the same components, and equivalent ones. The components described above can appropriately be combined as well. In addition, various omissions, replacements or changes of the components can be made without departing from the gist of the embodiments described above.

What is claimed is:

1. A display device, comprising:

an image display panel that includes a plurality of pixels that are arranged on a display region of a square shape having a first side and a second side intersecting with the first side in a matrix form and receives image information of a portrait mode in which a direction along the first side is a predetermined one direction of a display image or a landscape mode in which a direction along the second side is the one direction of the display image, each of the plurality of pixels including a first sub-pixel, a second sub-pixel, a third sub-pixel, and a fourth sub-pixel arranged in a 2×2 matrix form; and a signal processing unit that generates output signals from input values of input signals for the first sub-pixel, the second sub-pixel, and the third sub-pixel, and outputs the generated output signals to the image display panel, wherein the signal processing unit includes a rendering position deciding unit that decides whether or not a sub-pixel rendering process is performed, among the plurality of arranged pixels including a first pixel, a second pixel neighboring the first pixel at a side in a predetermined processing direction, and a third pixel neighboring the second pixel at the side in the processing direction, the sub-pixel rendering process changing input signal values of sub-pixels of the second pixel, a pattern information acquiring unit that acquires an arrangement of the sub-pixels in the processing direction of a display mode indicating either of the portrait mode and the landscape mode as pattern information indicating any one of a first arrangement pattern and a second arrangement pattern that differ in the arrangement of the sub-pixels, and a rendering unit that generates rendering input signals of the sub-pixels of the second pixel by performing either of a first sub-pixel rendering process and a second sub-pixel rendering process of the sub-pixel rendering process on input signals of the sub-pixels of the second pixel based on the decision of the rendering position deciding unit and the pattern information, the second sub-pixel rendering process differing from the first sub-pixel rendering process in a change in signal values of the input signals of the sub-pixels, and the processing direction is a direction along the first side of the image display panel when the display mode is the portrait mode and a direction along the second side of the image display panel when the display mode is the landscape mode.

2. The display device according to claim 1, wherein the rendering position deciding unit decides to perform the sub-pixel rendering process on the second pixel when a difference between the input signal values of the sub-pixels in the first pixel and the input signal values of the sub-pixels in the third pixel is a predetermined threshold value or more.

3. The display device according to claim 2, wherein the first sub-pixel rendering process is a process of causing an input signal value of the first sub-pixel in the second pixel to be a signal value between a first pixel input signal value serving as the input signal value of the first pixel and a third pixel input signal value serving as the input signal value of the third pixel, causing an input signal value of the second sub-pixel in the second pixel to be a value between the input signal value of the first sub-pixel in the second pixel and the third pixel input signal value, and causing an input signal value of the third sub-pixel in the second pixel to be a value between the input signal value of the second sub-pixel in the second pixel and the third pixel input signal value, and the second sub-pixel rendering process is a process of causing the input signal value of the first sub-pixel in the second pixel to be a signal value between the first pixel input signal value and the third pixel input signal value, causing the input signal value of the second sub-pixel in the second pixel to be a value between the input signal value of the first sub-pixel in the second pixel and the first pixel input signal value, and causing the input signal value of the third sub-pixel in the second pixel to be a value between the input signal value of the second sub-pixel in the second pixel and the first pixel input signal value.

4. The display device according to claim 3, wherein, when the pattern information indicates the first arrangement pattern, the second sub-pixel of the second pixel neighbors a side of the first sub-pixel of the second pixel in the processing direction, or the third sub-pixel of the second pixel neighbors a side of the second sub-pixel of the second pixel in the processing direction, when the pattern information indicates the second arrangement pattern, the first sub-pixel of the second pixel neighbors a side of the second sub-pixel of the second pixel in the processing direction, or the second sub-pixel of the second pixel neighbors a side of the third sub-pixel of the second pixel in the processing direction, and the rendering unit decides to perform the first sub-pixel rendering process when the pattern information indicates the first arrangement pattern, and decides to perform the second sub-pixel rendering process when the pattern information indicates the second arrangement pattern.

5. The display device according to claim 4, wherein, when the first pixel input signal value is larger than the third pixel input signal value, the first sub-pixel rendering process is a process of causing the input signal value of the first sub-pixel to be largest and causing the input signal value of the third sub-pixel to be smallest among the input signal values of the first sub-pixel, the second sub-pixel, and the third sub-pixel of the second pixel, and the second sub-pixel rendering process is a process of causing the input signal value of the third sub-pixel to be largest and causing the input signal value of the first sub-pixel to be smallest among the input signal values of the first sub-pixel, the second sub-pixel, and the third sub-pixel of the second pixel.

6. The display device according to claim 1, wherein the signal processing unit includes an output processing unit that generates the output signals of the first sub-pixel, the second sub-pixel, the third sub-pixel, and the fourth sub-pixel of the second pixel based on the rendering input signal, and the output processing unit decides an expansion coefficient related to the image display panel, obtains the output signal of the fourth sub-pixel of the second pixel based on the rendering input signals of the first sub-pixel, the second sub-pixel, and the third sub-pixel of the second pixel and the expansion coefficient, obtains the output signal of the first sub-pixel of the second pixel based on the rendering input signal of the first sub-pixel of the second pixel, the output signal of the fourth sub-pixel of the second pixel, and the expansion coefficient, obtains the output signal of the second sub-pixel of the second pixel based on the rendering input signal of the second sub-pixel of the second pixel, the output signal of the fourth sub-pixel of the second pixel, and the expansion coefficient, and obtains the output signal of the third sub-pixel of the second pixel based on the rendering input signal of the third sub-pixel of the second pixel, the output signal of the fourth sub-pixel of the second pixel, and the expansion coefficient.

7. A display device, comprising:

an image display panel that includes a plurality of pixels that are arranged on a display region of a square shape having a first side and a second side intersecting with the first side in a matrix form and receives image information of a portrait mode in which a direction along the first side is a predetermined one direction of a display image or a landscape mode in which a direction along the second side is the one direction of the display image, each of the plurality of pixels including a first sub-pixel, a second sub-pixel, a third sub-pixel, and a fourth sub-pixel arranged in a 2×2 matrix form; and a signal processing unit that generates output signals from input values of input signals for the first sub-pixel, the second sub-pixel, and the third sub-pixel, and outputs the generated output signals to the image display panel, wherein the signal processing unit includes a rendering unit that generates a rendering input signal by performing a predetermined sub-pixel rendering process, the plurality of arranged pixels including a first pixel, a second pixel neighboring the first pixel at a side in a predetermined processing direction, and a third pixel neighboring the second pixel at the side in the processing direction, the predetermined sub-pixel rendering process changing signal values of input signals of sub-pixels of the second pixel, a pattern information acquiring unit that acquires an arrangement of the sub-pixels in the processing direction of a display mode indicating either of the portrait mode and the landscape mode as pattern information indicating any one of a first arrangement pattern and a second arrangement pattern that differ in the arrangement of the sub-pixels, a correction process deciding unit that decides whether or not an output signal of the fourth sub-pixel of the second pixel is generated based on the pattern information through a correction process, a fourth sub-pixel generation signal unit that obtains a generation signal of the fourth sub-pixel of the second pixel based on the rendering input signals of the first sub-pixel, the second sub-pixel, and the third sub-pixel of the second pixel, and an expansion coefficient related to the image display panel, based on the decision of the correction process deciding unit, a fourth sub-pixel output signal generating unit that performs the correction process by performing an averaging process based on the generation signal of the fourth sub-pixel of the second pixel and input signals of other sub-pixels, and generates the output signal of the fourth sub-pixel of the second pixel, an output signal generating unit that obtains the output signal of the first sub-pixel of the second pixel based on the rendering input signal of the first sub-pixel of the second pixel, the output signal of the fourth sub-pixel of the second pixel, and the expansion coefficient, obtains the output signal of the second sub-pixel of the second pixel based on the rendering input signal of the second sub-pixel of the second pixel, the output signal of the fourth sub-pixel of the second pixel, and the expansion coefficient, and obtains the output signal of the third sub-pixel of the second pixel based on the rendering input signal of the third sub-pixel of the second pixel, the output signal of the fourth sub-pixel of the second pixel, and the expansion coefficient, and the processing direction is a direction along the first side of the image display panel when the display mode is the portrait mode and a direction along the second side of the image display panel when the display mode is the landscape mode.

8. The display device according to claim 7, wherein the sub-pixel rendering process is a process of causing the input signal values of the first sub-pixel, the second sub-pixel, and the third sub-pixel of the second pixel to be a value between the first pixel input signal value and the third pixel input signal value, and causing the input signal value of the second sub-pixel of the second pixel to be a value between the input signal value of the first sub-pixel of the second pixel and the input signal value of the third sub-pixel of the second pixel.

9. The display device according to claim 8, wherein the sub-pixel rendering process is a process of causing the input signal value of the second sub-pixel of the second pixel to be a value between the input signal value of the first sub-pixel of the second pixel and the third pixel input signal value, and causing the input signal value of the third sub-pixel of the second pixel to be a value between the input signal value of the second sub-pixel of the second pixel and the third pixel input signal value.

10. The display device according to claim 9, wherein, when the pattern information indicates the second arrangement pattern, the first sub-pixel of the second pixel neighbors a side of the second sub-pixel of the second pixel in the processing direction, or the second sub-pixel of the second pixel neighbors a side of the third sub-pixel of the second pixel in the processing direction, and the correction process deciding unit decides to generate the output signal of the fourth sub-pixel of the second pixel through the correction process when the pattern information indicates the second arrangement pattern.

11. The display device according to claim 8, wherein the sub-pixel rendering process is a process of causing the input signal value of the second sub-pixel in the second pixel to be a value between the input signal value of the first sub-pixel in the second pixel and the first pixel input signal value, and causing the input signal value of the third sub-pixel in the second pixel to be a value between the input signal value of the second sub-pixel in the second pixel and the first pixel input signal value.

12. The display device according to claim 11, wherein, when the pattern information indicates the first arrangement pattern, the second sub-pixel of the second pixel neighbors a side of the first sub-pixel of the second pixel in the processing direction, or the third sub-pixel of the second pixel neighbors a side of the second sub-pixel of the second pixel in the processing direction, and the correction process deciding unit decides to generate the output signal of the fourth sub-pixel of the second pixel through the correction process when the pattern information indicates the first arrangement pattern.

13. The display device according to claim 8, wherein the correction process deciding unit further decides whether or not the correction process is performed on the second pixel based on a magnitude relation of the rendering input signal values of the first sub-pixel, the second sub-pixel, and the third sub-pixel of the second pixel.

14. The display device according to claim 7, wherein the fourth sub-pixel output signal generating unit generates the output signal of the fourth sub-pixel of the second pixel based on the generation signal of the fourth sub-pixel of the second pixel and the input signal of the first sub-pixel, the input signal of the second sub-pixel or the input signal of the third sub-pixel of the second pixel.

15. A display device, comprising:

an image display panel that includes a plurality of pixels that are arranged on a display region of a square shape having a first side and a second side intersecting with the first side in a matrix form and receives image information of a portrait mode in which a direction along the first side is a predetermined one direction of a display image or a landscape mode in which a direction along the second side is the one direction of the display image, each of the plurality of pixels including a first sub-pixel, a second sub-pixel, a third sub-pixel, and a fourth sub-pixel arranged in a 2×2 matrix form; and a signal processing unit that generates output signals from input values of input signals for the first sub-pixel, the second sub-pixel, and the third sub-pixel, and outputs the generated output signals to the image display panel, wherein the signal processing unit includes a rendering unit that generates a rendering input signal by performing a predetermined sub-pixel rendering process, the plurality of arranged pixels including a first pixel, a second pixel neighboring the first pixel at a side in a predetermined processing direction, and a third pixel neighboring the second pixel at the side in the processing direction, the predetermined sub-pixel rendering process changing signal values of input signals of sub-pixels of the second pixel, a sub-pixel generation signal unit that generates generation signals of the first sub-pixel, the second sub-pixel, the third sub-pixel, and the fourth sub-pixel based on the input signal values and the rendering input signal values of the sub-pixels in each of the pixels, a correction process deciding unit that decides whether or not the output signal of the fourth sub-pixel of the second pixel is generated through a correction process based on a generation signal value of a neighboring sub-pixel and generation signal values of both-side sub-pixels, the neighboring subpixel is served as a sub-pixel of the second pixel neighboring the fourth sub-pixel of the second pixel in an orthogonal direction serving as a direction orthogonal to the processing direction, and the both-side sub-pixels are served as a plurality of sub-pixels neighboring the neighboring sub-pixel or the fourth sub-pixel of the second pixel in the processing direction or an opposite direction serving as a direction opposite to the processing direction, a fourth sub-pixel output signal generating unit that performs the correction process based on the decision of the correction process deciding unit, by performing an averaging process based on the generation signal of the fourth sub-pixel of the second pixel and input signals of other sub-pixels, and generates the output signal of the fourth sub-pixel of the second pixel, an output signal generating unit that obtains the output signal of the first sub-pixel of the second pixel based on the rendering input signal of the first sub-pixel of the second pixel, the output signal of the fourth sub-pixel of the second pixel, and an expansion coefficient, obtains the output signal of the second sub-pixel of the second pixel based on the rendering input signal of the second sub-pixel of the second pixel, the output signal of the fourth sub-pixel of the second pixel, and the expansion coefficient, and obtains the output signal of the third sub-pixel of the second pixel based on the rendering input signal of the third sub-pixel of the second pixel, the output signal of the fourth sub-pixel of the second pixel, and the expansion coefficient, and the processing direction is a direction along the first side of the image display panel when the image information corresponds to the portrait mode and a direction along the second side of the image display panel when the image information corresponds to the landscape mode.

16. The display device according to claim 15, wherein the correction process deciding unit decides whether or not the output signal of the fourth sub-pixel of the second pixel is generated based on the generation signal of the fourth sub-pixel of the second pixel, when the generation signal value of the neighboring sub-pixel is smaller than the generation signal values of the both-side sub-pixels, and a difference between the generation signal value of the neighboring sub-pixel and the generation signal values of the both-side sub-pixels is a predetermined value or more.

17. The display device according to claim 15, wherein the sub-pixel rendering process is a process of causing the input signal values of the first sub-pixel, the second sub-pixel, and the third sub-pixel of the second pixel to be a value between the first pixel input signal value and the third pixel input signal value and causing the input signal value of the second sub-pixel of the second pixel to be a value between the input signal value of the first sub-pixel of the second pixel and the input signal value of the third sub-pixel of the second pixel.

18. The display device according to claim 17, wherein the sub-pixel rendering process is a process of causing the input signal value of the second sub-pixel of the second pixel to be a value between the input signal value of the first sub-pixel of the second pixel and the third pixel input signal value, and causing the input signal value of the third sub-pixel of the second pixel to be a value between the input signal value of the second sub-pixel of the second pixel and the third pixel input signal value.

19. The display device according to claim 17, wherein the sub-pixel rendering process is a process of causing the input signal value of the second sub-pixel in the second pixel to be a value between the input signal value of the first sub-pixel in the second pixel and the first pixel input signal value, and causing the input signal value of the third sub-pixel in the second pixel to be a value between the input signal value of the second sub-pixel in the second pixel and the first pixel input signal value.

20. The display device according to claim 15, wherein the fourth sub-pixel output signal generating unit generates the output signal of the fourth sub-pixel of the second pixel based on the generation signal of the fourth sub-pixel of the second pixel and the input signal of the first sub-pixel, the input signal of the second sub-pixel or the input signal of the third sub-pixel of the second pixel.

* * * * *